US007860639B2

(12) United States Patent
Yang

(10) Patent No.: US 7,860,639 B2
(45) Date of Patent: Dec. 28, 2010

(54) ROAD TRAFFIC CONTROL METHOD AND TRAFFIC FACILITIES

(75) Inventor: Shaopeng Yang, Tianjing (CN)

(73) Assignees: Shaoping Yang, Tianjin (CN); Qinghe Wang, Panjin (CN)

( * ) Notice: Subject to any disclaimer, the term of this patent is extended or adjusted under 35 U.S.C. 154(b) by 1076 days.

(21) Appl. No.: 10/547,055

(22) PCT Filed: Feb. 26, 2004

(86) PCT No.: PCT/CN2004/000144

§ 371 (c)(1),
(2), (4) Date: Feb. 2, 2006

(87) PCT Pub. No.: WO2004/077377

PCT Pub. Date: Sep. 10, 2004

(65) Prior Publication Data

US 2006/0155427 A1 Jul. 13, 2006

(30) Foreign Application Priority Data

Feb. 27, 2003 (CN) ..... 03 1 06914

(51) Int. Cl.
*G06G 7/76* (2006.01)

(52) U.S. Cl. ..... 701/117; 701/1; 701/23; 701/24; 340/901; 340/907; 340/910; 340/933

(58) Field of Classification Search ..... 701/117, 701/1, 23, 24; 340/901, 907, 910, 933
See application file for complete search history.

(56) References Cited

U.S. PATENT DOCUMENTS

RE31,044 E * 9/1982 McReynolds et al. ..... 701/118
5,257,194 A * 10/1993 Sakita ..... 701/117
5,278,554 A * 1/1994 Marton ..... 340/910
5,330,278 A * 7/1994 Raswant ..... 404/1
5,357,436 A * 10/1994 Chiu ..... 701/117
5,778,332 A * 7/1998 Chang et al. ..... 701/117
5,821,878 A * 10/1998 Raswant ..... 340/907
5,928,294 A * 7/1999 Zelinkovsky ..... 701/24
6,151,550 A * 11/2000 Nakatani ..... 701/117
6,167,331 A * 12/2000 Matsumoto et al. ..... 701/23
6,246,955 B1 * 6/2001 Nishikawa et al. ..... 701/117
6,281,808 B1 * 8/2001 Glier et al. ..... 340/933
6,480,783 B1 * 11/2002 Myr ..... 701/117
6,577,246 B1 * 6/2003 Handa et al. ..... 340/901
6,760,061 B1 * 7/2004 Glier et al. ..... 348/149

* cited by examiner

*Primary Examiner*—Khoi Tran
*Assistant Examiner*—Stephen Holwerda
(74) *Attorney, Agent, or Firm*—Matthias Scholl P.C.; Matthias Scholl

(57) ABSTRACT

The invention relates to a road traffic control method and corresponding traffic facilities. The method includes: setting roads mounted or vehicles mounted devices for controlling queens passing; setting associated traffic facilities which assist controlling queens; guiding, including and controlling to vehicle flows in various directions by the above devices and facilities; arranging the vehicle queens into sequential array at the same time or by turns in roads and crosses according to preset procedure. By the method, the vehicle flows can pass continuously or non-continuously without crossing or with less crossing in multi-driveway road. The invention has small investment, wide application and can greatly improve the cross passing ability.

9 Claims, 41 Drawing Sheets

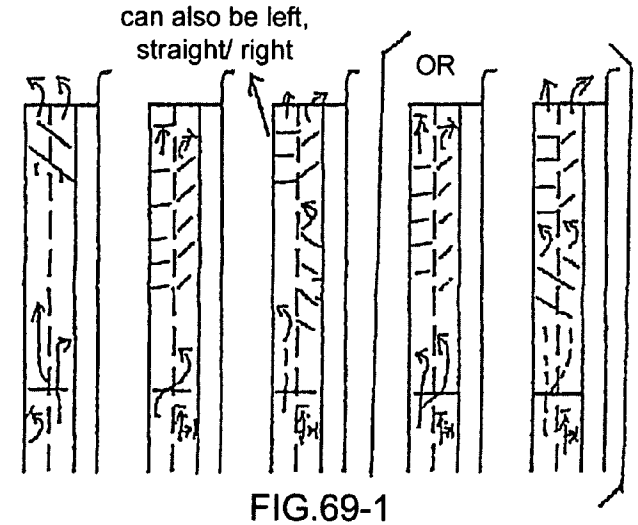
FIG.69-1
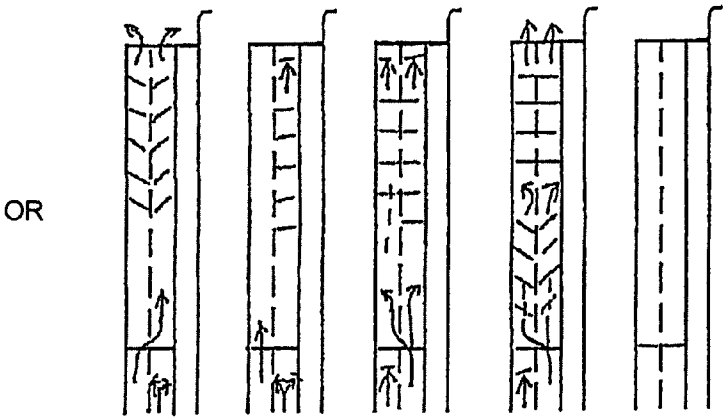
FIG.69-2
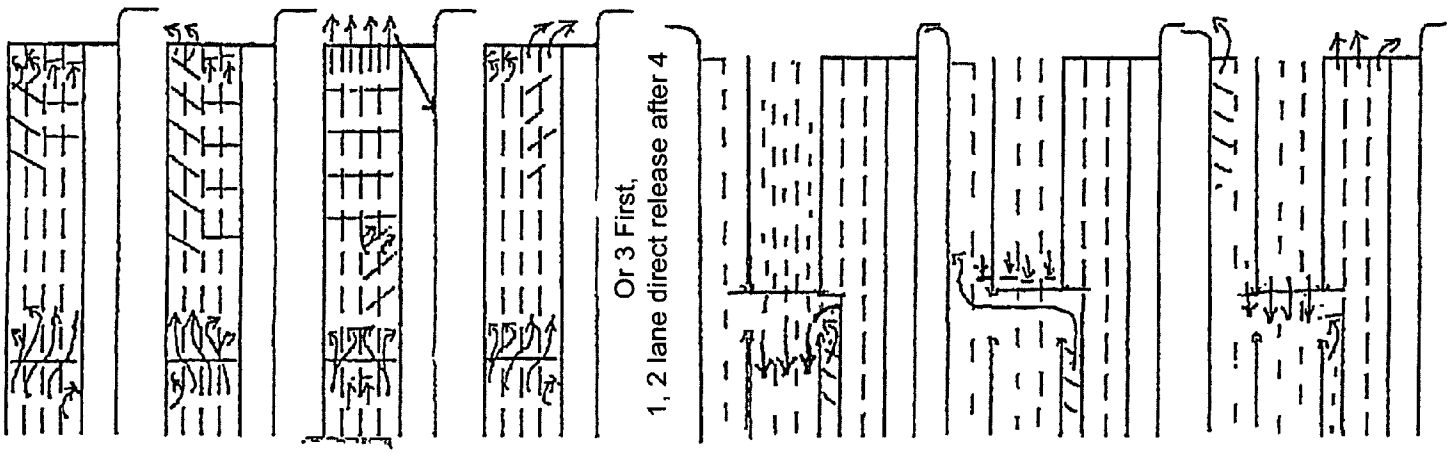
FIG.70
FIG.71-3

ROAD TRAFFIC CONTROL METHOD AND TRAFFIC FACILITIES

BACKGROUND OF THE PRESENT INVENTION

1. Field of Invention

The present invention relates to a method of road controlling traffic and a device thereof.

2. Description of Related Arts

Recently, road traffic is commonly controlled according to traffic flow of all directions, the number of lanes and so forth, such that the scenarios of splitting direction or mixed direction traffic flow is created, such as two-phase and multi-phase control. Fixed periodic, sensor, self-relieving control technology, and the developing intelligent traffic control technology, such as intelligent traffic system (ITS), are all base on the same technique. Road traffic usually relies on traffic sign and traffic line as a guidance to realize directional or mixed traffic flow. Even the most advance technologies, such as traffic navigation, cruise control, and intelligent traffic system ITS, only divide traffic lanes and speed to control the traffic flow.

As to the control facility and device, whether it is an intersection, or section of a road, whether it is a single point intersection or road lane control or road network surface controls, and whether it is traditional facility or new device, such as signal for intersection control and new pixels signal panel, traditional single-point fixed period, sensor control device, and all kinds of new intelligent advanced control system, such as SCOOT or ITS, traditional sensor coil for vehicles and new graphics monitoring device, and the developing beacon, navigation and cruise control devices, the structure, theory, and function are all evolved around the realization of the above mentioned simple control target according to division of direction based on the lanes or directional traffic flow of mixed traffic, or natural traffic flow condition, the core of the control theory relies on the contemporary traffic flow model. The characteristic of contemporary control method is that it is better in connection by the direction of cars crossing the intersection, traffic flow and lining up of traffic.

WO99/53460 a compound traffic control method and device, wherein it mainly adds a preset compound signal, control traffic flow from all direction to enter areas controlled by compound signal and traditional signal light in order, so as to achieve multi-lane traffic flow. 01108206.2 illustrates a duplex control method and device. Other than adding directional instruction, the preset duplex signal light basically referred to the compound traffic control method and device. The two methods only put up preset signal light in intersections, wherein the theory of controlling in advance the traffic flow of multi-lanes traffic is similar to the contents of the present invention. However, when it comes to applicable area, control theory, control plan, installation of device, structure and procedure, and parameter, the present invention is obviously totally different or have a great difference with the previous disclosure, wherein the previous disclosure contains fatal shortcomings or limitations and immature, such as applicable area is small, technical plan not logical, low in effectiveness, control procedure and parameter device has error, error in the traffic flow model fundamental concept, device is simple and out-dated, poor in effect, increase in delays, low in practicability.

Contemporary technology is deficient in the sense that both the hardware and software do not deal with nor realize preset high efficiency order arrangement of perpendicular or parallel to traffic flow, and controlled guidance to traffic and the corresponding installation of devices. There exists conflicts, inability to fully make use of the passage space of intersections, low efficiency or huge delays, such as although there is a green signal in an intersection two phase control and all lanes can be opened, the left turning traffic flow will conflict with the straight going vehicles and the right turning traffic will conflict with the straight going non-motorized vehicles, such that the order within the intersection is messed up, such that traffic flow is reduced and the occurrence of a certain degree of obstruction of traffic flow, such that the flow is reduced. Even though multi-phase control can solve the problem x-shaped conflict of the intersection, increase the order and speed of traffic flow since the traffic flow of all directions are released at a different time, traffic is nevertheless partially released according to the section of the road, such that not all the car lanes, or the maximized number of lanes can be used at the same time, limiting traffic passage and increase in delays.

SUMMARY OF THE PRESENT INVENTION

A main object of the present invention is to prevent having the deficiencies brought on by existing technologies, and to provide a traffic control method and a corresponding device for fully making use an intersection or a section of the road, so as to guarantee a good traffic order, increase the passage rate of intersections, reduce delays, and to carry out pre-platoon line up flow to control and guide traffic flow.

Accordingly, in order to accomplish the above objects, the present invention provides a system for assessing injury compensation claim made by a claimant, comprising:

a standardized data collection system for collecting an injury claim data from the claimant, wherein the data collection system has a coding system limiting a manner of which the injury claim data is collected;

a claim information database provided for storing the injury claim data collected from the claimant;

a means for inputting the injury claim data into the claim information database; and an error detection system comprising a first database containing data of prior injury claims, wherein the injury claim data is compared with the first database such that problematic injury compensation claim can be detected.

These and other objectives, features, and advantages of the present invention will become apparent from the following detailed description, the accompanying drawings, and the appended claims.

DETAILED DESCRIPTION OF THE PREFERRED EMBODIMENT

The present invention can make use of the below technological plan and installation of device to realize the objective of the present invention.

Traffic control method, or platoon line up control, comprises a road-installed or a vehicle-installed platoon line up control device, and relating traffic signal, road markings, partitioning facilities for assisting platoon line up control, so as to guide and instructionally control the entire or part of the traffic flow in all or partial directions of motorized vehicles, non-motorized vehicles when they are in intersections, and road segments to follow the steps of a predetermined or automatic sensing optimization and intelligence, so as to make use of a control method such that there is at least a period of time where there is multi-directional multi-lane or multi-segment, or multi-point traffic flow platoon line up at the same time, or gradually line up platoon line up, to line up in a ordered traffic platoon line up with a predetermined form, order, quantity, and variable speed, so as to realize a continuous or discontinuous multi-lane traffic flow with no overlapping or minimal overlapping. It has three main types of control method, namely, dynamic arrangement of a moving-traffic road segment, fixed area platoon line up of intersection and road segment, and the combination of the first two, a combined platoon line up, including all types of traffic control technology or device facility developed, combined or improved from the above methods. The above mentioned vehicles platoon line up includes formation of all forms of vehicle arrangement, in order to distinguish from ordinary lining up of cars. The dynamic platoon line up of the moving traffic of a road segment can optimize the reduction of delays, the effect of the dynamic platoon line up is very distinguished, and is the objective of the invention. Fixed-area platoon line up and combined platoon line up control can be seen as a follow up supplement or a spare control method of road segment dynamic platoon line up control, however, due to simple description and understanding, they are referred to as fixed area platoon line up control in this description.

Device facility in accordance of traffic control method, comprising at least a road-installed or a vehicle-installed device, more than one platoon line up through traffic control handling and driver device, instruction and guidance device of through traffic of platoon line up, or control execution device, and related signs, road sighs, partitioning facilities, and a choice of: inspection or monitor, signal display guidance, beacon, localization, navigation, device for navigation guidance identification, vehicle location monitoring maintenance, and drive control; device facility is installed according to the need of platoon line up control, including combined use with original device facility, containing the function and process of performing platoon line up control and related assisting control, which can be a new use of a traditional device facility, new connection or an improved form, or can be a new use device, or can be a functional parts or functional module, wherein many combinations can be achieved, wherein at least part of the device form, function, structure, theory, flow, or process or other traffic control device facility is different from the traditional traffic control devices, wherein mechanical or non-device can be used by itself or combined. According to different platoon line up control need, condition and other factors, the function, device form of platoon line up control device facility can be adjusted accordingly. Simple disposition choices are available containing directional, distance markings, inspecting or monitoring device inspecting directional flow rate, control device calculating and emitting on platoon line up signal board platoon line up guidance signal and instruction that contains direction, speed, distance between cars, platoon line up order, platoon line up shape, method of dislocation, acceleration or deceleration, so as to realize dynamic platoon line up.

When compared with existing technology, the plan of the present technology has the following advantage and effects.

After correlation calculation, when compared with existing control methods, platoon line up control can increase the flow rate through an intersection by the maximum of three times, and because of the difference of flow rate, congestion and backing up condition, the rate of reduction of average delay can be as high as ten folds or a few ten folds. Using a four way intersection which flow rate is saturated as an example for simple theoretical calculation, wherein both directions of each of the four crossing sections has three lanes, in order for simple calculation, it is assumed that the saturated flow rate of all lanes are equal during peak time, wherein left turning, straight and right turning traffic each has x number of cars, queuing and backing up condition are equal, and delay is about three cycles. If using the commonly used left/right same phase and four phases control flow, the traffic flow of each direction has an average of q cars per second, and then each crossing section is to be allowed to flow for 2x/q seconds. If vehicles from all direction uniformly form three rows in advance, using B method allowing all three rows to pass through at the same time, then each of the crossing section only has to be allowed to flow for 2x/3q seconds, wherein flow time has been reduced by a third (⅓) from the original flow time, and, within the same period of time, the power of flow is increased by three times. Applying a simplified delay analysis having the concept of "the delay time of starting from the time of making first stop to the time of crossing the stopping line" and the theory of calculus of the average delay of a single car is half of the greatest delay time of a single car, the platoon line up delay time can be calculated: $d'=Tm/2=(\text{wherein } T\ \text{flow}-T\ \text{stop}-T\ \text{smooth})/2$. Tm is the greatest delay of a single vehicle in the platoon line up, T flow is the moment when the first vehicle of the row after the last queuing or end of the last platoon line up cycle crosses the stop line after being allowed to flow, T stop is the time when the first vehicle at the end of the last queuing or end of the last platoon line up cycle is stopped for the first time after moving forward to the guiding area or beyond the stopping line, and T smooth is the amount of time when vehicles are passing through the delayed road segment with a smooth speed. Under serious calculation, the average platoon line up delaying time is in accordance to the weighted average of all direction of vehicle flow of all leading road the entire intersection or the vehicles intersection unit of all entrance into the intersection, which is the total flow $d'=(\Sigma qi*Tmi/2)/Q$, from experience, $d'<C'/2$, road segment dynamic platoon line up and combined platoon line up, or the more the platoon line up lanes, the simpler the platoon line up, the smaller the platoon line up area, then d' is closer to $(C'-g')/2$. Because the flow rate of all four direction of the intersection is equivalent, therefore $g'\approx C'/4$, also, post-platoon line up control period C' can also be reduced to a third (⅓) of the original period C, then $d'\approx(C'-g')/2=(C'-C'/4)/2=3C'/8\approx C/8$, then $d'/d\approx(C/8)/3C\approx 1/24$, wherein having applied the platoon line up control, the delay time is reduced by approximately 1/24 of the original delay time. The larger the original delay time, the greater the reduction of the delay time after the application of the platoon line up control.

Platoon line up control is very effective, to certain degrees, it can replace road-standing traffic facilities across intersections which not only ruin the view of the environment, but also cost billions of dollars, wherein the platoon line up control is estimated to cost about fifty to a hundred thousand dollars, wherein the cost effectiveness ratio between the platoon line up control and road-standing traffic facilities is above 1000:1, which has a huge economical benefit. Regarding reduction of energy consumption and pollution, according to an average of 20 intersections that a vehicle will pass through that platoon line up control can be applied, that each of those intersections has a reduction in delay of 50 s and that each small capacity vehicle has an average gas consumption of 0.8 kg/h, each vehicle can reduce gas consumption of 81 kg per year, which would reduce money spent on gasoline by about 360 dollars (according to gasoline price in year 2005), such that the entire country could reduce money spent on gasoline by about 20 billion a year. Because of a reduction of pollution by car exhaust, wear and tear of vehicles, and travel time, the indirect social consumption reduction, creating of economy and the value to the environment can simply not be measured easily.

In a dynamic platoon line up within a moving-traffic road segment, vehicle passing speed, operational delay and vehicle front portion time-distance are better, its traffic passage power is essentially the same as or higher than that of fixed-area control, and can optimize the prevention of traffic jam across an intersection, reduce or even eliminate intersection delays, and at the same time, minimize the fuel consumption for vehicle starting and pollution due to car exhaust. Improvements in traffic efficiency, economy and social effect can be seen.

The traffic passage power of a combined platoon line up is essentially the same as the effects of the two above-mentioned controls, containing both the advantages of the two above-mentioned controls.

The application areas of platoon line up control is very broad, including lanes for non-motorized vehicles, platoon line up control can be applied to at least the segments and intersections of two lanes, the effect of which is very outstanding, and which has great effects in improving traffic passage power of an intersection and traffic order, reduce delay, reduce energy consumption and pollution, slow down green-house effect, improve the environment, and saving money to be spent on infrastructure, the effect is especially noticeable when the traffic flow rate is high. It creates a new path for solving traffic dilemmas, creates huge benefits to the economy and the society, and has a bright application future. It means especially more in cities where road conditions are hard to improve and in under-developed countries. As ITS or the like intelligent intersection control and automatic guidance technology method are advancing and applied, platoon line up control will obtain more advanced technological support, such that its application effect is will be even more obvious, and at the same time becomes a very important content of ITS or the like traffic control system.

DESCRIPTION OF THE DRAWINGS

Combining drawings and embodiment to further explain describe the content of the present technology

FIGS. 26, 27, 28, 29-1/2/3 and 30 illustrate the methods derived from platoon line up control.

FIG. 58-71-1/2/3 are supplemental diagrams illustrating all types of platoon line up control flow (the changing of control method is shown within the brackets).

All flow diagrams of the drawings is ordered from left to right, the arrowheads in which represent the direction of vehicle flow, horizontal lines and left/right slanted line shadings represent the actual condition of straight going or left/right turning vehicle flow, and the guiding area and lanes changing area are not marked.

Referring to FIG. 1-6, a few ideal types of basic platoon line up passage control method example of fixed area platoon line up control are first illustrated:

Platoon line up control comprises control of the formation of vehicle flow continuous platoon line up passage or non-continuous platoon line up passage, or vehicles, under the circumstances of without passage instruction guiding signal control or automatic control after the formation of platoon line up control, pass through intersections or road segments.

Figure 1:
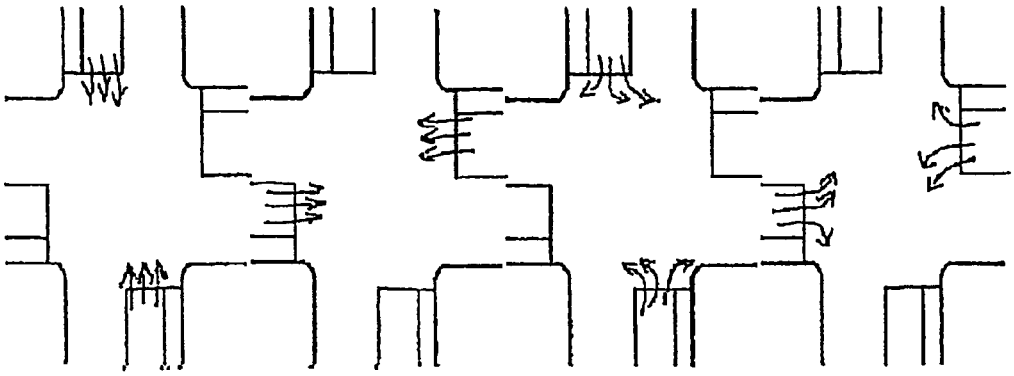
FIG. 1 is a control flow diagram of illustrating a non-continuous platoon line up traffic flow.
Figure 2:
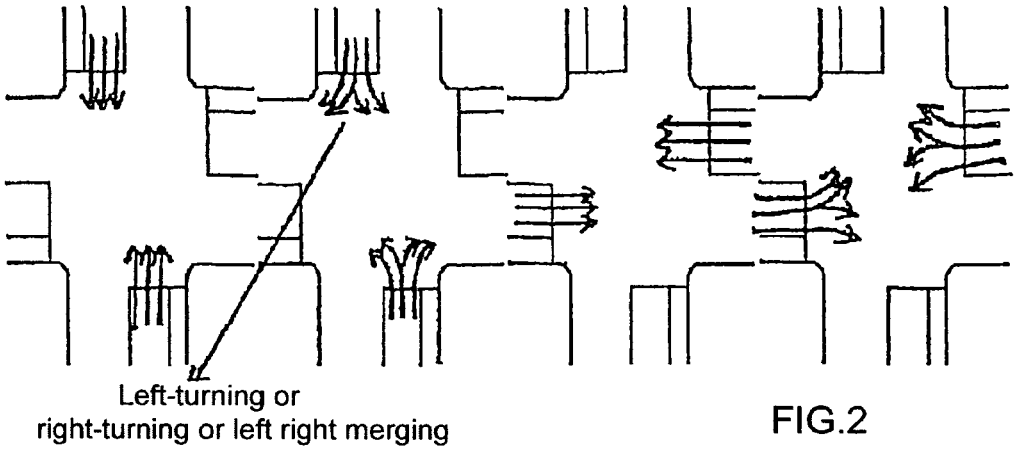
FIG. 2 is a control flow diagram illustrating method A releasing control.

Using three lanes as an example, if according to the control method of FIG. 1, lining up as two vehicle platoon line ups before in the guiding road according to the order, four-phase control release, so that the tail of the platoon line up cannot form continuous release as the head of platoon line up of traffic flow, the middle has break a phase that is in the straight direction, so that the platoon line up area will be occupied for a long time before the release of traffic flow of the tail of the platoon line up, affecting the platoon line up formation of the following traffic flow, at the same time, time lost during green signal increases. The more the gaping phase are, the lower the efficiency and higher the number of interruptions. In order to form platoon line up continuous release of traffic flow, there are a few methods, such as:

A: As shown in FIG. 2, the two direction traffic flows under the same cross section (such as non-crossing left and right, straight going and right going), has same platoon line up or same phase release, so as to form continuous platoon line up passage, such as in order or anti-order cycle release of straight, left-right same phase or left, straight-right same phase. During a heavier right turning traffic flow, a portion of the road can be used for straight going left-right same phase release. This is referred to as method A.

Figure 3:
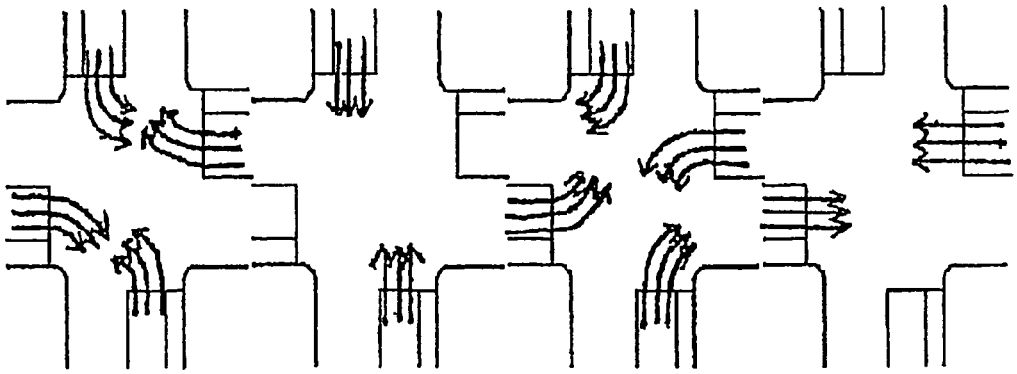
FIG. 3 is a control flow diagram illustrating method B releasing control.

B: As shown in FIG. 3, traffic is released through a repeated continuous platoon line up order of left, straight going, right, or right, straight going and left. This is referred to as method B.

Figure 4:
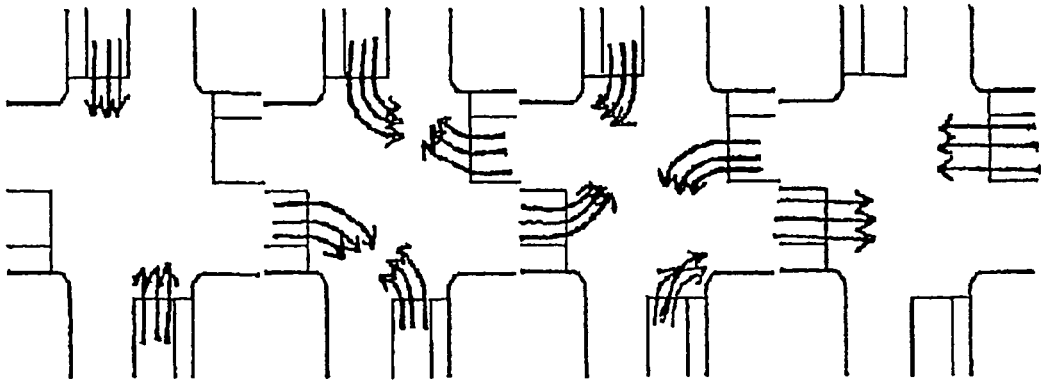
FIG. 4 is a control flow diagram illustrating method C releasing control.

C: As shown in FIG. 4, one direction has a continuous passage platoon line up order of straight going, left/right, right/left; the other direction has a cycle of right/left, left/right and straight going. This is referred to as method C.

Figure 5:
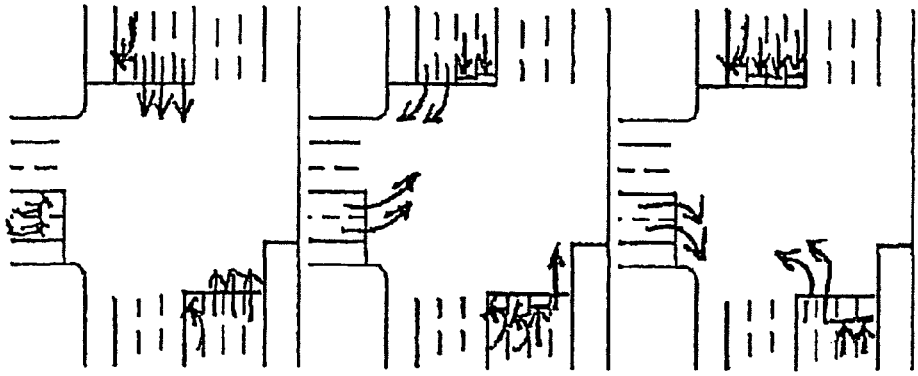
FIGS. 5 and 6 is a control flow diagram illustrating method D for other continuous platoon line up passage control.
Figure 6:
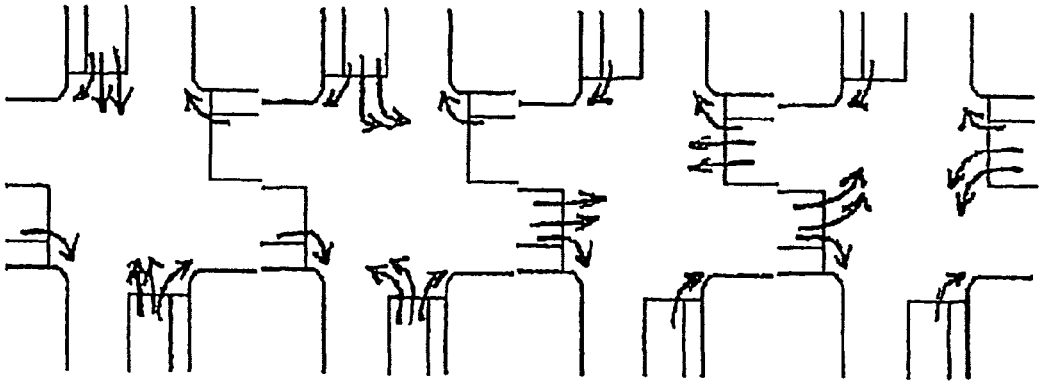

D: FIG. 5, 6, shows methods other than methods A, B and C, such as continuous platoon line up passage control that are more than or lack of flow direction, vehicle platoon line up, phase or continuous right turning traffic flow or cross phase passage, T shape, multi-crossing or other irregular shaped intersection condition. This is referred to as method D.

Cross phase, early-cut-off or slow-operation, more than or lack of flow direction or vehicle platoon line up, more than or lack of phase, or other forms developed from special need (such as during some period of method C where right turning vehicle will borrow crossing left/right phase release) of the above control method such as continuous platoon line up passage control, all belong to their own type:

Non-continuous platoon line up of traffic flow similar to FIG. 1 has a low efficiency and a poor order. Obviously, according to the above mentioned platoon line up control plan and theory of the present invention, the passage power of platoon line up control of intersection cross-section is obviously greater than traditional control. The passage power control values of all types of cross-section, all control plans are calculated according to theories of traffic engineering and traffic control.

Platoon line up control includes formation of simultaneous platoon line up formation or gradual in-order platoon line up control of combined multi-directional (at least one direction) multi-lane or multi-segment or multi-point traffic flow for at least a period of time, referring to FIG. 7-21, wherein simultaneous platoon line up control method of multi-directional and multi-lane of fixed-area platoon line up control is first introduced.

The formation of simultaneous platoon line up formation or gradual in-order platoon line up control of combined multi-directional (at least one direction) multi-lane or multi-segment or multi-point traffic flow for at least a period of time can be control methods such as cross phase or cross platoon line up area platoon line up, platoon line up merging, borrow-lane platoon line up, follow-movement platoon line up, group/mixed platoon line up. Cross phase/cross platoon line up area platoon line up: control the allocation of devices that guide the speed, direction, distance between, position, order, form, of traffic flow, or control platoon line up area, platoon line up passage and the control points of positions of the beginning, splitting and merging, passages and spaced required by staggering platoon line up, so as to form control procedure and method of simultaneous platoon line up formation of combined multi-directional multi-lane or multi-segment or multi-point traffic flow for at least a period of time. Platoon line up merging: according to the control procedure and method of the need of controlling traffic filling, merging of a portion of certain row, segment of dynamic, static platoon line up area or moving-line, there are chain displacement and one car at a time passage control, platoon line up can be merged by segment, and can also be by sequence. Borrow lane platoon line up: the control procedure and method of controlling traffic flow borrowing portion of space for platoon line up in opposite traffic lane or lanes for different vehicle types. Position replacement and follow-movement platoon line up: control procedure and method of controlling the moving forward and position replacing of following traffic that follows traffic ahead. Group/mixed platoon line up: control procedure and method of traffic flow platoon line up formation under group or mixed conditions of directions, aligning, order, such that these control can be applied together. Sequential platoon line up control: control all traffic flow of all direction or all lanes so as to form platoon line ups in platoon line up area or in moving traffic one direction at a time or one lane at a time sequentially. Each of all above mentioned control method will be introduced eventually.

Cross section of three-lanes or more:

(1) Method A. Splitting into two platoon line up areas, such as straight going as first platoon line up, left-right turning as second platoon line up. Because there will be no crossing formed when left and right turning traffic are released at the same time, and the effect on non-motorized vehicles is less of right turning traffic after the release of straight going traffic (this is when non-motorized vehicles have already drove past), left and right turning usually has a smaller flow volume, easy to match, as a result, the middle platoon line up lanes can be altered according to the rate of left and right turning traffic rate, it can be chosen that lanes are dedicated to left or right turning, or left right simultaneous method. Even though there is no crossing problem in straight going and right turning same phase release, but the flow volume difference is usually large, not easy to match. Also, right turning motorized vehicle will form crossing conflict with straight going non-motorized vehicles. As a result, during larger flow volume of non-motorized vehicles, same phase release of straight and right turning motorized vehicle should be avoided.

If all direction traffic flows sequentially enter a predetermined area to form a platoon line up like "complex or duplex control" (without the platoon line up and adjustment of traffic lanes according to the present invention), situations of through one single traffic lane and according to order, in turn and continuously forming three lines will occur, with very low efficiency. When the total incoming vehicle flow rate $\Sigma\lambda=\lambda straight+\lambda left+\lambda right \geqq$ saturated flow rate $\lambda$ of single lane (theoretically is 1800 vehicles/hour) is saturated, accumulation of vehicles will get larger, release is incomplete, which causes congestion. As a result, this control plan is comparatively not as good, and cannot be utilized practically.

Figure 7:
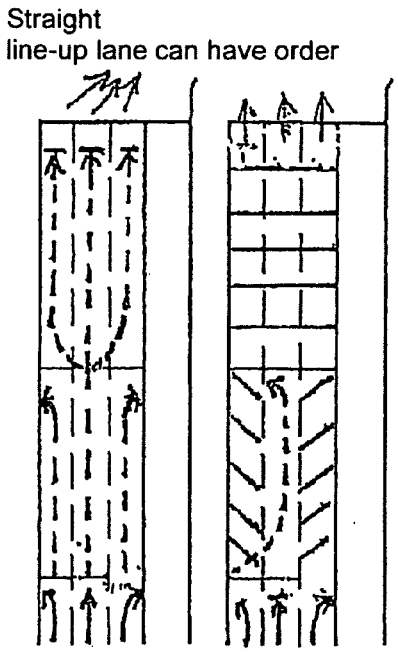
FIGS. 7, 8, 10, 11, 12 is a control flow diagram illustrating a multi-directional and multi-lane simultaneous platoon line up control of a three-lane method A traffic flow control.
Figure 8:
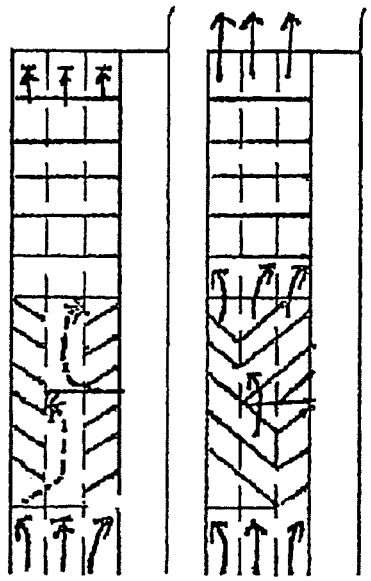

Control method of forming simultaneous platoon line up (including at least a period of simultaneous platoon line up) of multi-directional, multi-lane or multi-segment or point, as shown in FIG. 7 and 8, left and right turning vehicles, without limitation, continuously release platoon along their own lane from front to back within the second platoon, the middle lanes is provided for the passage and release platoon of straight going vehicles, as a result, when the straight going traffic has completed release for a certain period of time, the middle lane is to be provided for left and right turning at the back to release platoon together or merge platoon for a predetermined direction for a period of time (direction can be fixed, periodic left right alternate, irregular alternation according to the change of flow volume of different directions, similar control is regularly used in platoon line up control). When merge platoon is completed, at a predetermined point of time, straight going platoon line up will initiate again, and make use of the room after platoon is combined to initiate platoon line up cycle. Afterwards, straight going vehicles will follow left and right turning vehicles to move forward. And at a predetermined point of time, the release of left and right turning vehicles will be initiated again.

In order to guarantee a greatest efficiency of platoon line up control and complete release, the total platoon line up volume under all platoon line up control circumstances of all vehicles direction within the period (especially the greatest pressure flow) should be made best to be greater than or equal to incoming vehicle volume: $QI=\Sigma(\Sigma\lambda i*gi)\geqq\lambda S$. It means that the ratio value is 1, QI is the platoon volume of the I direction of the period, $\Sigma$ is the total platoon line up volume of the I direction vehicle passing through n number of lanes, $\lambda i$ is the average platoon line up flow rate of the n platoon line up lane under platoon line up control condition i. gi is the platoon line up time of platoon control under condition i. $\lambda I$ is the incoming traffic flow volume of the I direction within the vehicle flow period. The meaning of greatest pressure flow is the greatest flow direction of incoming traffic flow rate $\lambda I$ in accordance to realease platoon lane number n. According to FIG. 7 and 8, the straight going traffic is the greatest pressure flow, and the platoon line up problem is the heaviest of the heavy ones. As incoming traffic flow rate fluctuates, incoming traffic may be very concentrated in a short period of time. However, high intensity flow peak can be averaged down, where a few periods or predetermined time length period is used to replace period time (for example, 5-30 minutes). Also, the platoon line up lane and platoon line up time matching of all direction traffic flow can be adjusted through control.

Figure 9:
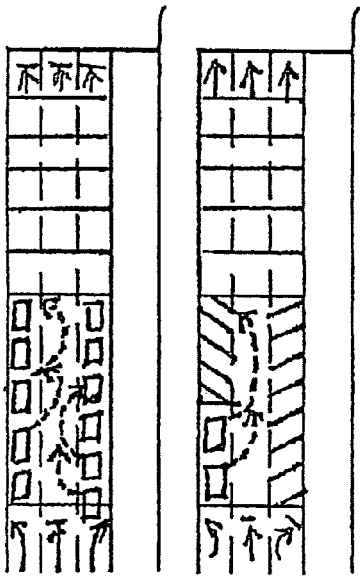
FIG. 9 is a control diagram illustrating chain-moving and one-vehicle-at-a-time type of control.

According to FIG. 7 and 8, the middle, left and right lane will platoon by replace position after the release of straight going traffic has ended, which is referred to as merge platoon or replacement platoon. There are methods of chain displacement and one-vehicle at a time. Chained slanted replacement platoon line up control is almost carried out simultaneously, time required is less, which basically is the time required for vehicles of position replacement merge platoon to follow the tail of the previous platoon, as shown in FIG. 9. The time required for one-vehicle at a time passage method is basically the number of replacement vehicles Q*the average displacement between nose of car of merge platoon H+delay in initiation D (the position replacement merge platoon signal can be initialed 2-3 seconds earlier at the design stage to balance out delay in initiation). Merge platoon can also be one at a time one-lane at a time merge platoon, as shown by the middle, different segment of the left and right direction can be merge simultaneously, and can merge one at a time through pre-stop lines as shown in FIG. 8.

According to FIG. 7, lining up before the platoon area and before merge platoon of left turning traffic will only occur under certain circumstances. Similar periodic position control of pre-lining up and pre-merge platoon, because it only is related to the alternations of lining position, lining up basically is occurring continuously, and is also occurring randomly, as a result, this specification has not pointed out the signal and time matching period (including the following time matching calculation), but can be installed when actually utilized.

Figure 10:
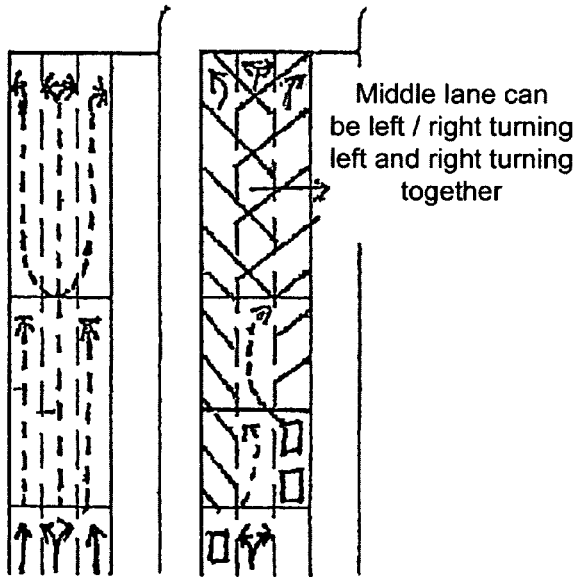
Figure 11:
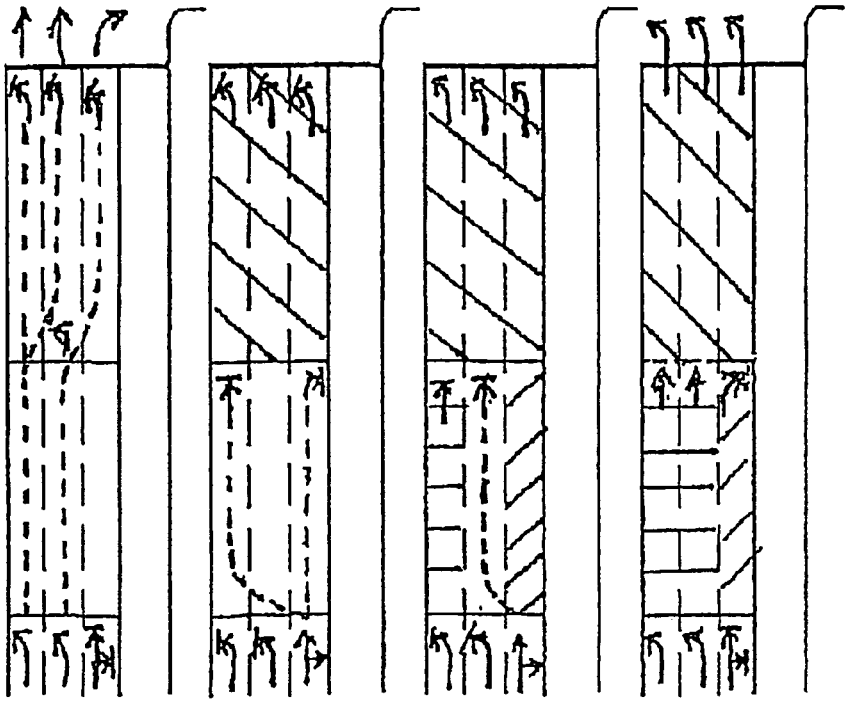

Control plan to solve the complete release of greatest pressure flow can also include the changing of the two greatest flow rate (straight going) vehicle lanes into passage platoon line up, as shown in FIG. 10. Or flow limitation or same lane platoon line up of one of left or right turning flow. If the greatest pressure flow is left or right turning, similar control plan can be used, which using two vehicle lanes for platoon line up for left or right turning vehicles, as shown in FIG. 11.

Figure 12:
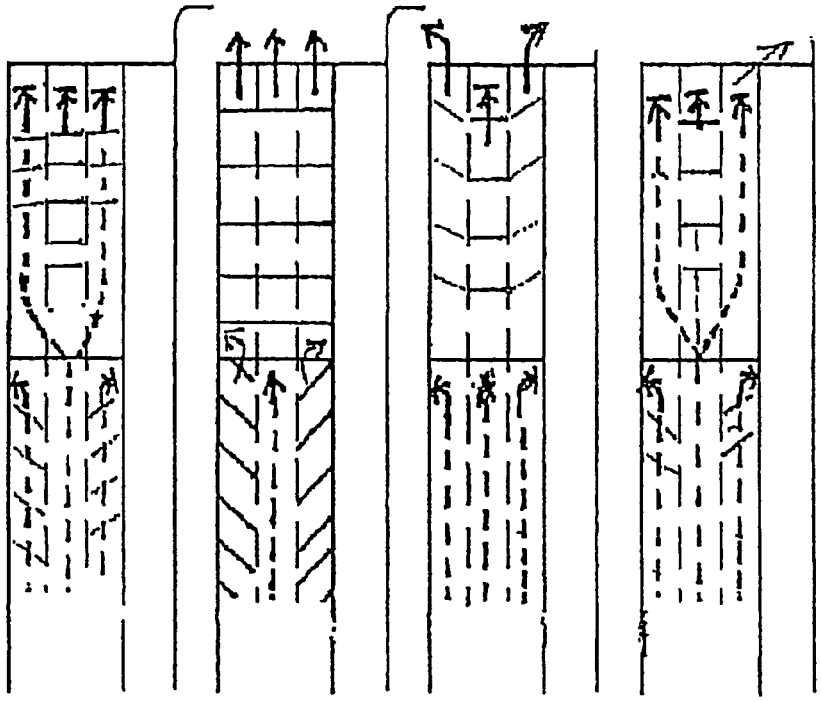
Figure 13:
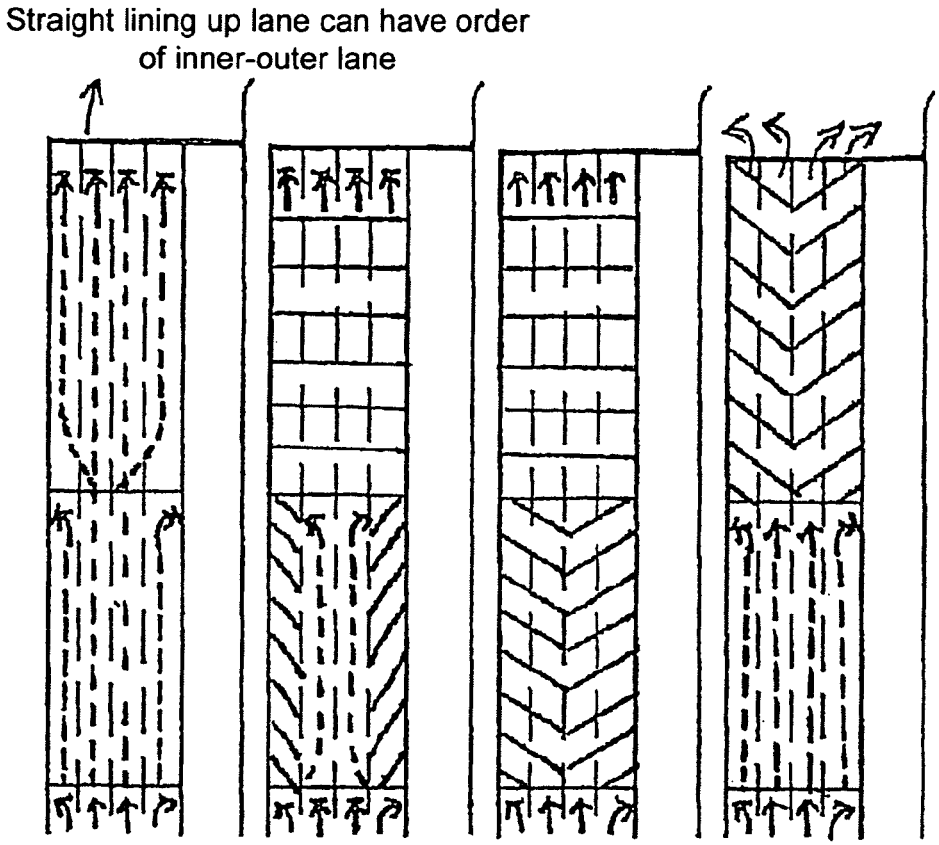
FIG. 13 is a control flow diagram illustrating a multi-directional and multi-lane simultaneous platoon line up control of a more than three four-lane method A traffic flow control.
Figure 14:
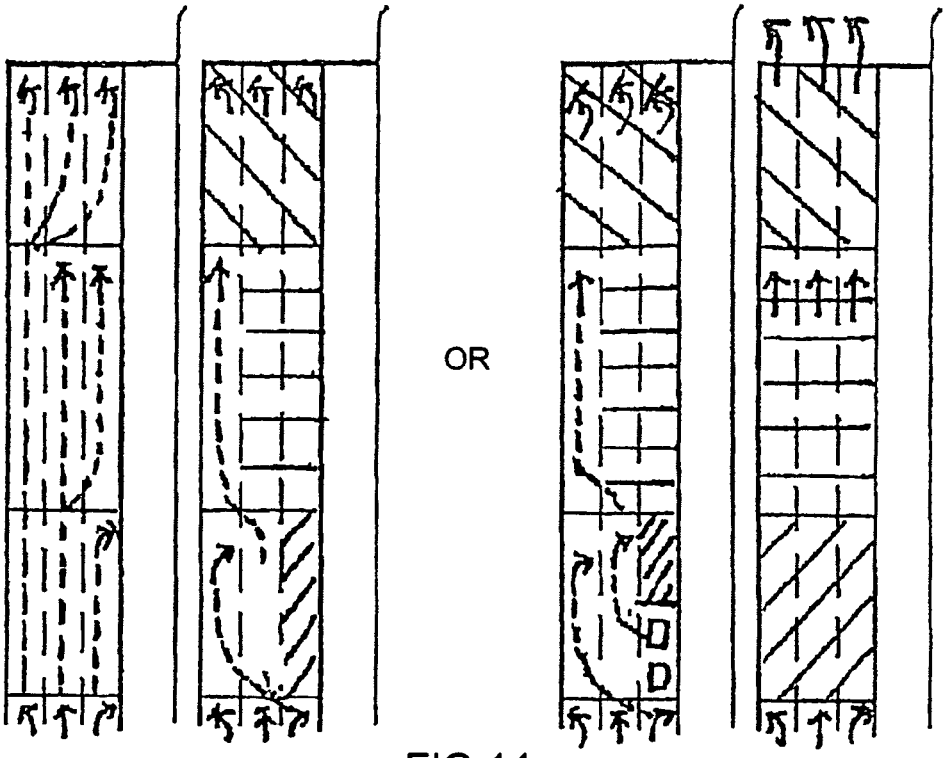
FIG. 14 is a control flow diagram illustrating a multi-directional and multi-lane simultaneous platoon line up control of a three-lane method B traffic flow control.

There is another type of control method: middle lanes is continuously occupied by straight going vehicles, when in the release phase of left and right turning vehicles, the straight going vehicle is kept stationery, as shown in FIG. 12 (release platoon on straight going traffic lane 1 and lane 3 can also have some order). Although the total release flow rate of the cross section is reduced due to a lower number of vehicles released in the left and right release phase of this method, control management is easier, and is suitable for small left right turning traffic flow.

For three or more lanes, the number of lanes for platoon line up increases, especially for the increase in passage for the main traffic flow, such that the increase in power of the main traffic flow is far greater than the increase proportion of release, therefore making platoon line up much easier. When there are four lanes, according to FIG. 13, the ratio between straight going release platoon lane and release lane is 2:4, and that of three lanes is 1:3, main release platoon lane increases by one, and the power of release platoon is doubled.

(2) Method B. 1. Release power. Release power calculated according to method B is greater than that according to Method A. Also, referring to release figure, it can be seen that by simple comparison view that: All phases in Method A in general is 6 lanes simultaneous release of two entrances, but in Method B, the two left and right turning phase is released simultaneously through four entrances 12 lanes, release power has obviously been increased.

2. Platoon line up power. Better control platoon line up plan of three lanes according to Method B is: according to FIG. 14. It can be seen that the number of platoon line up lanes before the merging of the first platoon, second platoon and the last platoon of the platoon line up control method are 3, 2, and 1 respectively, which are continuously released platoon except for when platoon is merged. The overall power of platoon line up is: P total=λ first platoon incoming*(T period−T platoon cut off 1)+λ second platoon incoming*(T period−T platoon cut off 2)+λ last platoon incoming*(T period−T platoon cut off 3). Assume all λ to be theoretical saturation flow rate λ saturated incoming, then P total=λ saturated incoming (3T period−T cut off 1−T cut off 2−T cut off 3).

Utilizing theory of lining up, fluctuation, and theory related to traffic control to calculate, the platoon line up power of Method B is basically of the same level or slightly lower, but can still completely satisfy the actual traffic need.

Figure 15:
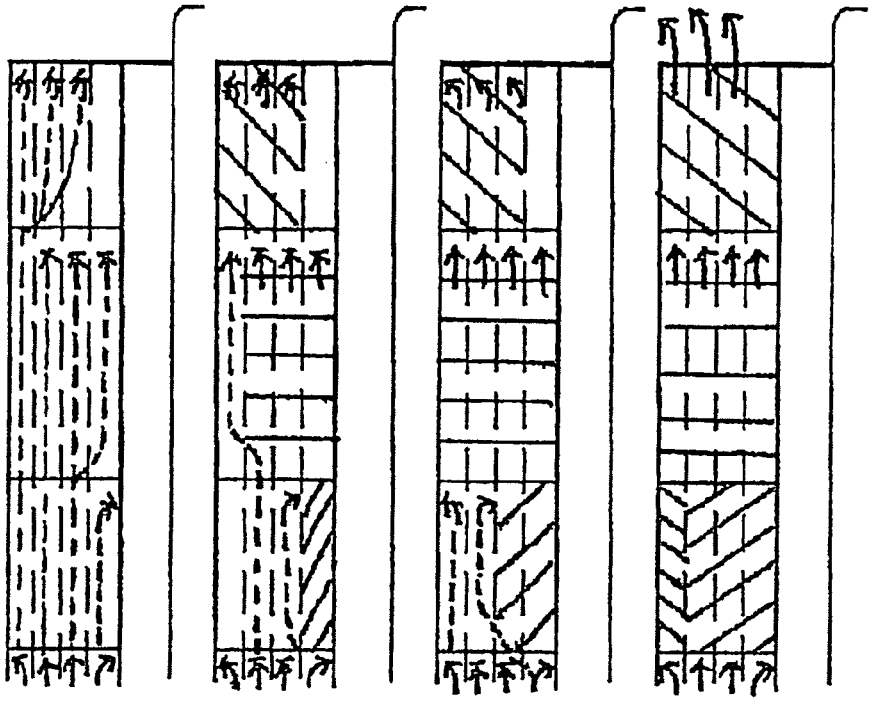
FIGS. 15 and 16 is a control flow diagram illustrating a multi-directional and multi-lane simultaneous platoon line up control of a more than three four-lane method B traffic flow control.
Figure 16:
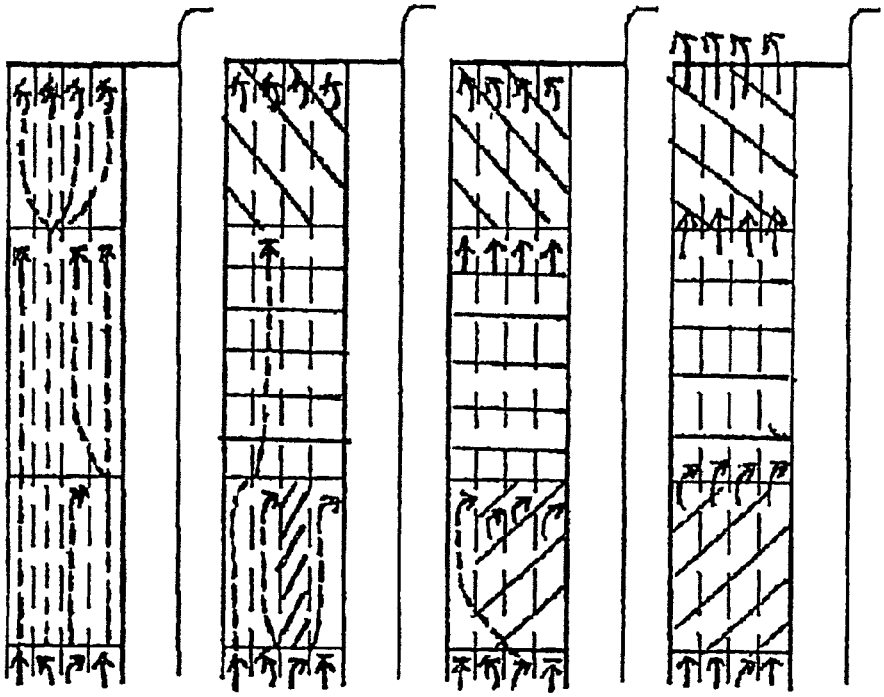
Figure 17:
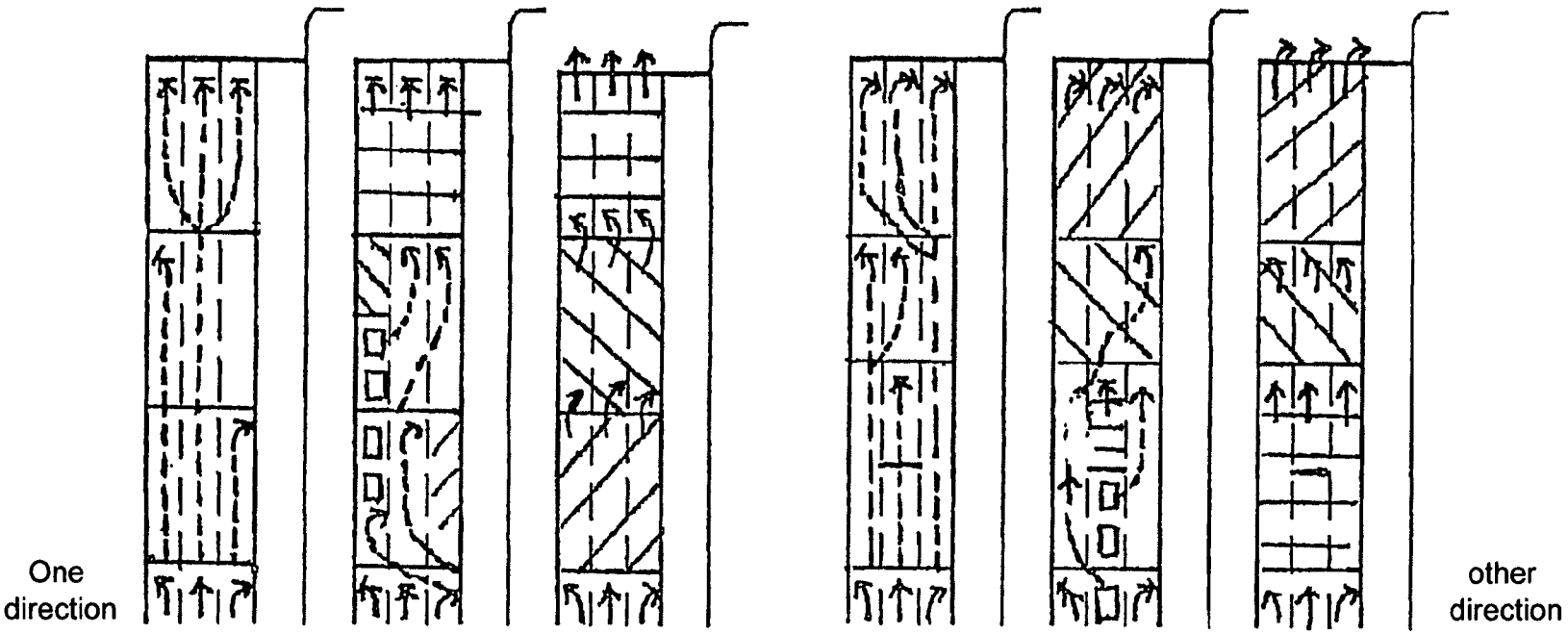
FIG. 17 is a control flow diagram illustrating a multi-directional and multi-lane simultaneous platoon line up control of a three-lane method C traffic flow control.

Cross section of three or more lanes, because the curve of lane alteration of the merging of platoon of the first and last platoon is greater, there will be more merging platoon lining up, and increase in platoon line up difficulty due to a longer tail of prior platoon before platoon merge. As a result, partial lane platoon line up can be chosen to be used by the first and last platoon, so as to reduce the difficulty or adjust lane order of flow direction during release and merge platoon, as shown in FIG. 15 and 16.

(3) Method C. 1. Release power. Because the left and right turning traffic flow of the two directions make use of same phase release in release control method, during platoon line up, there is no platoon merge during first platoon, and the second and last platoon require platoon merge, which is similar to Method B, such that conditions of having simultaneous merging of many rows can be controlled. As a result, the overall platoon line up power is of a similar level to Method B. Guiding lanes of right, left and straight platoon order require A straight going is not suitable to be too large, in order to avoid an oversize of the last platoon. It is more suitable for the direction of having a larger straight going traffic flow to use the platoon order of straight, left and right.

Figure 18:
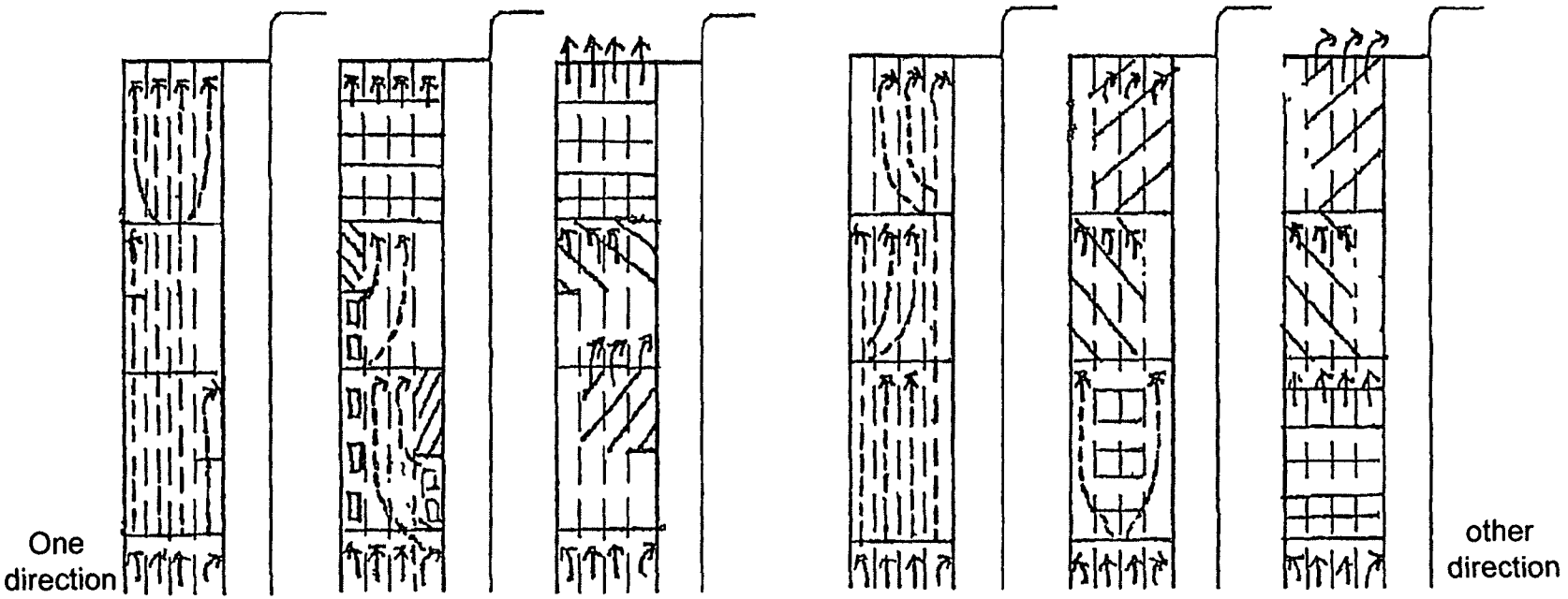
FIG. 18 is a control flow diagram illustrating a multi-directional and multi-lane simultaneous platoon line up control of a more than three four-lane method C traffic flow control.

The difficult of release and merge platoon of Method C for three or more lanes is less than that of Method B, as shown in the four lanes in FIG. 18.

Method D refers to the theory of Method A, B, and C, and will not be detailed here.

Two lanes utilizing the three control methods of A, B, and C is analogous from the three lanes theory.

Figure 19:
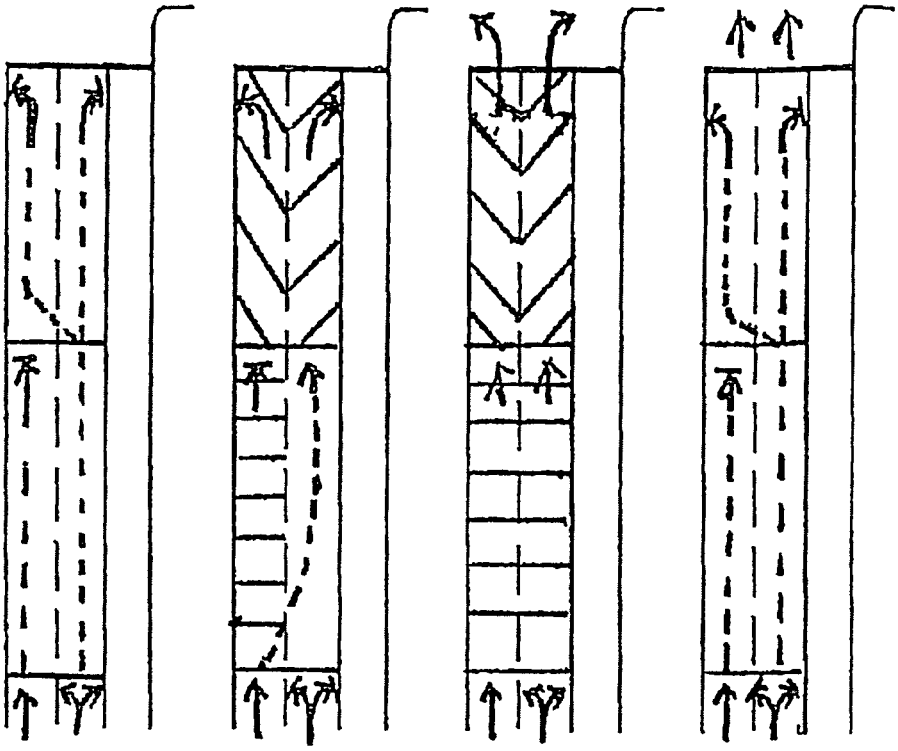
FIG. 19 is a control flow diagram illustrating a multi-directional and multi-lane simultaneous platoon line up control of a two-lane method A traffic flow control.

(1) Method A: such as: the straight going traffic is the main flow, which occupy the first platoon, left and right turning occupy the second platoon, straight going vehicles and left right turning vehicles obtain platoon line up signal in order according to their own lanes, wherein the overall platoon line up power is equivalent to the continuous platoon line up power of one lane. When left right turning flow is higher or requires an increase in platoon line up, the platoon order can be reversed, as shown in FIG. 19. This control method can form simultaneous platoon line up of two lanes, the platoon line up power of which is greater. As can be seen in left and right turning of two platoon area in platoon line up method A, the utilization ability of straight platoon order is better. If there is a greater left or right turning traffic flow, left or right turning traffic flow can be allowed to occupy the first platoon, the remaining two directions occupy the second platoon, same theory of platoon control.

Figure 20:
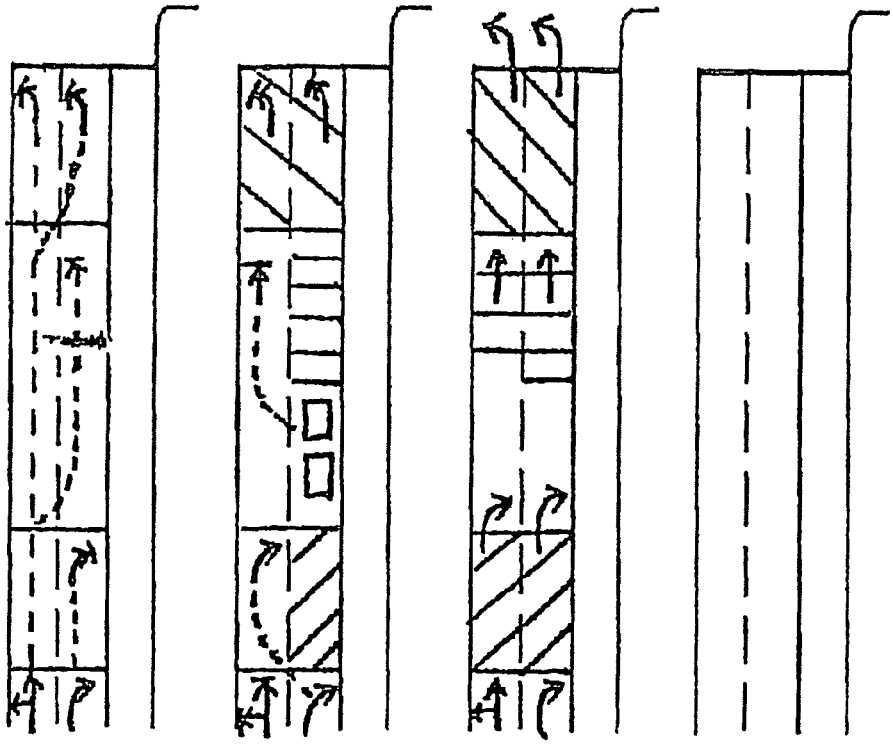
FIG. 20 is a control flow diagram illustrating a multi-directional and multi-lane simultaneous platoon line up control of a two-lane method B traffic flow control.

(2) Method B: as shown in FIG. 20, platoon order is left or right, straight, right or left. The vehicle flow of the first platoon (such as left turning) and the straight going vehicle flow both use the lane of the first platoon direction to release platoon according to two rows and single row respectively, the vehicle flow of the last platoon make use of another lane to release platoon with a single row at the last platoon. Then, the first platoon is cut off, second and last platoon merge, and the cycle is repeated in that order.

The release power is equivalent to ⅔ of that of three lanes cross section release of Method B.

Figure 21:
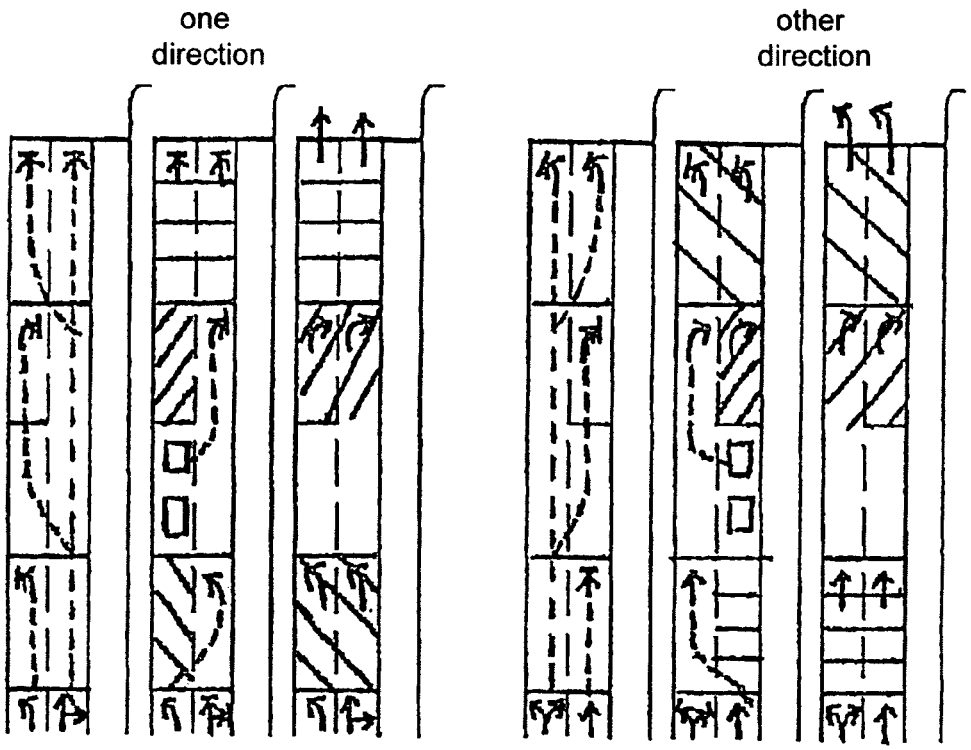
FIG. 21 is a control flow diagram illustrating a multi-directional and multi-lane simultaneous platoon line up control of a two-lane method C traffic flow control.

(3) Method C: such as: a straight going main flow occupy the first platoon, left turning uses second platoon, right turning uses third platoon, straight left uses the first lane as passage, at first and second platoon area double rows and single row platoon line up respectively, right turning vehicles use second lane to line up first, when the first platoon is lined up, second and third platoon merge, and the cycle is repeated in that order. The platoon line up and merge method is basically the same as that of Method B according to FIG. 20, the overall platoon line up power is also basically equal. The situation is also similar for the right, left and straight going platoon order of the other direction. Platoon line up power is approximately ⅔ of that of three lanes. Method C here can be developed into an alternative method, as shown in FIG. 21, where the platoon line up of straight going, right and left turning, and left, right turning and straight going and releasing orderly will not cause conflict in flow direction. The effect is better.

When two direction vehicle flow use one passage for platoon line up of cross section two lane platoon line up, the overall flow rate of the two direction λ should be≦than the platoon line up flow rate of merged vehicle flow platoon. As a result, another control rule is that second and third flow (the order is according to the flow volume), or first and third flow merging, and platoon is released in one lane. This is also suitable for platoon line up condition of other two direction vehicle flow using one lane.

Figure 60:
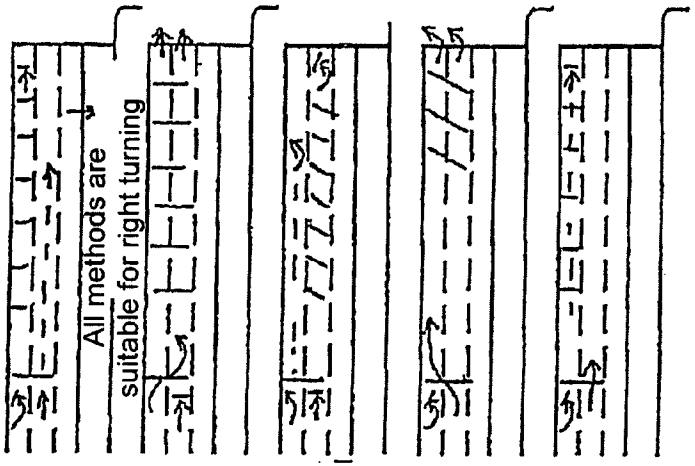
Figure 62:
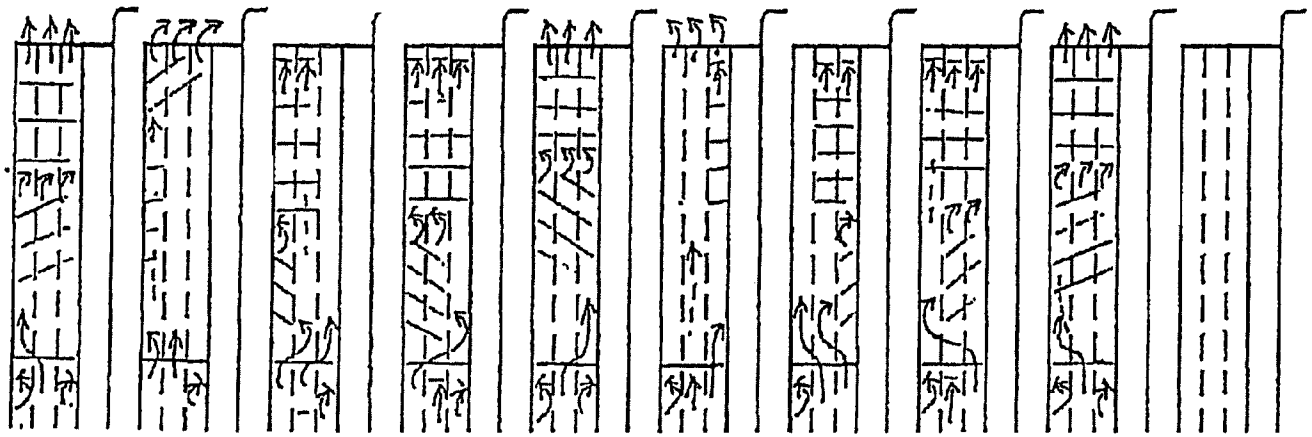
Figures 63, 64:
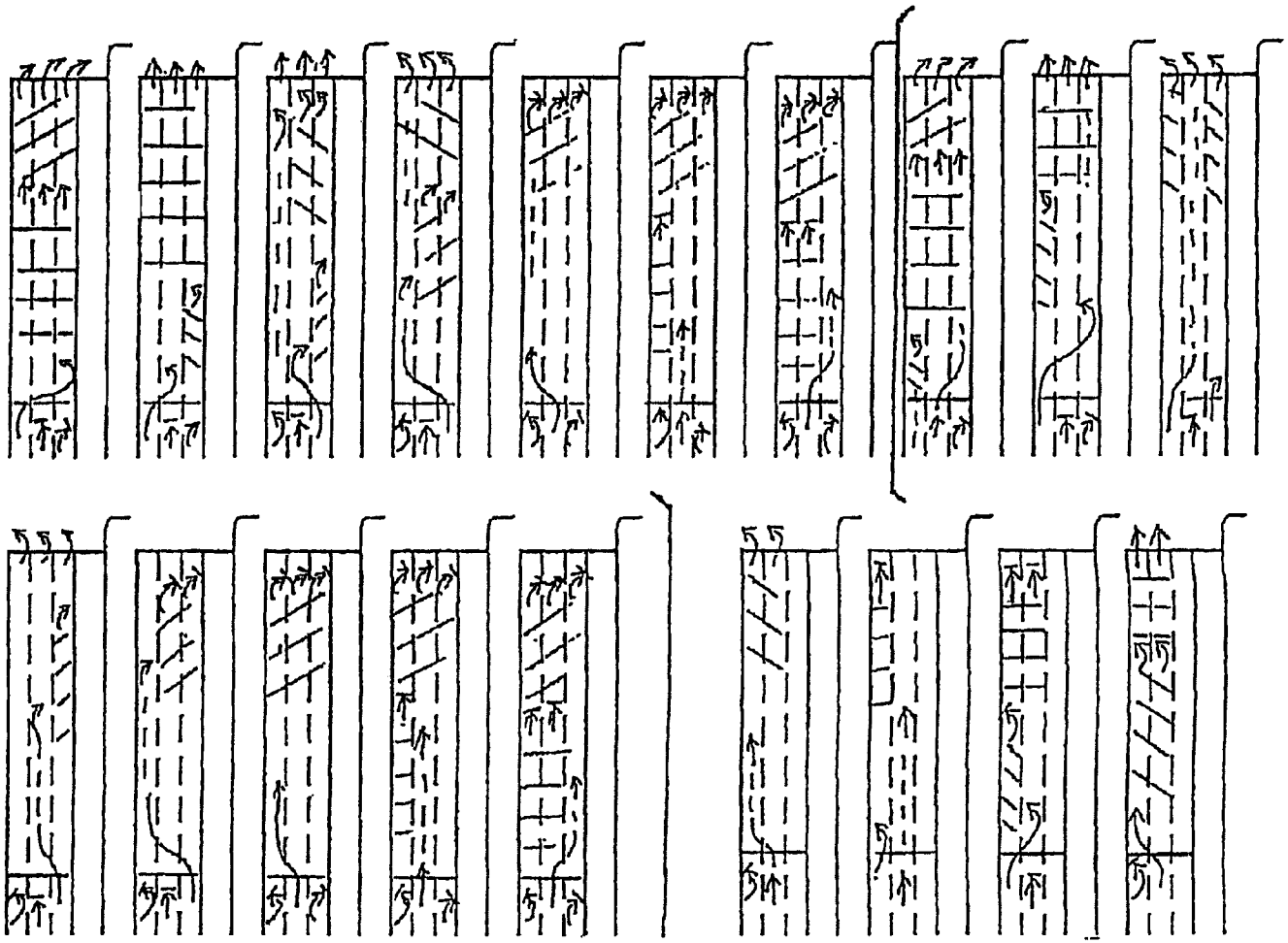
Figure 65:
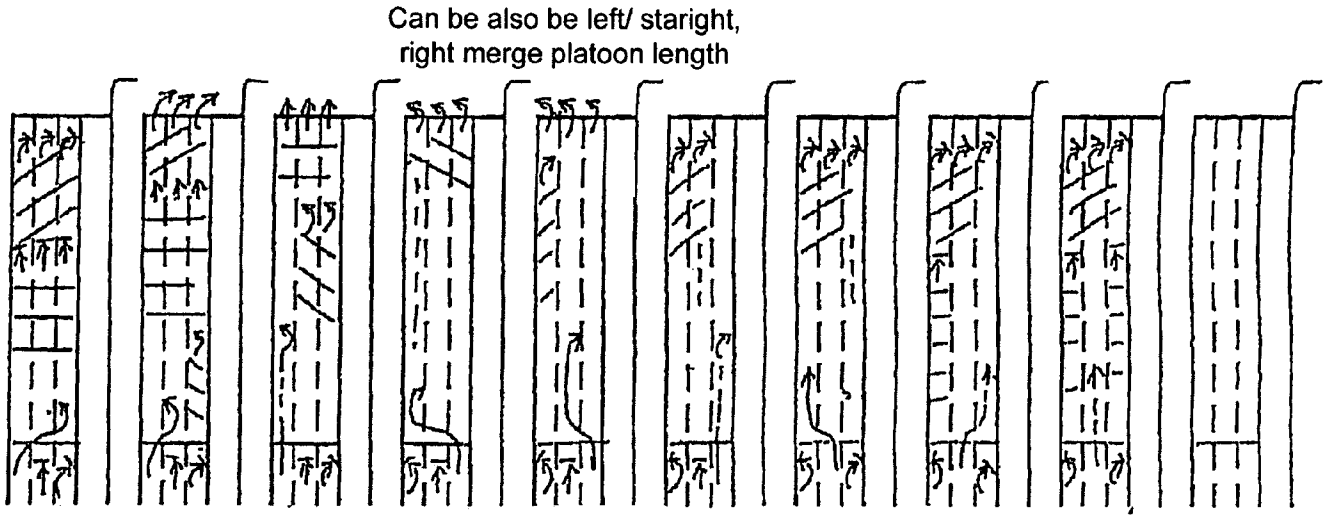
Figure 66:
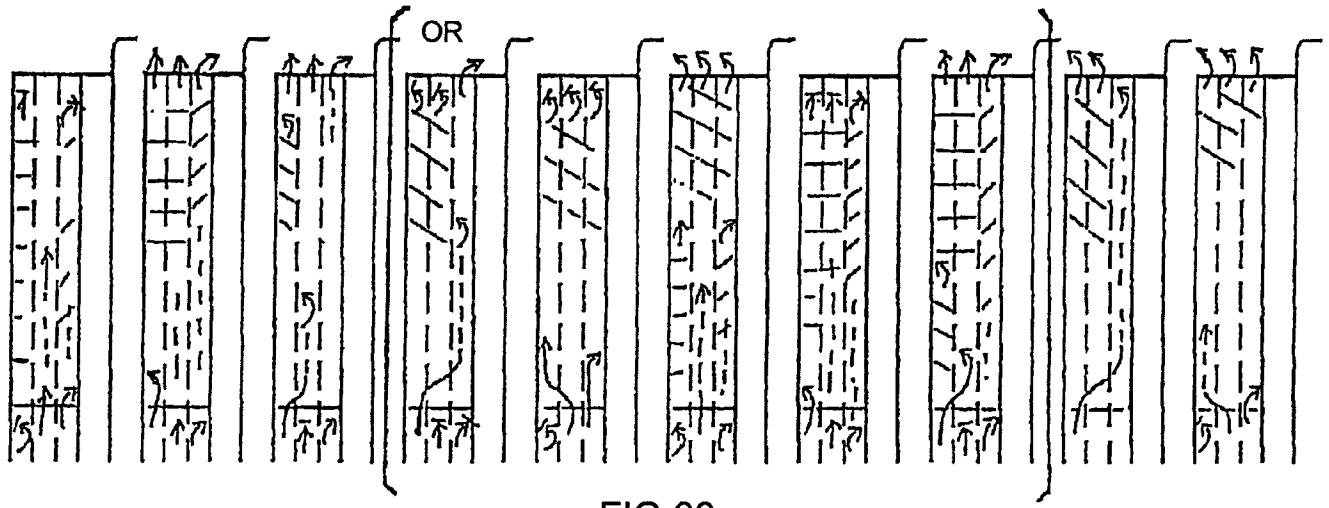
Figure 67:
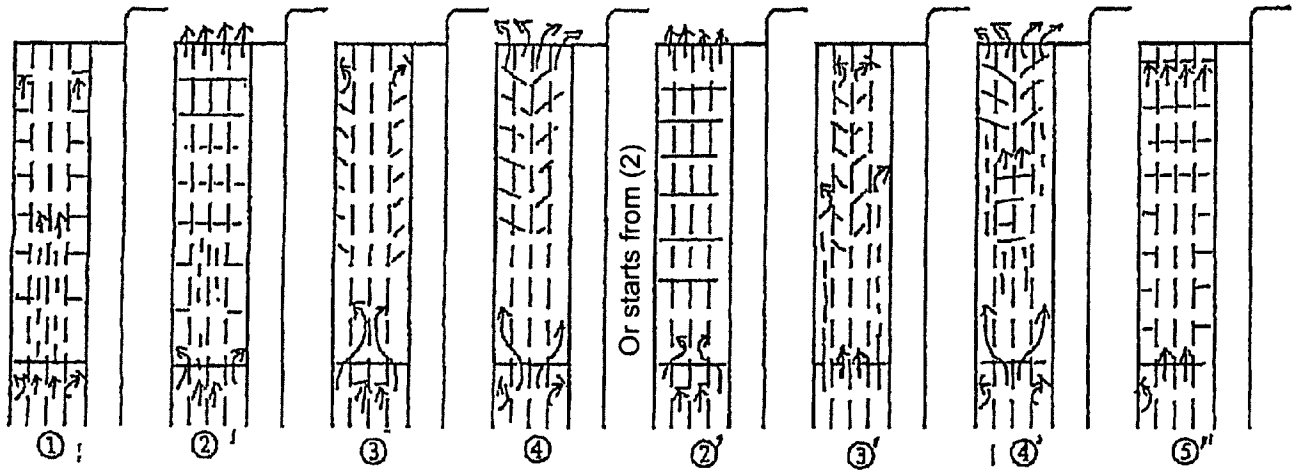
Figure 68:
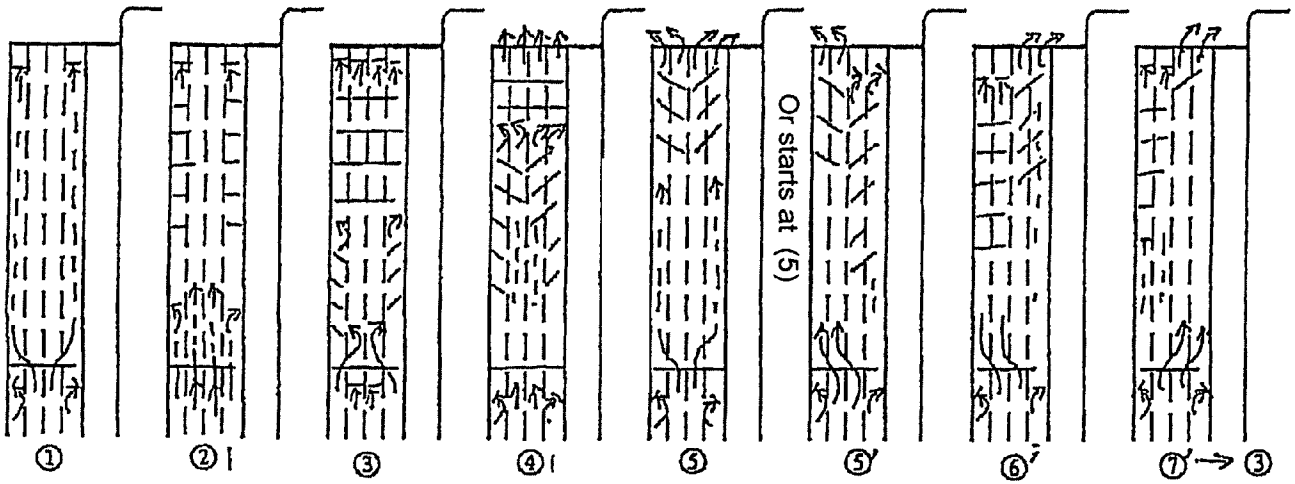

Remark 0: the present invention includes other platoon line up control methods other than the listed A, B, C, and D method, such as in FIG. 2, when the north-south bounds are left-right turning, the east-west bounds can turn right; such as vehicle stop or increase entering in certain directions or certain lanes, or the number of vehicle in each direction, and cycle of platoon control when each vehicle lane increases in unequal frequency (such as a certain flow direction is released once every two cycle periods); if it is non-continuous platoon line up passage control, as shown in FIG. 60 (control theory is similar, others will not be detailed one by one), when non-continuous release as in the above listed example, increase in phase or lost in time may increase, platoon line up time is long and efficiency is low. There will be more problems when matching with crossing direction phase and adjusting with non-motorized vehicles, but the control may be simpler.

Figure 22:
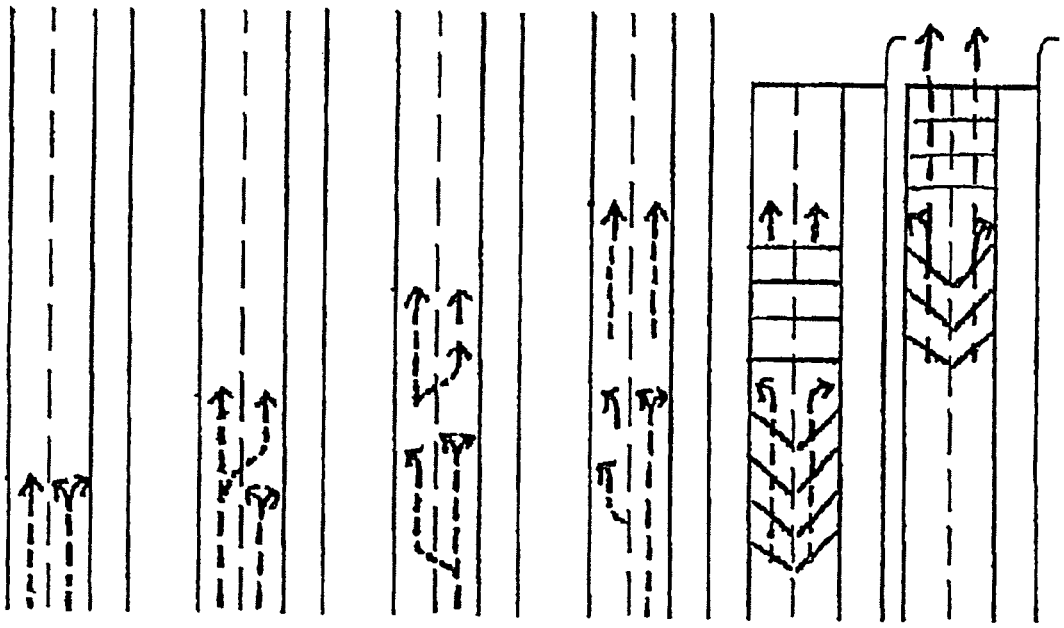
FIGS. 22, 23 and 24 is a control flow diagram illustrating a multi-directional and multi-lane simultaneous platoon line up control of a road segment under ⅔ lanes dynamic platoon line up.
Figure 23:
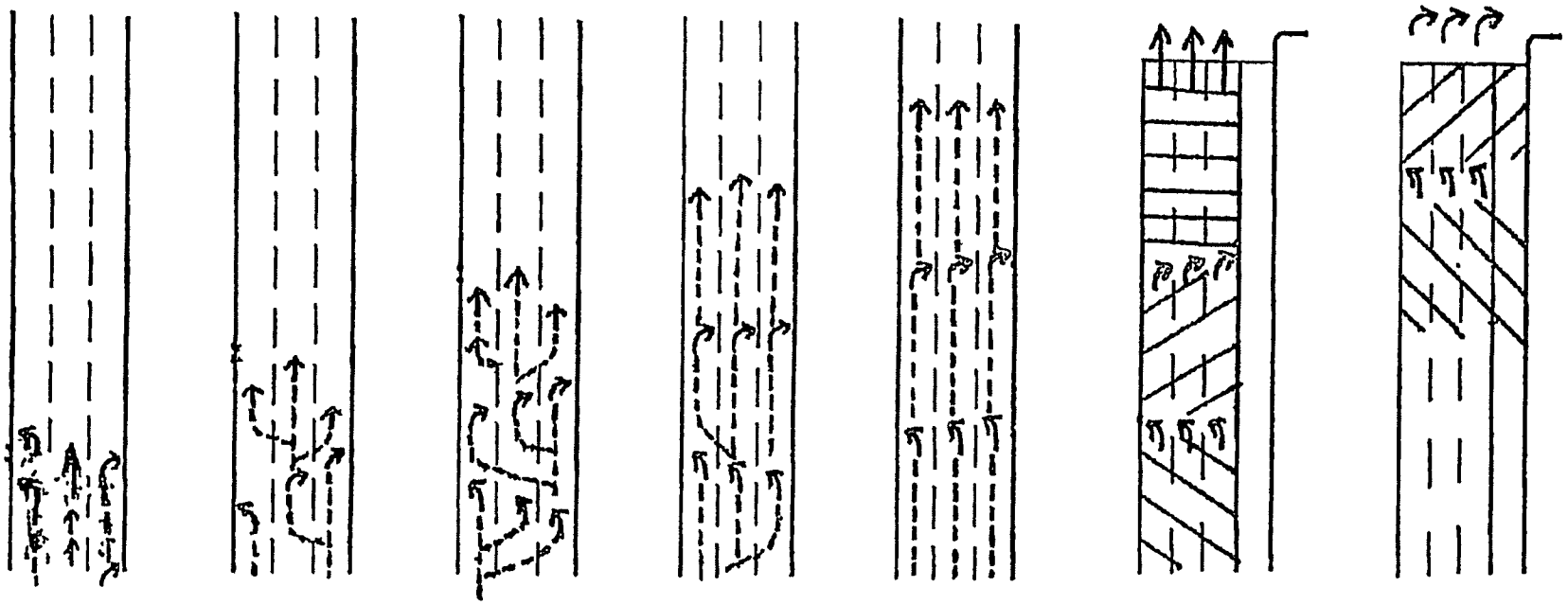
Figure 24:
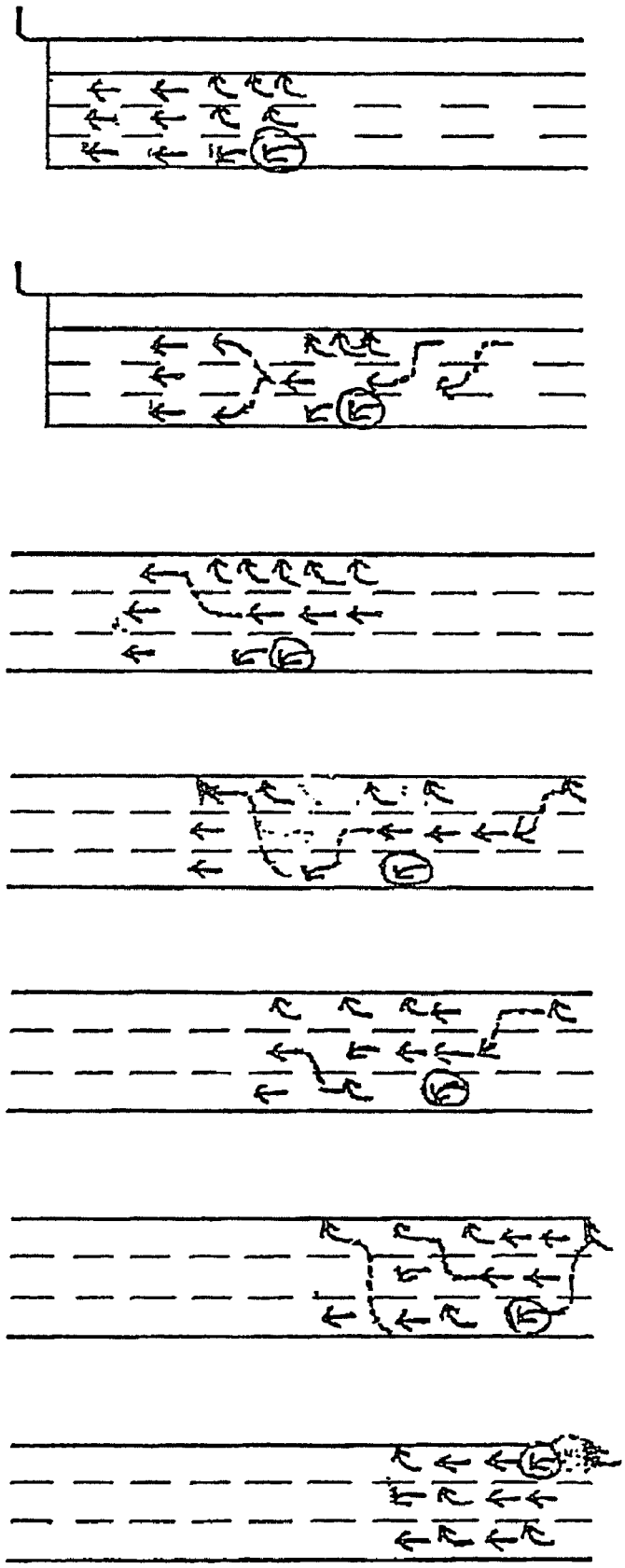

Referring to FIG. 22-24, example of multi-direction, multi-lane or multi-segment or multi-point vehicle flow simultaneous platoon line up passage control method of road segment dynamic platoon control is introduced.

Referring to the description of fixed-area platoon line up control while traffic is flow in the road segment (without stop line/area), instructions guide vehicle flow to carry out platoon line up passage (including incomplete platoon line up of before passing through the intersection) through vehicle-installed or road-installed control device, facility, and also to try their best to pass in order without vehicle stopping. Platoon in motion can first be freed, without forming a platoon, and can form a platoon with a better platoon shape when they reach the intersection. Dynamic platoon line up of road segment with movement can be seen as a relatively still among movement fixed area method, as a result, the release power is basically the same as that of fixed area method (without delay in initiation, distances between vehicles are larger, speed of passage vehicles is greater). Platoon line up power, as it is happening in a road segment with movement, distances between vehicles are greater, changing of lane is easier, and with no definite periodic limitation in platoon line up. It will be all right as long as the road segment is long enough, control speed is appropriate, and can be completed, and at the back there is a fixed area control ready to be utilized. Such as:

When there are two lanes, two vehicle rows of different direction is first formed, then, platoon rows of different direction is formed, as shown in FIG. 22. When there are three lanes, it is shown in FIG. 23 and 24. When there are four or more lanes, the theory is the same. Fixed area method can be referred.

Cross phase moving platoon line up control is a technical point of the present invention of increasing the efficiency of moving platoon, such as cross phase of the head and tail of the moving row, and can obtain the number of vehicles of different direction in each platoon row, actively defining the cross phase order, making sure that the head and tail vehicles of the platoon are in the corresponding position through methods such as inspection/monitoring and signaling. It can also provide similar highway traffic signs and traffic lines.

Generally, first separating in direction, then release platoon is simpler and require less facilities, but the road segment has to be longer. Separating direction and release platoon at the same time requires a higher accuracy in control, but the road segment can be shorter. Earlier separating direction, through vehicle-installed and road-installed devices, distribute and emit navigation information to vehicles passing through each road segment and intersection according to messages from destination and full-scale traffic messages calculate, so as to split up different directions as early as possible, such as early splitting in direction one intersection or road segment (with movement) before.

The road segment length and movement speed is comparatively more important in a dynamic platoon line up of a road segment with movement. The dynamic platoon line up of a road segment with movement has control methods such as first split up direction then platoon line up, combine platoon line up, and cross phase platoon line up control; when the vehicle flow scope of release and merge of platoon is determined, division by road segmentation and time period with reference to the number of vehicles can be used, or make use of group division for a more concentrated and dense (vehicle numbers in a grouping may not be consistent, release signal can be adjusted accordingly). However, monitoring, guiding, communication and the like devices and technological support will be required. Such as: A, inspect when passage flow volume of a certain point reaches the predetermined value, control system determines the distance between the tail of a vehicle and the head of another vehicle, and also to carry out control guidance (such as emitting a slowing down signal to the vehicles behind the last vehicle through vehicle-installed or road-installed devices), forming partition of vehicle flow; B, detect vehicle flow with obvious density partition through two or more inspection/monitoring device (vehicle group can have a predetermined size requirement, it is not suitable to be too large or too small), determine the last vehicle, so as to carry out control according to speed and distance; C, combination of the previous two, such as when a certain number of vehicles is detected, if there are higher density vehicle flow following, if size allows, following vehicle flow can be accepted appropriately, if there is segregation, the speed has to be determined; and such as, if density of group division is relatively lower, vehicle flow can be partly continued, and monitor and control the number.

Also, distance within and position of vehicle group of different directions, vehicles in each group can be adjusted through vehicle speed, distance between vehicle, position control guidance, so as to make changing or lanes, group shape, formation of group by certain vehicle merging in or adjustment of position more convenient (such as the moving up of fire-fighting, first-aid, police activity or the like vehicle (group)). This advantage exceeds the fixed area control.

Figure 25:
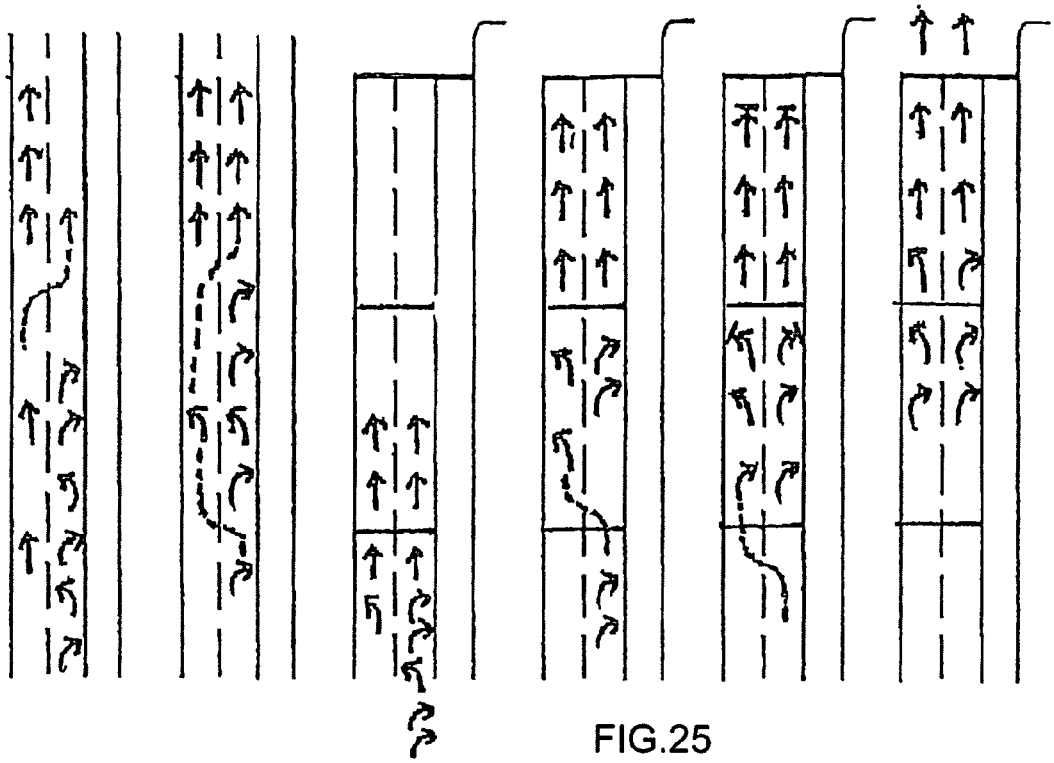
FIG. 25 illustrates combined platoon line up passage control.

Referring to FIG. 25, an example of combined platoon line up passage control is illustrated.

1. Fixed area and dynamic platoon control of road segment with movement are carried out alternately. This type of control is easier to understand, which can make use of control models appropriately according to flow volume, change of flow direction and length of road segment, speed or the like traffic condition, and carried out alternately according to time periods. If flow volume from upstream is small, platoon line up is to be completed in a limited length of road segment; fixed area platoon line up is used when flow volume from upstream is large.

2. Forming group row of different direction in road segment first (it can be of different road segment), and according to the predetermined lining up and merging platoon method control movement condition and arrival time, and order of fixed area, to form different arrival, so as to prevent as much as possible delay caused by stopping vehicles. When entering the platoon line up area, platoon line up and release is completed according to fixed area control method.

3. When there is insufficient road segment length and dynamic platoon line up time, random stage of procedure of vehicle row direction separation, position adjustment of row order, platoon line up control should first be tried to be completed, the remaining procedures will be completed after entering platoon area. As shown in FIG. 25: under this situation, platoon area division is not even required.

4. Shape-altering intersection situation (such as trumpet shaped intersection), any one procedure of direction separation, position adjustment of row order, platoon line up should be completed in road segment, reforming of platoon is to be completed after entering platoon area.

When fixed area platoon line up and dynamic platoon line up of road segment with movement combine, efficiency of line up and merge platoon can be increased.

When platoon line up control is completed, fixed area platoon line up, dynamic platoon line up of road segment with movement, and combined platoon line up can pass through intersection/road segment under the condition of having no passage instruction control signal or under automatic control.

According to FIG. 26-30, an example of alternative method of platoon line up control is illustrated.

Platoon line up control including irregular shaped intersections, one-way intersections, having the control of only one platoon, platoon control area is shifted towards upstream, borrowing opposite traffic lanes, non-motorized vehicle lanes, partial intersection space, highway, roundabout, ramp, non-sealable intersection that is in close neighbor, temporary platoon line up, excessive or insufficient flow direction, vehicle platoon, phase, continuous passage of right turning or borrowed phase passage or the like alternative control method.

Platoon line up control of irregular shaped intersection such as T-shaped intersection, because there are less vehicle directions, platoon line up is even much easier. Theory of platoon line up control of five-crosses or other irregular intersection is similar, which can be controlled according to conditions such as structure and flow volume of intersection, and flow direction.

Figure 26:
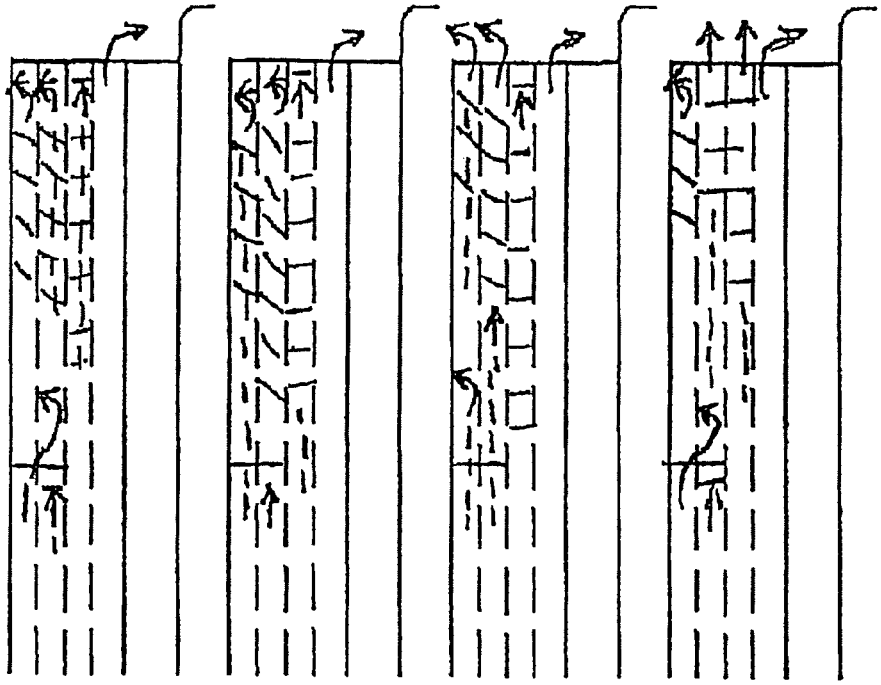
Figure 27:
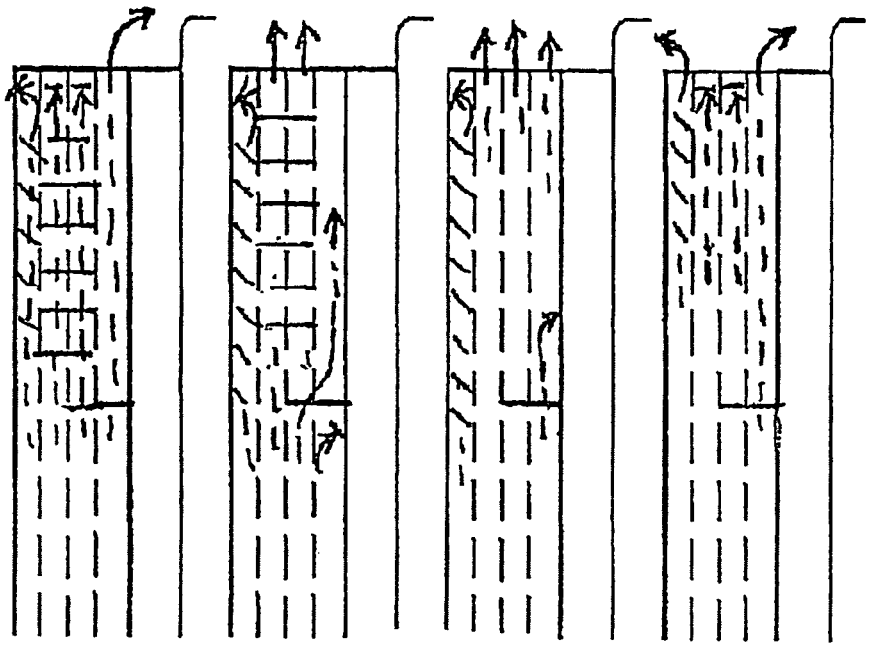

Intersections such as one-way intersection has less flow directions, platoon line up control is easier, such as having only one vehicle platoon to control; such as borrowed phase, which allows right turning vehicle to pass freely according to opportunity, and only control partial direction flow; such as left turning, left and straight going platoon line up, as shown in FIG. 26; such as periodic platoon line up of flow of partial lanes or row segment, as shown in FIG. 27; such as shifting line up and merge area to upstream, release ahead of time, so as to form control of continuous release of dynamic vehicle platoon, such that vehicle platoon can pass through intersection with higher speed, which in turn will help increase usage rate of signal.

Figure 28:
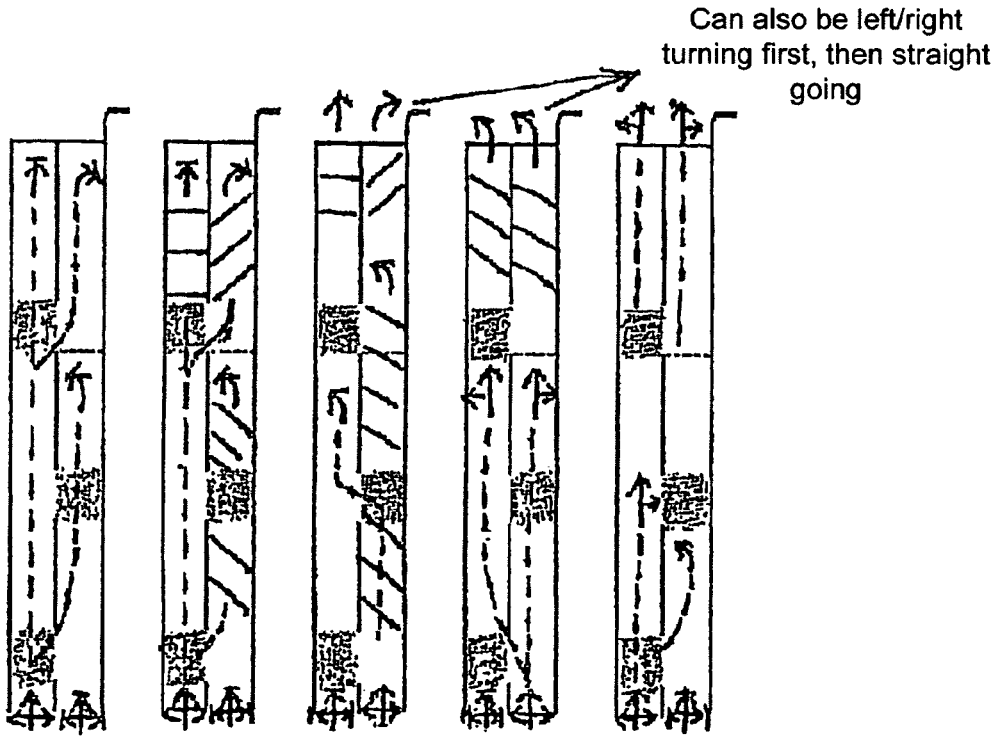

If there are special needs for one motorized vehicle lane or multi-lanes, they can borrow non-motorized vehicle lane (so as to reach the width of motorized vehicle lane), through device facility to control the stopping position of non-motorized vehicles, or after moving partial vehicle flow road segment towards upstream, control motorized vehicle to borrow a kept segment of non-motorized vehicle lane fixed area or dynamic platoon line up with movement, such that a certain platoon of motorized vehicle is released, or a release of a certain platoon of motorized vehicles, or non-motorized vehicles follow a certain phase or time period or after. As shown in FIG. 28, adjustment should be made to release control under this situation, non-motorized vehicles pass through by following closely to the tail of the motorized vehicles platoon.

Figure 29:
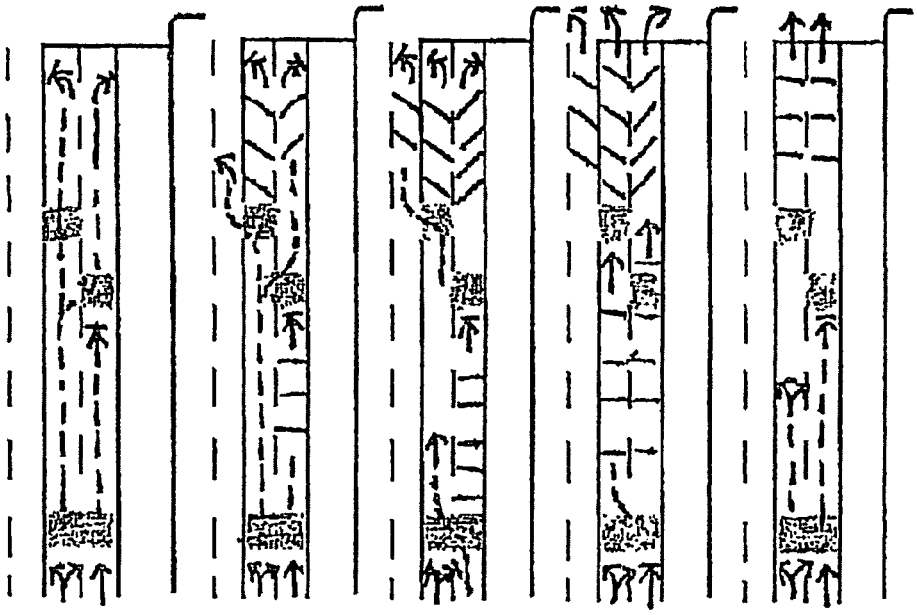
Figure 44:
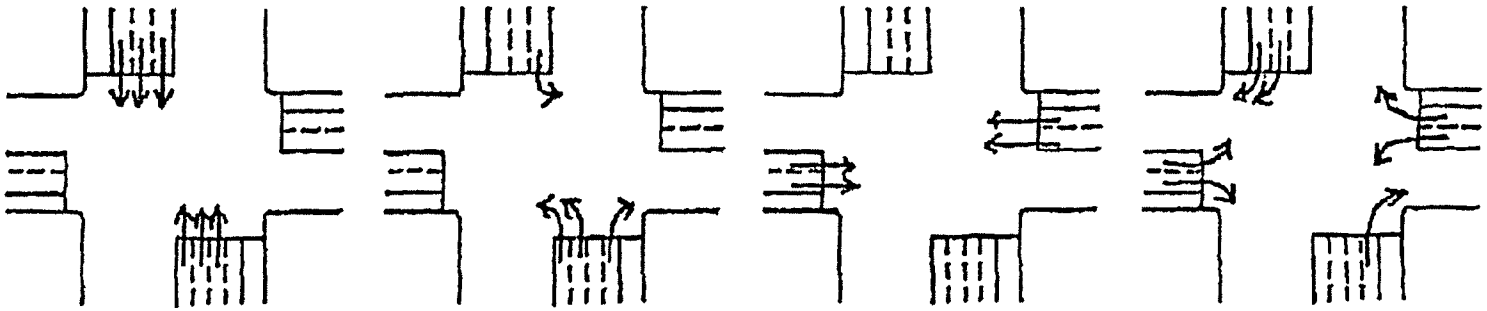
FIGS. 44, 45, 46, 47 is a flow diagram illustrating method A passage control and platoon line up control of platoon line up arrangement with time.
Figures 2, 71:
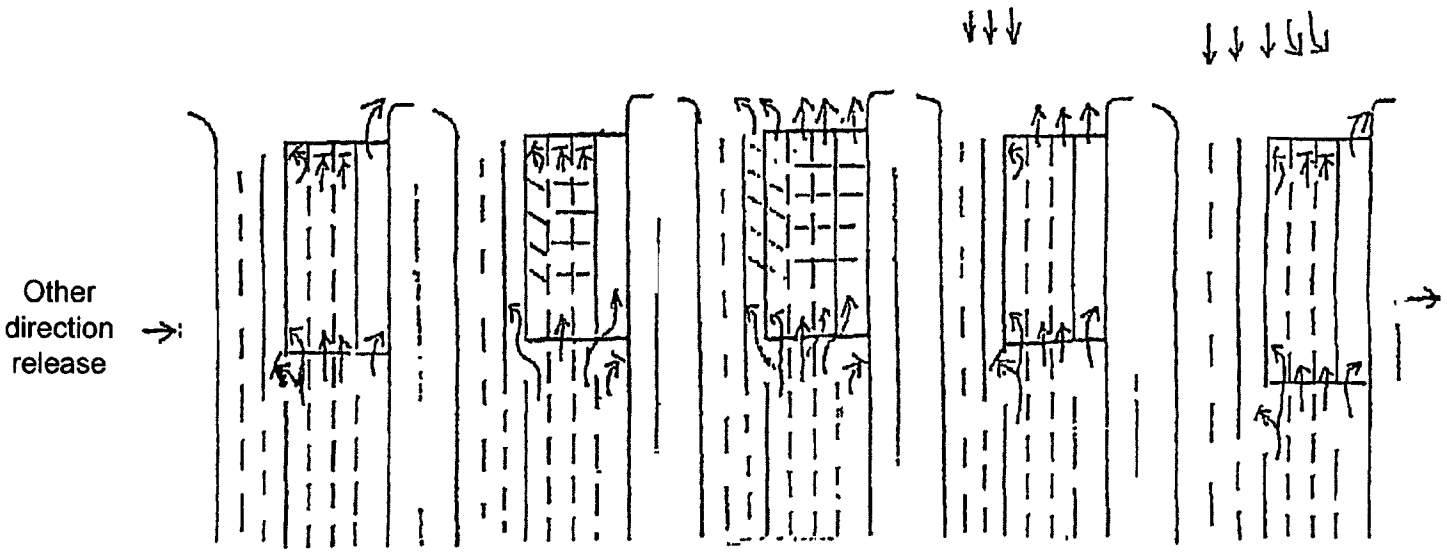
Figures 3, 71:
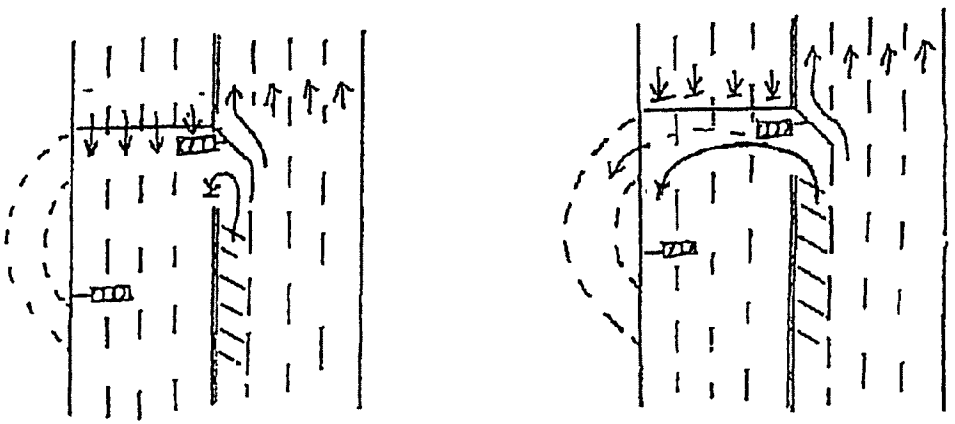

Borrowing opposite direction lane has control options: when there are no partitioning facilities or open intersection, certain direction or certain lane or certain segment or certain point vehicle flow according to default or sensing control guidance signal or automatic control, borrow portion of opposite direction vehicle flow lane for platoon line up to pass under the condition of not affecting normal passage of opposite direction vehicle flow, such as periodic borrowing of portion of opposite direction vehicle flow lane. Such as under the circumstances of having no partitioning facilities (or can be open intersection), left turning (or other direction) vehicle flow can borrow part of opposite flowing vehicle lane for passage according to control guiding signal, as shown in FIG. 44, when phase control is in the order of from right to left, east opening left turning vehicle can borrow one opposing vehicle flow lane (can be at suitable points of the middle lane, such as one place or multiple place at ⅓, ½, or foregoing intersections has navigation borrow intersection or other guiding indication lines, signs, devices facility). Borrowing time period should first be calculated or controlled by sensing, should not affect the normal traffic flow of the opposite traffic, as shown in FIG. 29 and 71. During the borrowing of the most outer (portion of or the entire) non-motorized vehicle lane or vehicle lane (confirmed according to whether or not there are non-motorized vehicle), similar to FIG. 29 and FIG. 71, non-motorized vehicles control can be accommodated with methods such as same borrowing or secondary waiting, which will not be discussed in details here. Similar to FIG. 71, borrowing opposite direction lane control can also be moved ahead to an intersection before (such as through a certain lanes, make motorized vehicles that are going to make a left turn in the next intersection to enter lanes specially for left turning vehicles in the opposite direction when it is in the same direction going lanes left turning phase). Also, corresponding control and instruction devices and facilities should be provided. Borrowing opposite direction lane can increase flexibility in lane utilization rate, reduce the difficulties in platoon lining up and merging, and reduce the length of platoon line up.

Figure 30:
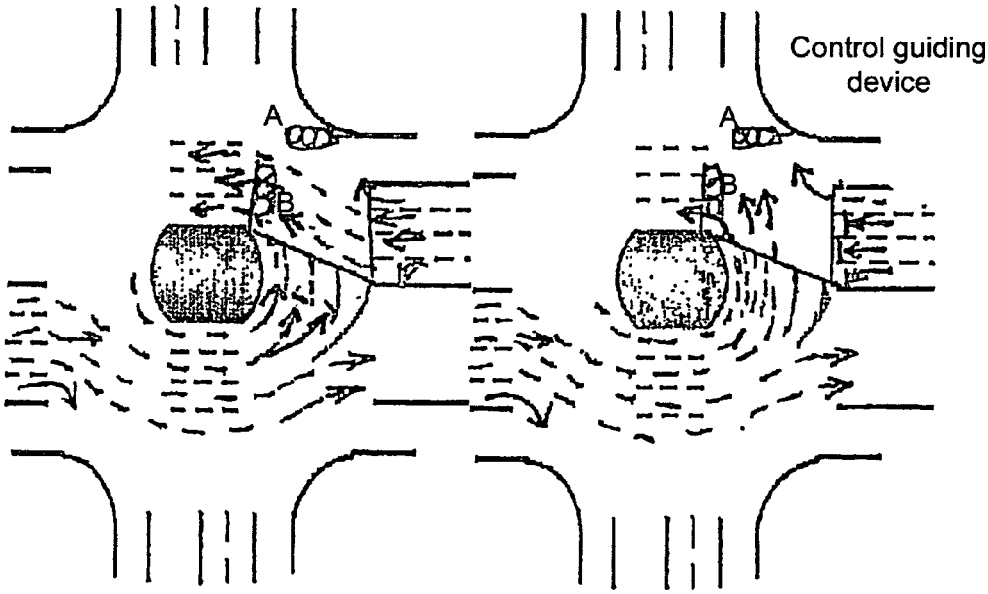

Such as vehicle flow lane lining up guidance and circular flow yielding and speed guidance of roundabout, platoon line up control device and platoon line up area and related signs, traffic line facility, should be provided on entrance or roundabout lane, in order to control guiding platoon line up of vehicle flow at entrance or roundabout lane and speed guiding, as shown in FIG. 30. Other conditions that require group vehicle flow, adjusting lanes can also use platoon line up control.

Temporary platoon line up control options: such as under the conditions of allowance by instructional lane, incoming traffic of a certain lane is relatively low or no traffic or temporary need, through inspection real-time control or fixed time period signal control, control guiding speed of incoming vehicles from upstream or temporarily block incoming vehicles from the same direction, adjusting in a phasic manner the lanes for the use of platoon line up of other direction of vehicle flow (such as when the left or right turn vehicle lane is spacious, has less incoming traffic or during discontinuity).

Such as using partial intersection space outside the vehicle stop line for platoon line up release. Such as choosing a certain lane as special public transport lane to control row position of public transport and conditional platoon line up matching and platoon line up control in public transport priority plans.

Such as when neighboring intersection is close (such as within the platoon area), and cannot be closed down, the intersection can be kept, extending platoon area, adjust or increase the corresponding release, platoon line up, merge platoon and control device and procedure thereof, and should also take into consideration problems created by the interruption and delay factors and crossing flow volume and platoon line up merging of platoon line up merging, though a little complicated, the theory is essentially the same.

Other alternative control will not be discussed, since the above has a lot of alternative control methods, which can be combined with dynamic platoon line up control to applied road segment.

There are many types of scenarios in speed adjustment of platoon line up control: such as platoon line up merging and release instruction speed, instructing the guiding speed such that vehicles will pass through intersection as without stopping as possible, vehicles reaching a predetermined distance from intersection (can be multiple distances), instructed speed of the formation of green wave, which requires correspondence with signal control system that is close to the intersection.

All different intersections, road segments, and all different entrances, cross-sections, lanes, flow directions of intersection and segment use a corresponding platoon line up control method or use in combination with traditional control; platoon line up control is suitable for road segment or intersection having at least two lanes and containing non-motorized vehicle lane, and suitable for all phase control method, left, right flowing system and one-way traffic.

In conclusion of the above description of platoon line up release control, controlling of vehicle platoon line up procedure includes:

Vehicle x of a certain cross-section, certain direction or lane or certain segment or certain point:

Step y1: carry out instructional guiding control or assistance/automatic control of options from direction, splitting direction, merging direction, speed, distances, positions, orders, lane adjustments, conditions and signal control, through device facility;

Step y2: controlling vehicle to enter platoon line up area or into a certain position within or out of moving vehicle group through instructional guiding control or assistance/automatic control of options from direction, splitting direction, merging direction, split/merge flow control point, speed, distance, position, order, lane adjustment, condition, and signal control.

Step y2+n: control vehicle to enter platoon area or into a certain position within or out of moving vehicle group through instructional guiding control or assistance/automatic control of options from direction, splitting direction, merging direction, split/merge flow control point, speed, distance, position, order, lane adjustment, condition, and signal control, wherein n is a whole number ≧0, which means step y2+n is 0 or any number after step y2.

The above mentioned steps or y1, y2 step or y2, y2+n step can be carried out once, or carry out repeatedly multiple times;

Procedure of vehicle platoon line up control of other direction or certain lane or certain segment or certain point is the same as the above; when controlling by method of simultaneous platoon line-up of multi-directional, multi-lane or multi-segment or multi-point vehicle flow, vehicle platoon line up control procedure cycle of all directions or all lanes, or all segments all points should overlap for at least one time period, such that when using one-at-a-time order platoon line up, procedures repeat in order. Platoon line up, merging can have order control options;

After the procedure of platoon line up control, if there is passage instruction guidance control or assistance/automatic control, then corresponding passage control or control steps will increase, if there are no passage instruction guidance controls or assistance/automatic control, the there will be no passage control or control procedure.

Platoon line up control comprises stable control of platoon: which is to how to control the alignment of all platoons, equalize lengths of all platoons, and equalize passage time, so as to increase the utilization rate and the rate of utilization of lane space of release signal, reduce a waste in green light time due to mismatch of passage of platoon rows (such as loosing the tail of a certain longer rows), which has optional items of: including consistent platoon row of a single entrance and different entrance, balancing passage volume distribution of platoon line up passage way and platoon rows, A: consistent control of platoon length of static and dynamic movement according to signal control time of flow volume and traffic flow model calculation and default values (amendable) or through real-time monitoring, calculation of the accumulated platoon lane length of vehicles entering all platoon rows (lengths of all platoon shape is different), so as to compare predetermined value and process of guiding vehicles to flow into shorter rows, or through (CCD visual frequency image sensing or the like) monitoring device and technology, monitor the length and vehicle flow of all platoon row, and to carry out consistent control guidance of platoon row. Such as consideration of designing the time and instruction when a platoon row tail is short, and the like. B: consistence of speed guidance, because of differences in speeds that vehicle travels, even though the platoon lengths are consistent, situations of difference in release time may occur. Through inspection/monitoring evacuation guidance speed of all platoon rows, especially those at the tail, or monitor changes in lane and speed of vehicle flow of all lanes through CCD visual frequency image sensing or the like inspection devices and technology, and also through speed guidance, carry out dynamic speed control guidance of platoon rows, and the like, which are effective assistance and supplement to consistent platoon length, and can also be applied independently; C: continuation of replacement follow flow and phasic green signal, can consider a certain continued vehicle platoon as a whole, utilize continuous (and can have shorter gaps) control of replacement follow flow and phasic green signal; D: consistent divisional flow volume or time match, when there is a high number of incoming vehicles for a certain direction or certain lane in a certain time period, control the consistent division of flow volume and signal time matching, utilize method of moving or stopped-vehicle line up method to control overflowing flow rate in a road segment, and control of matching of post-period flow volume; E: platoon row grouping, control reasonable grouping platoon of platoon row, realize platoon consistency, such as the problem of grouping, consistency of multi-lane combination platoon and platoon consistency problem when grouping platoon while multilane has same direction platoon lining up (such as partial lanes requires platoon merging); F: combination of the above mentioned technology.

Referring to FIG. 1-30, technological optional items of platoon line up control are introduced:

Fixed area platoon line up control has optional items: a. traffic flow entering into platoon area according to order, platoon line up order is from front to back orderly platoon line up; b. platoon line up lane order from the farthest different lane towards the immediate lane (can be other alternative adjustments such as instantaneous, alternating or from close to far, according to the need); c. replacement follow flow, d. splitting direction and splitting platoon of far position, split direction (those that has not split into their direction will be forced release along with vehicle flow, which is the same as traditional control) or split platoon as early as possible before vehicle flow approaches platoon area and entering platoon area for platoon line up, ensuring early directional splitting or reasonable far position platoon line up curve, prevent the occurrence of situation where vehicles randomly cutting such that the vehicle cannot enter the lane completely, e. large vehicles have the priority of using the immediate lane and the neighboring lanes, which is under the condition that safe distance of split direction lane changing is ensured, utilize the lane that it is originally on or neighboring lanes as much as possible, reduce changing lanes of large vehicles, such as control by inspection/monitoring and signal instruction; f. complete release, no vehicles are allowed to stop and affect normal platoon line up passage within the platoon line up passage way, vehicles that cannot be completed released within the corresponding phase should try to be control released by the following phase, release signal of shape or words displays this signal (clearly instructing vehicles that are not completed released will be released by the following phase), or design ahead of timed the remaining amount of signal (including partitioning time), phase continuation/ripple change, or according to platoon line release condition, adjust the control of platoon line up and release signal by monitoring control by installed inspection/monitoring device, or combine signal remote control and management, to realize complete release, which includes situations of interruption by pedestrians and vehicles; g. borrowed phase, utilization of control of other phasic passage by a certain direction or certain platoon row or certain segment of vehicle flow; h. emergency control, when situations where vehicle are released incompletely occurs occasionally (low probability) even when all control measures to ensure complete release are used, or when malfunction occurs, vehicles in accident block lanes, emergency control will be initiated, such as automatic adjustment through inspection/monitoring, or through remote control or manual control signal instructs that blocked lanes are temporarily shut down, and at the same time other platoon line up and release control adjustment are being made, which will be resumed when blocked vehicles are removed; or directly switch to traditional control.

Apart from referring to fixed area platoon line up control, road segment with movement dynamic platoon line up also has control optional items: a. speed, spacing maintenance and guidance instruction, vehicles moves with reference to speed, spacing distance instruction and information of platoon line up control, forming platoon line through automatic inspectional maintenance technology or visual inspectional identification; b. group into rows as much as possible; c. lane change signaling and move when it is possible, in order to reduce danger of lane changing, apart from obeying control guidance instruction, signaling ahead of time is required for lane changing, and can only do so when it is possible, especially when there is error in control guidance and in instructions; d. follow flow, dynamic platoon line up has a chain effect, when no instructions of platoon line up merging is given or other special situation, following of the vehicle in front should be maintained as much as possible, which is suitable for both before and after splitting direction; e. splitting direction ahead of time, in order to line up and merge platoon smoothly, splitting direction should be completed as much as possible a distant road segment or intersection before; f. maintain position, for certain vehicles, especially when those in the head and tail is in positions for platoon line up, platoon line up control should maintain their positions as much as possible, g. cross phase platoon line up while moving, h. guidance vehicle stopping reduction, mainly realized by speed control and arrival time.

Apart from referring to fixed area and dynamic platoon line up control, combined platoon line up also has control optional items: a. fixed area platoon line up control has priority, when vehicle row approaches guiding area and platoon line up control area, no matter what condition the platoon line up has gone through, even though front and back control is not consistent, should follow fixed area control, b. changing speed safely, reduction of speed or vehicle stopping must be done safely while conditional alternating in platoon line up.

Figure 31:
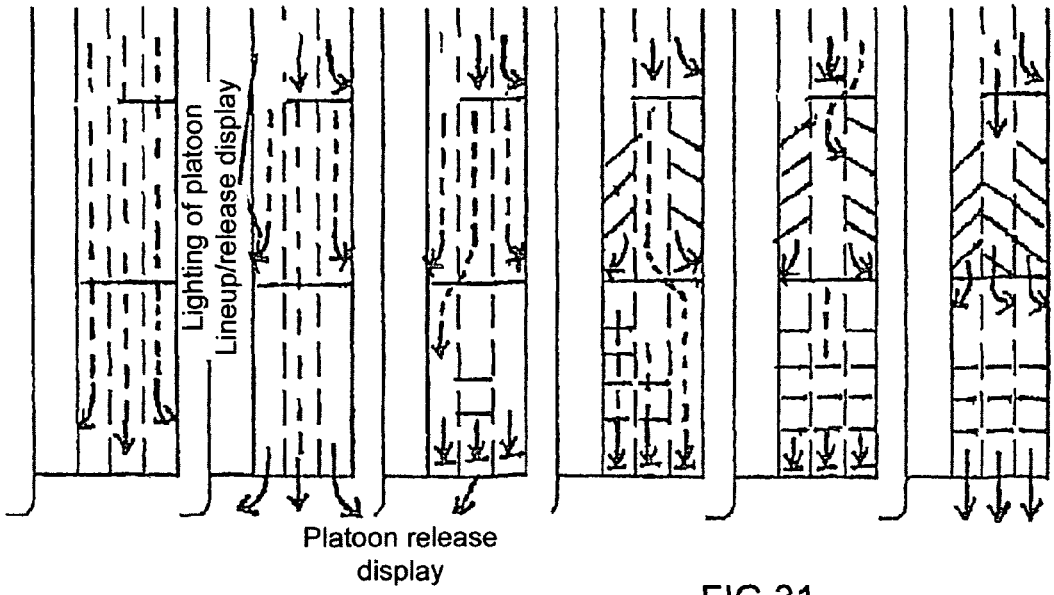
FIGS. 31 and 32 is a flow diagram illustrating the interchange of platoon line up control and traditional control situations.

Referring to FIG. 31, 32, conditional alternating in platoon line up control and traditional control is illustrated.

Figure 32:
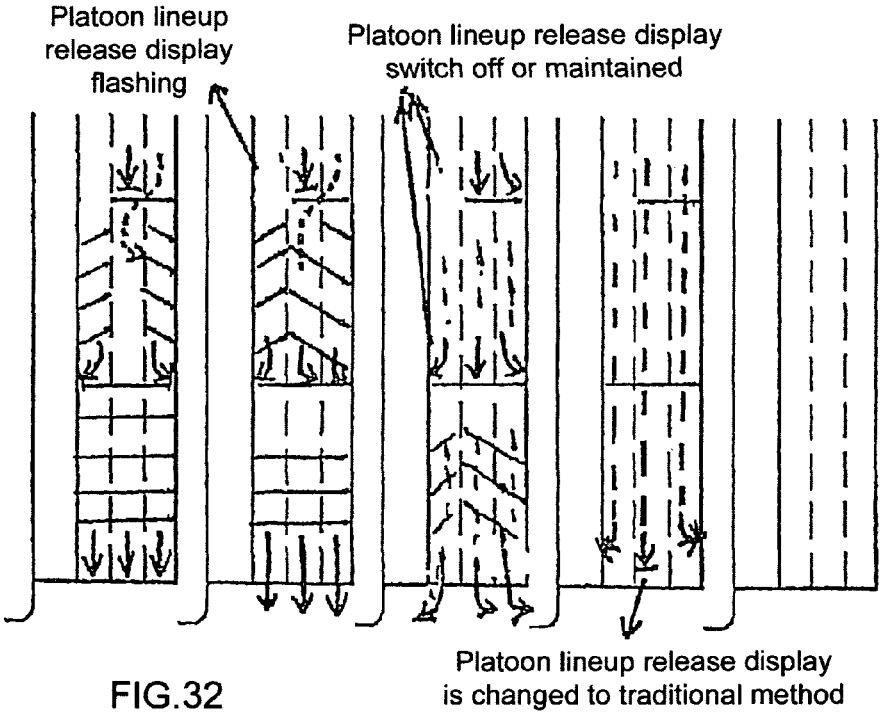
Figure 34:
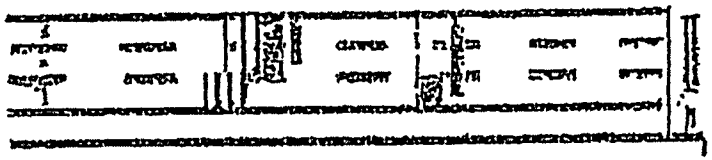
FIGS. 33, 34, 35, 36 and 37 illustrate fixed-area platoon line up control facility structure, each diagram represent the meaning of vehicle-contained device line-up, join and release signal device signal display device (recording) monitoring device inspecting device sign post road side device LCX magnetic needle or signal band communication/navigation facilities
Figure 36:
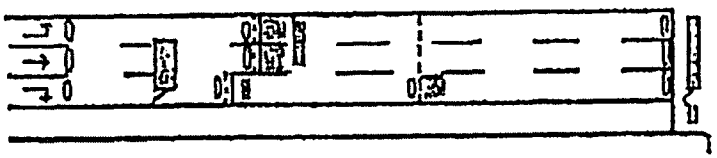
Figure 33:
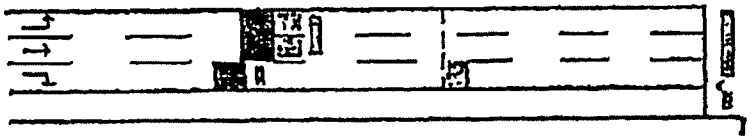
Figure 35:
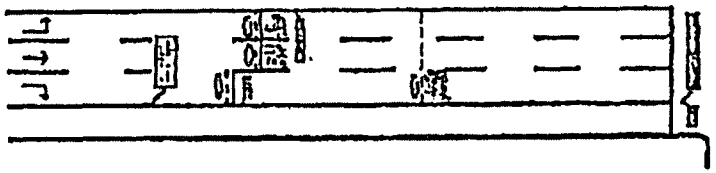
Figure 37:
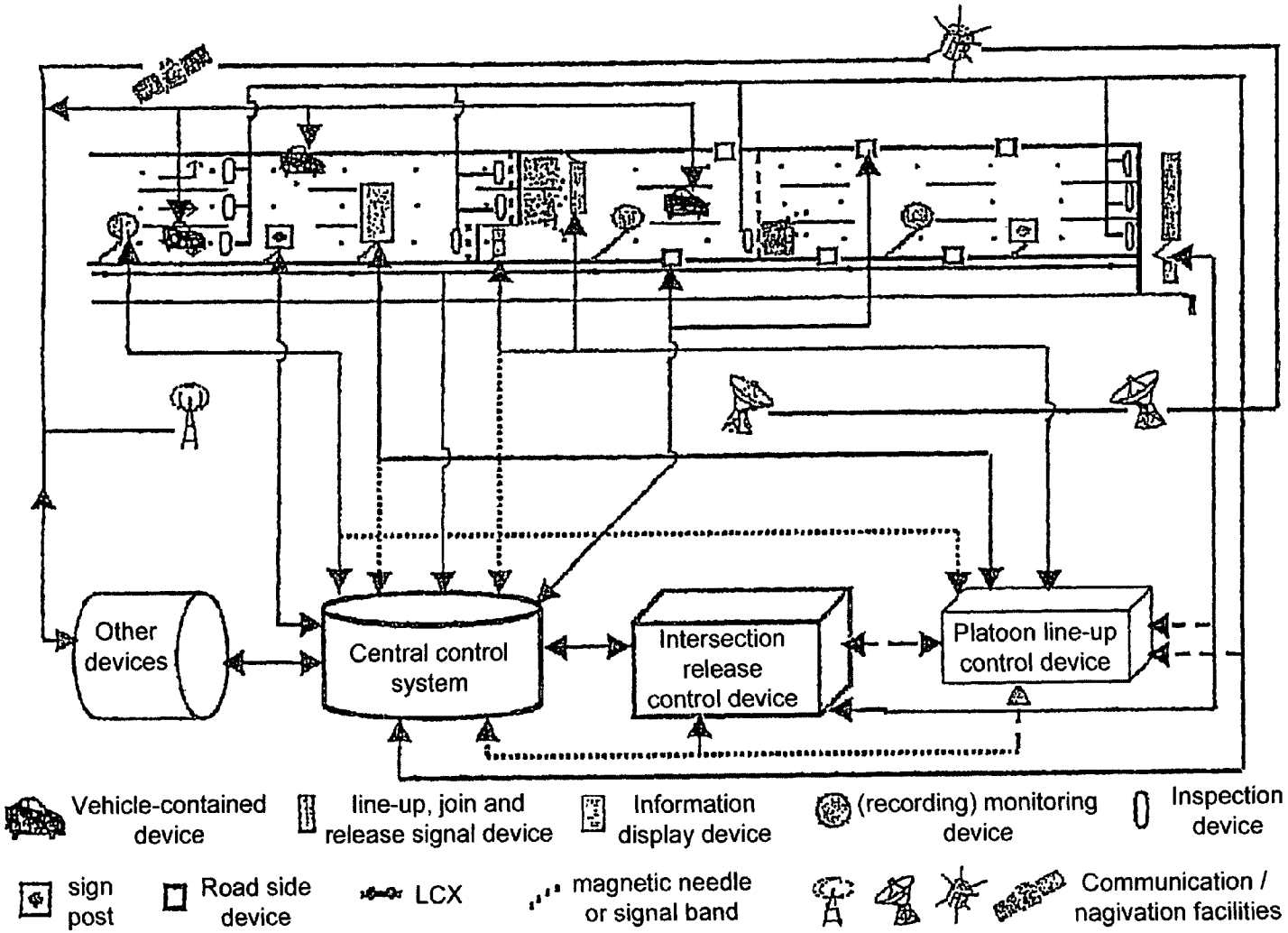

In order to accommodate changes in flow volume and direction, especially when flow volume is small, the control devices of the present invention contains back up traditional control condition and execution power (or independent control device) of storage, amendment and application adjustment time matching plan, according to a predetermined or real-time inspection, realize flexible alternation of traditional control and platoon line up merging control through application adjustment or alternating method. In order to increase alternating efficiency, the commonly used all red complete release method in signal control may be not used. If platoon line up merging control is alternated by traditional control, allowing methods such as portion of vehicle flow or partial platoon follow flow pressurizing complete release (such as the front platoon will follow flow, and other vehicle flow is prohibited from entering platoon area temporarily) and the like (or control of cutting off traffic in a shorter predetermined period of time or reduction of speed) may be used. Instructional guidance display devices may be initiated according to a particular order or simultaneously, or carry out switching of condition or content (must signal before switching, such as flashing), as shown in FIG. 31. And, it is generally easier to switch from platoon line up control to traditional control, which can be initiated at any stage point of any platoon line up merging cycle, carry out switching, instructional guidance display devices may be shut down according to a particular order or simultaneously, or carry out switching of condition or content (must signal before switching, such as flashing), as shown in FIG. 32. Specific control plan of different platoon line up merging control plan are different and should be mastered flexibly. Switching control can also include traffic line showing platoon line up merging can change, corresponding changes of traffic signs (non-display method such as splitting platoon row, guiding line and the line). In case there is power shortage, it should be considered that emergency power source should be designed, and overriding control to traditional control or manual control condition.

And, in order to realize incoming vehicle split direction lanes, flexible change and combination of platoon line up and merge lane and release lane, in utilization adjustment function under control condition (including lane adjustment) and time matching plan, lane adjusting switching function (or independent control device) can also be added), changeable signs or information display device and speed guidance device (or function) that may be used of this function can be installed in a upstream road segment when necessary.

Referring to FIG. 7, 8, 33-37, installation of lines of length of platoon area or other areas is introduced.

Platoon length of platoon can be: each platoon area corresponds to vehicle flow of each time period of all direction (including multi-direction) of control plan, especially during peak time. It should be the total of the allowed maximum or suitable length of vehicle row and the necessary safety lane changing distance, or flexibly determined according to control need and road and traffic condition. Fixed area platoon line up control. Using 3 lanes A method as an example, as shown in FIG. 7/8.

(1) Front platoon length, L Platoon 1=number of platoon line up of reaching appropriate volume of consumer vehicles in the corresponding period during peak time vehicle of front platoon flow direction (such as straight going) q/number of lanes (whole number) n×average stopping distance of head of vehicles L+(L safety).

Vertical length required by vehicle changing lane curve L safety, should be calculated according to the required curvature by the largest type of passage vehicle.

(2) Second length generally has three portions: L Platoon 2=length of largest vehicle row of plan of two platoons merging L1+L safety+(predetermined length connecting main flow of front platoon to second platoon continuous platoon line up, which can be considered to be used when vehicle flow of front platoon is comparative large such that platoon line up time has to be increased L2). The second platoon length calculation theory is the same as that of first platoon, but left right turning vehicle flow is first platoon line up on different lanes then merge, and length of vehicle length will be different due to lane distribution method of merging of vehicle flow of two directions, and has to take the greatest value of platoon merging control plan.

Periodic change for safety, smooth, no conflict and accommodate flow of control platoon line up, merging platoon, choice of safe vehicle distance or position of change lane area has to be reasonable. Method such as: 1: when merging vehicle flow is initiated to merge platoon from guiding area is controlled by platoon line up signal, position can be set at behind ½ (during single file merging) or ⅔ (while double lane merging) before the guiding area*(λ peak incoming traffic flow volume*T period/3600*L average distance of stopped vehicle heads) and later compare with another second platoon lane and obtain the larger value 2. better to install vehicle inspection sensor device, automatically inspect real-time control, L safety installation theory is the same as above. 3. while merging platoon gradually within platoon, if it is single row merging, L safety can be set behind the position of ⅓ (λ peak incoming traffic flow volume*T period/3600*L average distance of stopped vehicle heads) so as to accommodate changes of small flow volume platoon length, if it is double row merging platoon, large flow lane can be set behind ⅓ (λpeak incoming*T period/3600*L average distance of stopped vehicle heads), small flow lane can be set behind ⅔ (λpeak incoming*T period/3600*L average distance of stopped vehicle heads).

Shifting platoon position of chain shifting can be divided to obtain the curvature and width of merging lane.

Control of avoiding and yielding to the longest vehicles: platoon length should at least be able to fit one of the longest vehicles (such as 18 m long hinge connected bus), which can divide up such vehicle space at the tail of the platoon, such that the driver could see directly and determine the volume of the last vehicle space, and change lanes. Platoon area length should not be too long, control method is to reduce signal period and release platoon time. Design theory of other platoon length condition is the same.

Parameters of dynamic platoon release of road segment with movement such as platoon length are relatively stable variables, which usually have no display carriers, and can be realized by monitoring, guidance and distance monitoring maintenance and the like technology. Platoon shape and platoon length can change easily, wherein in general, the average distance between head and tail is greater than the volume value of the fixed area. Also, because adjustment of each distance between vehicles of a moving traffic line can be made to part or make closer through technologies such as distance monitoring maintenance and speed guidance, hence, lane change safety area (because the length should be greater during moving traffic) can be realized through this. Platoon length maintenance of all split direction platoon row under different platoon line up merging control condition is similar to the theory of that of fixed area, which can be represented as: L Platoon n row i=ΣL length of vehicle I+ΣL distance between the head and tail of vehicles I+ΣL safety.

Figure 38:
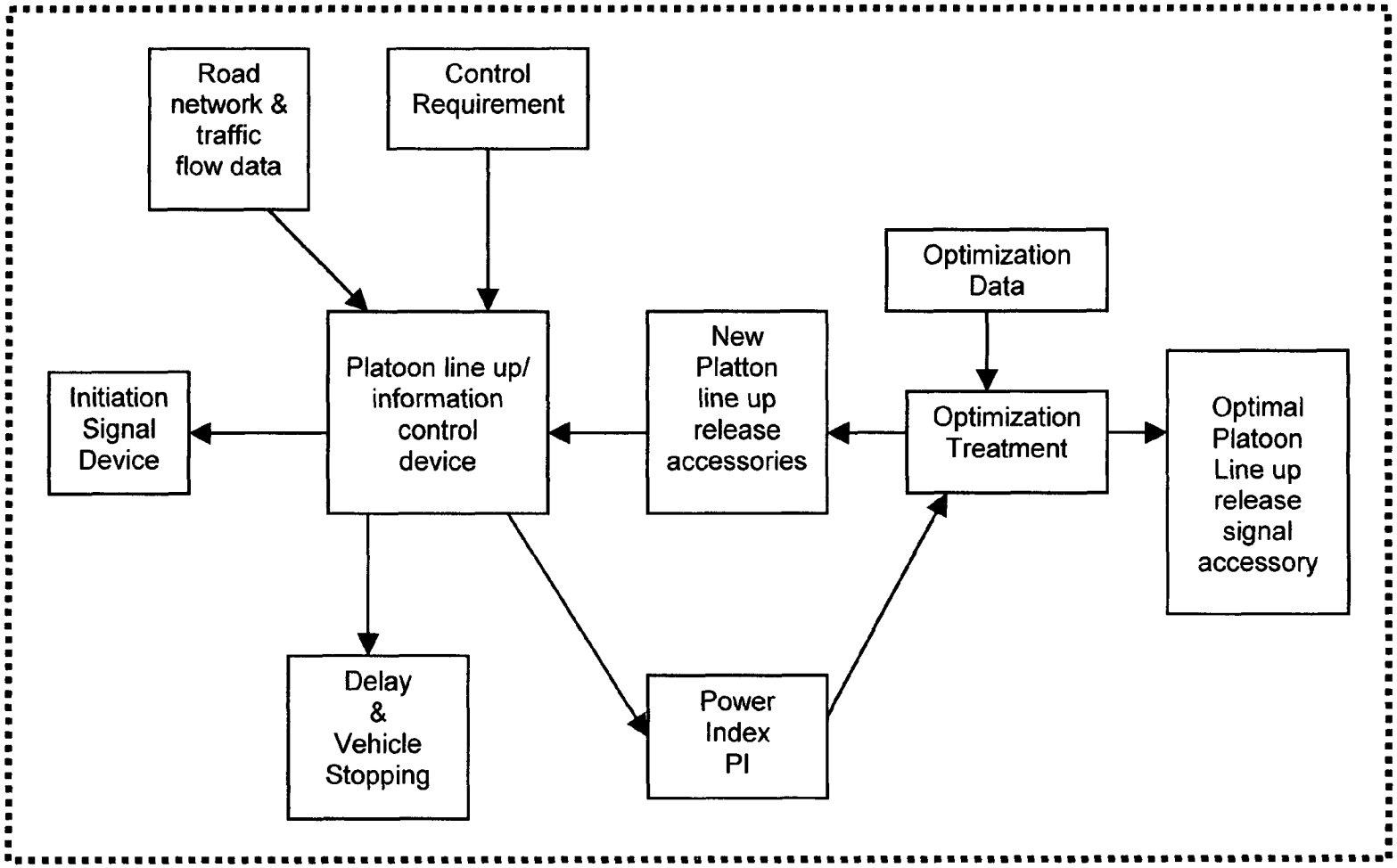
FIG. 38 is a diagram illustrating a simulation control process.
Figure 39:
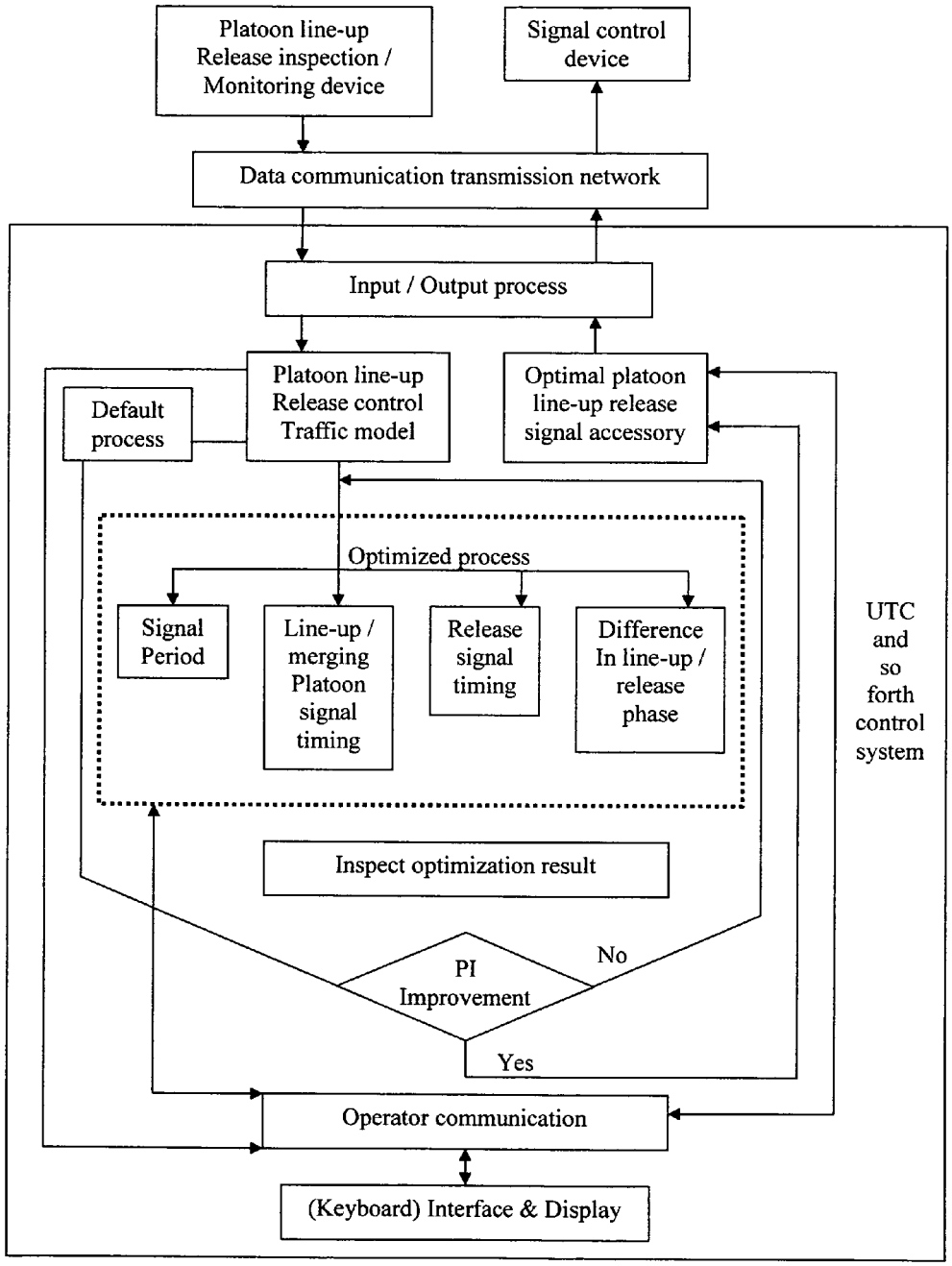
FIG. 39 is a diagram illustrating the basic operational theory of platoon line up control system.
Figure 40:
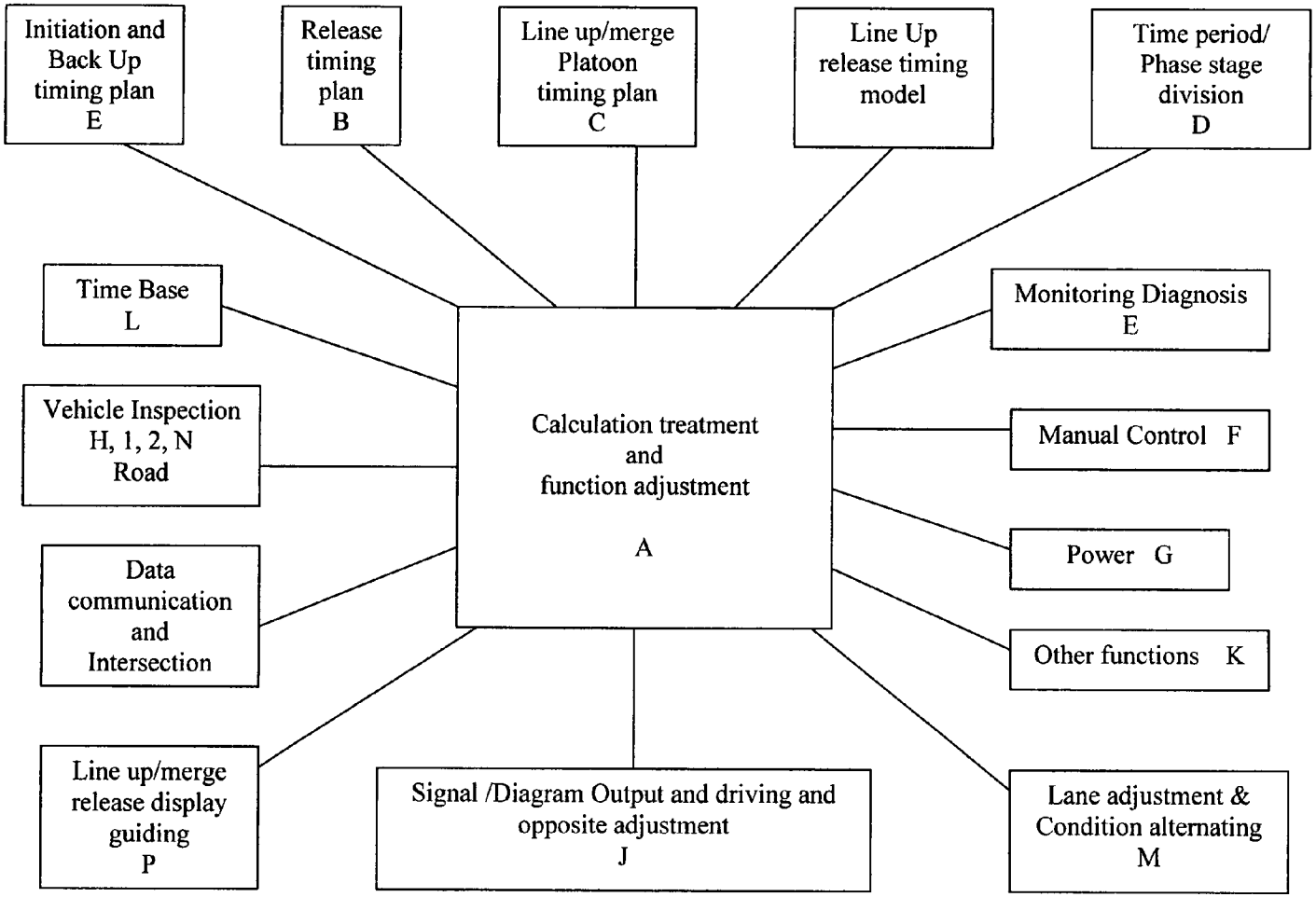
FIG. 40 is a diagram illustrating the structure, theory, and operation of platoon line up control device.
Figure 41:
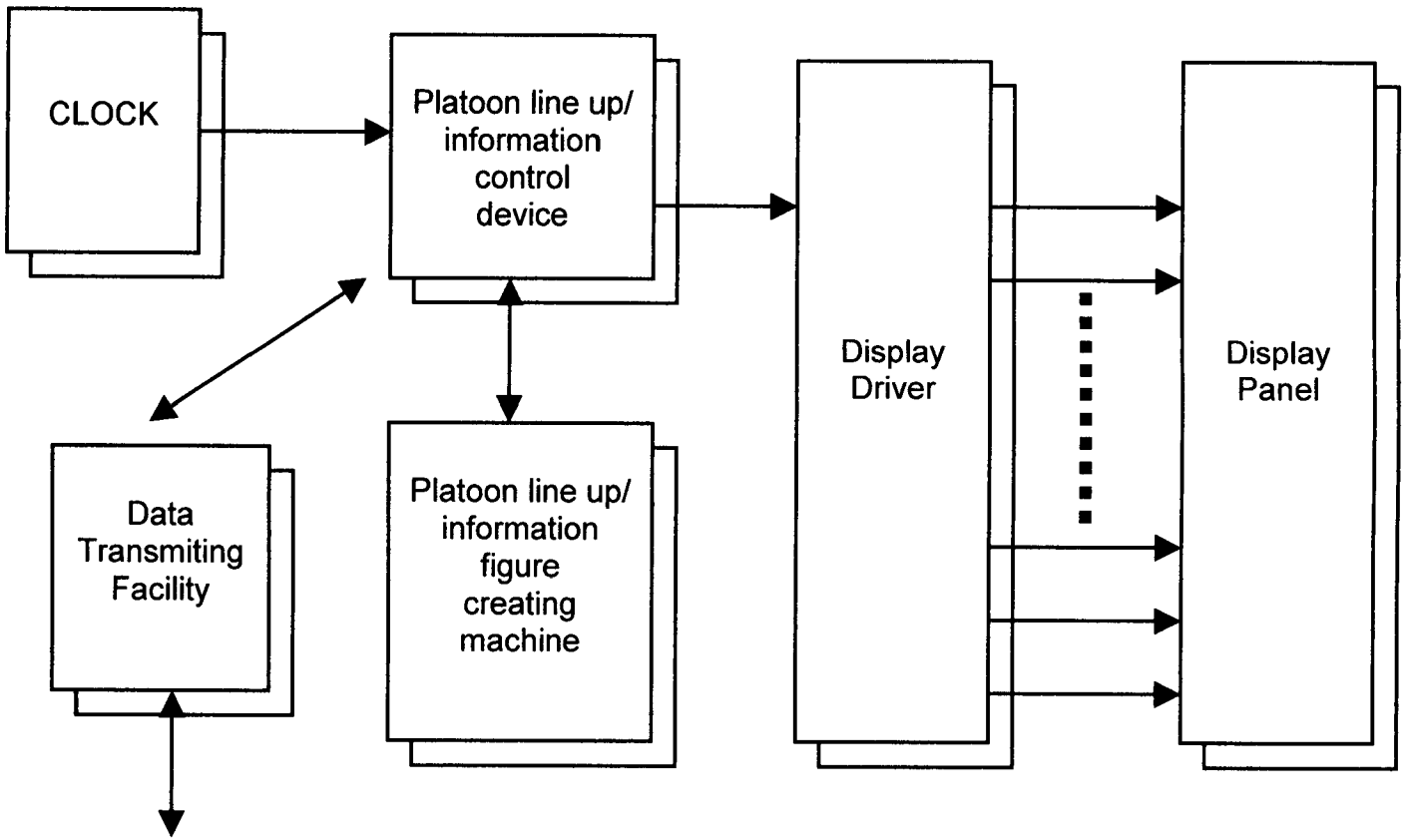
FIG. 41 is a diagram illustrating the theory and structure of platoon line up/signal display device.

Referring to FIG. 33-37, facility structure example of fixed area platoon line up release control is introduced; referring to FIG. 38, simulated control process example of fixed area platoon line up released is introduced; referring to FIG. 39, basic operation theory example of fixed area platoon line up release control system is introduced; referring to FIG. 40, structure, theory and work frame example of platoon line up release control device is introduced. Referring to FIG. 41, theory structure example of fixed area platoon line up release/information display device is introduced; referring to FIG. 42, instructional display example of fixed area platoon line up release is introduced.

Platoon area, traffic lines, signs, control device and the like facilities are as shown in FIG. 33-37.

Platoon control has platoon area/line, guiding area/line, safety lane change area/line, navigation area/line, position shifting area/line, that is invisible or visible, installation of related signs, lines facility and signs display has form, or is fixed or variable.

1. Division of platoon area and guidance area. Such as: can use the original vehicle stop line of intersection as ending line for extending backwardly (a particular situation can happen within the intersection, such as when there are fewer left turning vehicles, left turning vehicles are guided into empty area intersection for waiting in the straight moving phase, so as to set aside vehicle lane for straight going vehicles to borrow for release), divide into a certain number (one or more) platoon area (include borrowed lanes of the immediate direction, opposite direction, motorized vehicles and non-motorized vehicles) according to the need, such as the first platoon area . . . the $n^{th}$ platoon, wherein the last platoon area can also be referred to as final platoon area, and platoon number and combination can be altered according to different needs under different situations. All platoon areas can be parallel, can be connected in order the along road segment, can cross overlap, can be divided cross phase. All platoon area boundary can be displayed independently or together by forms such as traffic signs, lines and signal information device. Traffic lines, platoon dividing lines, and insulating facilities at both sides within the platoon area can be considered to be divided into different respective colors (such as when platoon line up release signal contains directional instruction, in order to prevent vehicles of traffic rows change lanes randomly, dividing lines are made into yellow). Tail portion of last platoon extends upstream as vehicle direction dividing guidance area (or lane change guidance safety area, such as blue area or gradual yellow dash line, square, rhombus or circular shape), or simple per-stop line (such as single, or double yellow or blue dash line) can also be considered, if necessary, guiding area and pre-stop line can be divided cross phase, guiding area can have the function, better than line, of safety cushion area of platoon line up release instruction guidance, and provide pre-platoon line up space that may appear, to prevent as much as possible disadvantages caused by complex or duplex vehicle stopping delay of stopping line and improper control caused by insufficient preparation by driver. If pre-stopping lines are not provided, instructional (display) signs or signal device of guiding platoon line up release may be used to carry out display and control (such as setting up signaling object, signal control device and so forth). When borrowing non-motorized vehicle lane and control opposite vehicle lane, mechanical non-isolation and central isolation device or signs have to contain gaps and signs allowing borrowed lane passage.

Note 1: For simple and convenient for procedure representation of drawings, many platoon area, guiding area, safety lane change area and all types of instruction lines were not drawn in all diagrams, but will not affect the representation of meaning, which should be noted.

2. Functional division of lanes. Division of distribution and function of release, platoon line up lanes can be confirmed according to platoon line up release control plan, traditional vehicle lane order should be obeyed as much as possible (and can also carry out adjustments different from traditional habits). Number of and distribution of platoon line up vehicle lane is confirmed in accordance to flow volume, flow direction, cross-section lanes, exit condition, platoon release control method and requirements, which is also applicable to combined and dynamic platoon line up release.

3. Apply direction splitting lane change curves, position shifting curves, early lane splitting and direction splitting lines, safe lane change vehicle distance areas and so forth. Safe lane change vehicle distance area (simply named as safe lane change area) should be best divided by yellow warning line, which is equivalent to the form and function of the existing intersection no-stopping area, and in order to ensure that the safe lane change area is not blacked by any vehicles, there is a safe lane change area blockage prevention control or design, which can prevent the occurrence of situations of safe lane change area being blocked through methods such as platoon line up signal, information instruction or control, or through inspection/monitoring, signal control design or platoon length remaining value design, as shown in FIG. 7, wherein left turning vehicle is instructed to be prohibited from stopping in safe lane change area, or through inspection/monitoring and signal design, before possible blockage of safe change area control vehicle flow to change the continuation of pre-lining up in guiding area or outside of pre-stop line; if close to or when vehicle blocks lane change area or platoon line up is getting full, there will be information warning or instruction (signal and vehicle stopping line), such as instructing vehicles within platoon to as packed as possible; such as design passage variable post-crossing second lane change area or pre-stop line, backwardly crossing a lane change area out, prevent vehicles from blocking passage. The use of the last vehicle to replace platoon position can be considered for the end of the platoon line up in the lane change area (stopping prohibited), such that the lane change area can be fully utilized, and minimize the length of the platoon. Other lane change curve, position shifting curve, early lane splitting direction splitting line or the like guiding instruction, signal, lines can use the blue color, which contains an instructional meaning. Also, it can correspond to instructional signal installed in platoon splitting area and all type of signal line, such as using protruding paint line. Navigation and signal line can be drawn longer, which can accommodate the vision of driver.

Also, all types of lines such as platoon area, guiding area, platoon splitting area, vehicle lane of the above mentioned content of item 1 and 3, can also make display by the use of variable lines or instruction display device (such that no special line is required) which has obvious color contrast, such as magnetic nails, electrical cable, signal line that can be sensed and recognized; gap marking or ground light emitting or reflective devices or materials; such as directly install platoon line up signal device for platoon area required area and so forth. These automatic identification function of control guidance and ITS and the like system is mainly use for platoon line up, release and speed. In order to accommodate change of platoon line up control due to flow volume change, variable platoon area and guiding area (or pre-stop line) such as moveable type or delivering display type can be considered, such as ground or underground light emitting, reflecting device facility (using materials that can be placed and under light, can receive light or reflect light, which can be used day or night such that light can be reflected or emit light and easy to recognize that is moveable or delivering display, such as laser); such as moveable projection illumination (including marking line projection illumination).

4. Signal and the like device facility. As shown in FIG. 33-37.

(1) Release signal device (optional). The signal device (including the to-be-mentioned platoon line up, platoon merging, guidance instruction and information display device) can be non-traditional signal "light" type electrical or mechanical devices such as electrical optical signal digital board and the like shape, can be a group, multi-group, can be grouped in different directions (can be displayed in one direction or multi-direction combined display) or signal merging of a few lanes, can be installed on its own, or merge with other devices, such as direction, platoon line up release and control condition, information and the like diagram or words display form, and has direction splitting, direction merging, vehicle lane adjustment, platoon control line up and passage instruction guidance, speed guidance, condition and information, non-mechanical control and so forth multi-control display options, which can be installed on road segment, in guidance area, platoon area, entrance of immediate direction or opposite direction, vehicle stopping line, intersection center and the like easy to observe positions, which be installed outside vehicle stopping line or portion of vehicle lane corresponding to each lane or a few lanes, including borrowed opposite direction lanes. In the control of borrow non-motorized vehicle lane, non-motorized vehicle release signal device can be loved backward, and can also be place in the same position as or merge with motorized vehicle control signal device.

(2) Platoon line up and platoon merging signal device (optional). Such as: can install instructional guiding device similar to the above mentioned platoon line up, platoon merging and others release signal device on area above and before or side or ground or the like easy to observe position in the guidance area, platoon area, such that information and content of the platoon area condition, platoon line up merging plan can be displayed.

All platoon line up, platoon merging, initiation or ending control of platoon area can be instructed individually or in combination by release signal and platoon line up and platoon merging signal device, such as when left turning vehicles of second platoon see the left turning follow flow signal of the release signal device or platoon line up and platoon merging signal device means they can move forward (generally not passing through the stop line), and wait to pass until another display of the left turning signal, or seeing direct display of left turning release signal to pass through the intersection. Signal device of lining up, merging, releasing platoon can be placed separately or combined randomly.

Signal display blockage prevention control: above ground, at the side, on the ground and guard rail, isolation facility display device are used to realize multi-position or mobile display, or utilize vehicle-installed display control.

(3) Vehicle inspection (monitoring) device (optional). Inspection/monitoring device can be installed on each monitoring point of platoon line up, platoon merging and platoon release. Such as within/before/next to the guidance area and lane change area, within the platoon area/ending area, release stop line area and the like position, such as inspection/monitoring length and position of possible accumulation lining up of pre-line up vehicle flow before platoon lining up, wherein the position affects the determination of platoon line up time matching of lining up vehicle flow in fixed period. Content of inspection/monitoring may include number of vehicles, vehicle length/width, speed, position, direction and so forth, such as inspection/monitoring the ratio (direction splitting) of number of vehicles, vehicle models, speed, accumulative length of entering platoon and release passage, so as to determine complete release, line up/release condition and the like situation, wherein inspection/monitoring public transports are included. Such as closed cycle type, ultrasound type, infrared, laser, microwave, light-sensitive tube and all types of vehicle sensing devices, image treatment of CCD to inspect/monitor and identification (such as contour scanning, vehicle statistic, vehicle speed calculation, vehicle length and width, vehicle lane usage and platoon line up release situation and the like number image identification), electronic (navigation) labeling, dispersed (regular) optical/microwave blockage (has underground or above ground signal transmitter and receiver, monitoring situations of signal being cut off by vehicles), and platoon line up fixed position inspection device can be used at only at guidance area, lane change area, final position in the platoon and the like positions. It can contain manual or signal activated function, can combine application system such as AUTO2003V, automatic vehicle identification (such as AVI), automatic vehicle classification (such as AVC).

(4) Signal guidance (audio, visual) device (optional). Display technologies such as LCD, CFT, LEO, optical fiber, digital board and the newest optical mirror reflection can all be applied to platoon line up merging control display. It can provide flow volume, speed, lane change platoon condition, lane borrowing and the like information. Such as automatic update visual board and information announcement signs of platoon line up shape and word display. Platoon line up display device can go under edit control, can store and transmit platoon line up navigation related information, plan and coding (coding technology can reduce data volume), can realize alternations and change of display condition and content, or transmit display through mobile communication technology. It can communicate the instructions of platoon line up merging position to a predetermined vehicle through the utilization of a predetermined communication technology. Platoon line up information can be transmitted and received through visual device and audio device. Audio aids answering (such as left right turn, change lane instruction). Vehicle installed display device can be installed on an appropriate position of the front windshield that will not affect vision and safe. And, aviation used multi-layer image display technology and device, "flat display", can be taken into consideration, or display by "glasses". It can have vehicle installed audio frequency agitation (radio), inside or outside vehicle turning signal agitation technology device (contains simultaneous signal agitation switch of direction turning switch) for platoon line up instruction navigation, to receive and transmit direction turning signal, receive and process information by control system, and automatically realize guidance platoon line up.

(5) Sign (optional). Platoon line up control signal also has functions such as inspection (monitoring) and communication. It has positional signs; information signs; duplex communication signs. Its sensor can have manual or signal activated function. Functions including collecting and transmitting information of vehicle position and destination, carry out platoon line up guiding and control adjustment; vehicle identification; intellectualize information signal control. Because detailed traffic information can be obtained, carrying out of signal control of content of automatically formed shape and words can be supported.

(6) Communication system (optional). Communication media of the present invention can be wired (optical cable, electrical cable, phone line, electricity transmission line, internet and so forth) and wireless (radio, optical waves, microwave and so forth). It can be radio signal, optical signal, FM multi-frequency broadcasting, dual direction mobile communication technology (such as the large transmission volume, low in interruption CDMA) and paging system can also be applied. There is communication between road and vehicle of platoon line up control, such as RVC technology in ITS, such as FM multi frequency, wireless and optical media signaling, vehicle phone and mobile phone. They can be divided into periodic type and continuous type. Period type communication is more suitable for the present invention. Inter-vehicle communication in platoon line up release control: such as IVC, realize orderly platoon line up and movement through inter-communication of driving data. Such as a predetermined platoon line up and group line communication: ultra short distance communication system such as milli-wave and the like media, to carry out vehicle position inspection and vehicle to vehicle communication.

(7) Platoon line up positioning, navigation, navigation track guidance identification device (optional). Such as CCD image treatment technology (identifying vehicle lane lines, platoon line up related guiding lines, L safety, outside lane lines), LCX (instruction transmitted by LCX controls head of vehicle lines speed, and others follow from behind), magnetic leak same axle cable, GPS, GIS, hidden magnetic nail and magnetic field inspection sensors, side wall (barrier) and reflective device and LIDAR, lane line type guidance (navigation lights) system and the like, and navigation technology of LCS from America, can all be applied to the present invention.

Vehicle position in platoon line up control can use message signs/monitor distance, wireless navigation, cruise track prediction calculation, beehives numeric data package (CDPD) and the like technology. Cruise track prediction calculation can combine "mapping" technology, when entering area, there are message signal transmission and position monitoring is initiated. It can combine the application of AVL system, navigation image identification, far distance navigation LORAN-C, ground magnetic sensor, near distance communication technology and the like.

Platoon line up navigation, can make use of traffic information to calculate the best cruise and line up release route, and can use GPS, traffic signal of cruise track prediction positioning system and transmitted by traffic monitoring center is carried out in navigation device (combining fixed position information and transmitted information), or calculation of navigation route, and transmission of display are directly handled by traffic control center. It can also has the function of position positioning (checking), platoon line up route guidance can make use of audio and figure and words symbol display (such as cross intersection diagram and platoon line up merge plan, magnifying route), dynamic (real-time platoon line up route guidance) and static are all suitable.

(8) Control treatment (can include driver) device. Platoon line up control treatment and driver device, can be one unit or multi-unit, can be independent or merge with other devices, can be an independent device, can be a specific use device or combined type device or central control treatment system, can be within a certain traditional control treatment device or combination or improvement of specific use traditional and specific use or improvement type device, point, line or service are all suitable; can have options such as platoon line up passage simulation, prediction, optimization, intelligent and the like functions; apart from having traditional functions and platoon line up control procedure/time matching function, platoon line up control treatment device, it can have release control procedure/time matching, platoon line up release procedure/time matching model, time period and phase division, platoon line up display/information guidance, vehicle lane adjustment and control condition alternation, ripple change and the like functional options. It can have public transport priority, accident inspection/monitoring, exhaustion estimation and control content.

Timed, semi-sensing and full-sensing, automatic adjustment, traffic obedience, intelligence are all suitable, can cooperate with partial maximization and full maximization and the like different systems. Control plans and platoon line up release route calculation can be divided into central decision type or terminal decision type.

Such as control the changing of signal (such as period) in control period through plans of prediction, platoon line up and release control prediction, and optimize spacing. Or according to real time inspection data or prediction value to execute platoon line up, release control. Such as platoon line up, release control by applying OD information and accommodate to change of OD traffic need: such as structure building and variable information, navigation, traffic need management, route guidance and the like platoon lining up, release related combined traffic control system. Such as vehicle platoon line up, change line control system and road facility should accommodate and react, and emit information signal to related vehicles. It can combine apply real-time traffic variable signal control technology (RT-TRACS), develop and establish control logic that can flexibly reflect the front of platoon line up condition estimation of the traffic network (all crossing intersection), formed by many real-time control model, maintain the best of each function under different traffic conditions, when condition is determined, control condition is able to automatically change platoon merge release signal control technology, and can add simulated prediction, as shown in FIG. 38, and functions like learning, diagram identification and emergency reacting, danger avoiding technology, assisted driving, priority control technology. It can establish similar or non-similar to SCOOT and SCAT control treatment system (including fixed area, road segment movement, and combined platoon line up control) that has platoon line up passage control as content. As shown in FIG. 39.

In order to accommodate the application of platoon line up control, specific use signal control device can be designed to carry out control, realize inspection and operation conducting according to specific use settings procedure through central (intelligent) control system (such as SCAT and SCOOT and so forth) under intersection that are qualified; or simply connect two or more multi-time period fixed time signal control device of different control release and platoon line up and merging through time-base adjustment, to realize unified control of release and platoon line up and merging. Structural theory and main operation procedure of platoon line up control use only signal control device can be preliminarily designed as FIG. 40 (can have both line up, and release control structure function or only has the previous. B, Q, D, M, P, H, N, K and other portions are optional items. Condition alternation in M includes adjustment of order of platoon. When platoon line up control cannot be carried out, such as during night time and when there are traffic incidences and the like accidental condition, it should be adjusted to use the back up control system, which is usually the traditional control).

(9) Vehicle position inspection maintenance device (optional). Platoon vehicle position inspection and moving guiding line inspection can make use of such as: CCD image. treatment technology, inspect pre-hidden guidance line (such as electric cable), and technology of magnetic nail, electrical wave signal band, LCX, side wall (barrier) and reflection device and LICAR and the like technology, and can combine horizontal vehicle lane technology. Inspection and platoon line up related content: road condition (road boundaries, shape, road surface condition, platoon line up merging related lane line), traffic condition (flow volume, flow direction, speed, line order, signal, signs) and so forth. Such as vehicle distances, vehicle reverse monitoring device and the like ultra-sound wave monitoring technology and device; laser radar vehicle distance monitoring technology and device: automatic adjustment navigation control technology and device LIDAR (inspect vehicle distance); millimeter area electronic wave automatic navigation control technology and device (RADAR). Front, side, rear and full directional positioning inspection, can make use of laser and milli-wave, which is good for short distance and has strong directional ability. And can make use of image recorder, radar and automatic navigation control device combination, to judge the front and rear condition, inspect empty lanes and platoon line gaps, control vehicle speed. Replacement method such that vehicles transmit between each other their own positions can be applied. It can be applied in combination with advance vehicle control AVCS.

(10) Moving control system (optional). Platoon line up control, can obtain external information through sensors of the single or both vehicle-installed or foundation facility, to realize platoon line up control: deceleration and acceleration, control movement, direction change, lane change, display and so forth, which can be seen as vehicle installed platoon line up drive automatic control device. Such as laying down navigation form technology of guiding line electrical cable to carry out direction change control; such as application of road side wall, three face right angle prisms, magnetic nail, such as applying self-discipline type technology like mechanical visual technology (visual system that combines image recorder and computer combined); such as horizontal control technology such as mechanical visual and prediction positioning; such as install control technology for identifying vehicle lane markings; such as ACC technology combining vehicle distance inspection and automatic speed adjustment; such as using vehicle distances radar that arrange drive that can maintain a short vehicle distance and longitudinal control of vehicle-vehicle communication, such as technology related to ITS.

(11) Other devices. Such as image recording of vehicles violating regulations, central line shifting, full angle inspection, far distance direction splitting and so forth devices.

Fixed area platoon line up control can also be controlled by vehicle installed (signal instruction, platoon line up/release control treatment, positioning and navigation, automatic/assisted drive and so forth in vehicle) devices, can be vehicle-installed and road-installed devices combined, not using or minimal use of road installed signal device. Such that the above devices can be flexibly combined to use, including increase facilities for vehicle installed or road installed platoon line up and release control for not using or minimal use of road installed signal device, such as a single vehicle (individual vehicle device is according to the control treatment of platoon line up/release calculated from the related platoon line up/release information) or a plurality of vehicle (according to the related platoon line up/release information vehicles of point, line, surface, are calculated together to treat and carry out multi-vehicles platoon line up/release control) platoon line up control treatment facilities, signal/information instruction in the vehicles, positioning navigation, automatic/assisted driving, road condition/vehicle position inspection maintenance and so forth devices. Such as using multi-vehicle control treatment device to collect platoon related information such as positioning, road condition, flow volume and flow rate and so forth, communication control multi-vehicle automatic/assisted drive device or vehicle-installed signal/information device to carry out platoon line up/release control, and so forth.

And, all types of intelligent traffic system using platoon line up control as content can be established, and including automatic adjustment, intelligent, specialist, fuzzy, nerve, and other forms of control model that can be applied to traffic control.

Note 2: Road-installed/vehicle installed platoon line up and release device and other display guidance device involved in the present invention, can be improvements of traditional device; can be new devices, can be electrical or mechanical devices (projection and searchlight type signal device, tumbling type, rotational type, curtain type and the like mechanical type or combined with electrical type device) such as non-traditional signal "light" type electrical optical signal pixel board and the like, can be board-installed light form, and can be detachable connected combined type device of direction, vehicle lane, condition, information and the like instruction. It includes platoon line up/information control device and platoon line up/information diagram/words creating device and other traditional device/parts combined to display guidance device, can be single unit or multi-unit, can be singly installed or combine with other device, which has direction, platoon line up passage and control condition, information, diagram, words display format, and has direction, splitting direction, vehicle lane markings (such as vehicle lane number markings) and adjustment (including all orders of traditional or non-traditional, apart from formats already listed such as many platoon line up lane change, control display options such as all direction alternation: left turning, straight, left turning, straight, straight, right turning, straight, right turning), platoon line up and passage instruction guidance, speed guidance (such as reduction in speed, speed limit instruction control under rain, snow, hail, night condition), condition and information, non-mechanical control, such as before approaching the platoon line up, there are speed (deceleration) instruction and instruction control of splitting direction ahead of time. Wherein direction display forms include one direction, multi-direction, cross-direction, splitting direction, merging direction, condition include options such as immediate line up of platoon/merge platoon condition, empty space condition, moving condition, all platoon line increase/reduce change condition, and also include time reduction display format (numbers or diagram). It can be installed within the vehicle or road segment, guidance area, platoon area, entrance of immediate direction or opposite direction, easy to observe central position of intersection, according to position of each lane and certain platoon. Display device can store multi-plans or make temporary changes or adjustment can be controlled by central system.

Color, shape, content, position and so forth of display signal, can be determined flexibly with reference to related standard, requirement and theory, may be fixed and may be changeable, change control can be manual, automatic, dynamic and static, and can include audio and non-traditional display format. Such as gradual increase or decrease dynamic display platoon line platoon length, condition: such as using platoon line up and passage condition control process example of the present invention to display diagram example or developed diagram example, can also be used as display design diagram. Such as treating immediately the traffic flow and so forth traffic condition data collected by inspection (monitor) device, information signal and so forth to, then directly display in a particular identified format on the display device of platoon line up/merge control and information guidance, to carry out instruction guidance, and can also realize "ticket and corresponding seat plan" where one-vehicle-at-a-time corresponding display control which requires the main characteristic of a vehicle such as the license plate corresponding through image treatment technology. At the same time, the function of the signal instruction guidance of the present invention is very special, and the power of continuation is very strong, such that the traditional red, yellow, green signal can be unused, such as during release control when all phases are continuous, cycling of each red signal process is not required (or red signal). It can also increase the installation of other traditional and non-traditional device, such as specific use far distance splitting direction, platoon line up, merging platoon inspection device and so forth. These new function extends its applicable area, such as speed adjusting guidance of single lane (such as predetermined speed limit display, radar automatic display speed limiting, or realized through other display speed limiting device display transmission and so forth) and traffic information display and so forth control; such as vehicle lane adjusting and platoon line up consistency control and so forth.

And, instruction guidance and control device can be installed at isolation area, isolation guard rail. It can also be considered to use ground surface or underground light-emitting moveable or transmission information display outside of the vehicle stopping line. Mechanical, non-signal control device can be grouped, and can be singled out.

Figure 42:
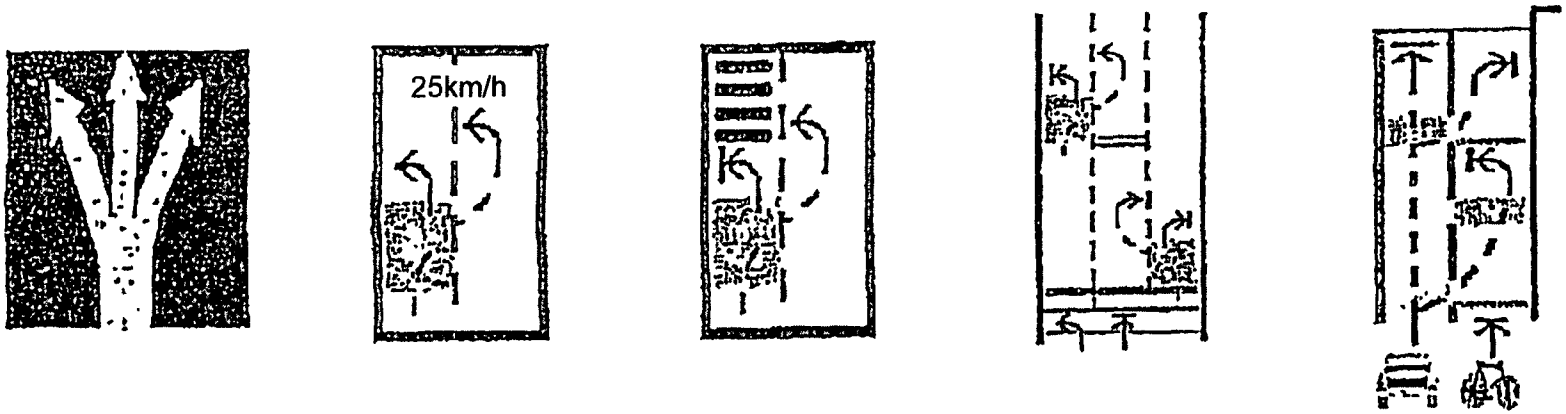
FIG. 42 is a diagram illustrating platoon line up signal display.

Structural frame diagram of Platoon line up/information display device theory is as illustrated in FIG. 41, displaying diagram as those in FIG. 42.

Device facility for roundabout and borrowing of opposite motorized or non-motorized vehicle lane and the like condition (such as platoon area, guidance area, safety lane change area, signs, line markings, signal control device and so forth) is installed according to the above theory.

Figure 43:
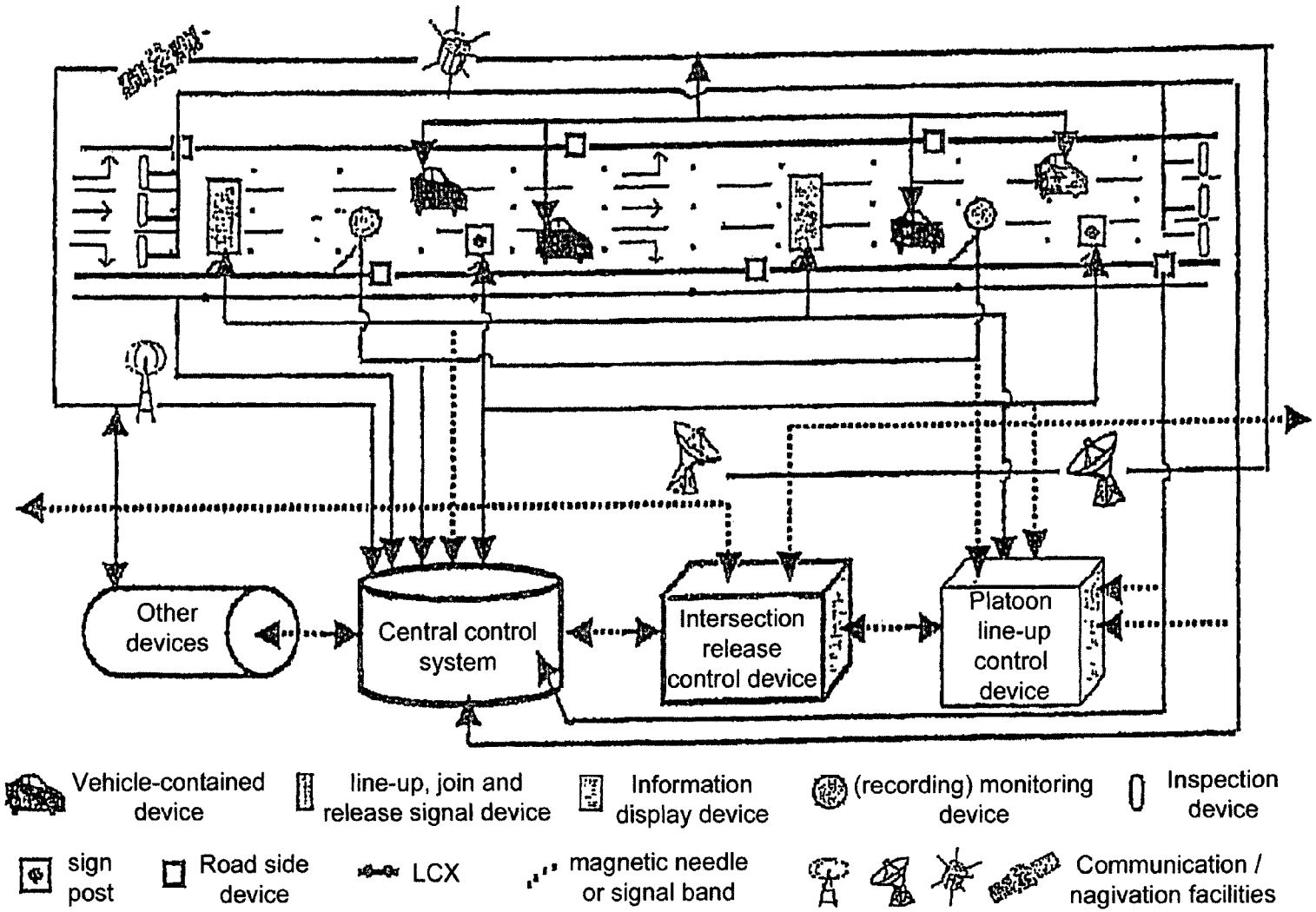
FIG. 43 illustrate dynamic platoon line up control facility structure, each diagram represent the meaning of inspecting device vehicle-contained device signal display device (recording) monitoring device LCX sign post road side device magnetic needle or signal band communication/navigation facilities

Referring to FIG. 43, device and structure of dynamic platoon line up control of road segment during movement is illustrated.

Safety and control accuracy requirements for dynamic platoon line up of road segment with movement is higher, as a result, inspection (monitor), (information) display guidance, communication, vehicle position inspection maintenance, driving control, cruise track inspection guidance, control treatment and the like technology and facility has a certain requirement. The higher in number and the accuracy of the technology and facility, the easier it is for dynamic platoon line up and merging control, and the safety and effect will be better. FIG. 43 illustrates some applicable technology facility, vehicle-installed facilities are not going to be discussed here. Some facilities are optional, such as only using direction splitting lines, distance identification markings, inspection (monitor) device and platoon line up information guidance board, according to the flow volume of the split direction after direction splitting, calculate and emit on platoon line up merging information board platoon line up merging guidance information and instruction (such as speed, vehicle distance, platoon order, platoon dynamic shape, cross phase method and so forth), display by control system (or according to stored information), moving vehicles (driver) will dynamically line up or merge accordingly.

Combined platoon control device and structure: traffic signs, markings, isolation facility, device and the like device facilities of combined platoon, can adjust facilities according to related device condition of fixed area and moving traffic dynamic platoon according to their own characteristic and requirements.

Factors of different conditions of each intersection and road segment and different flow volume, determine the difference in overall control method, procedure, facility technology. No discussion will be made to those outside of the examples already given. It can be flexibly mastered according to the control technological theory of the present invention.

Figure 50:
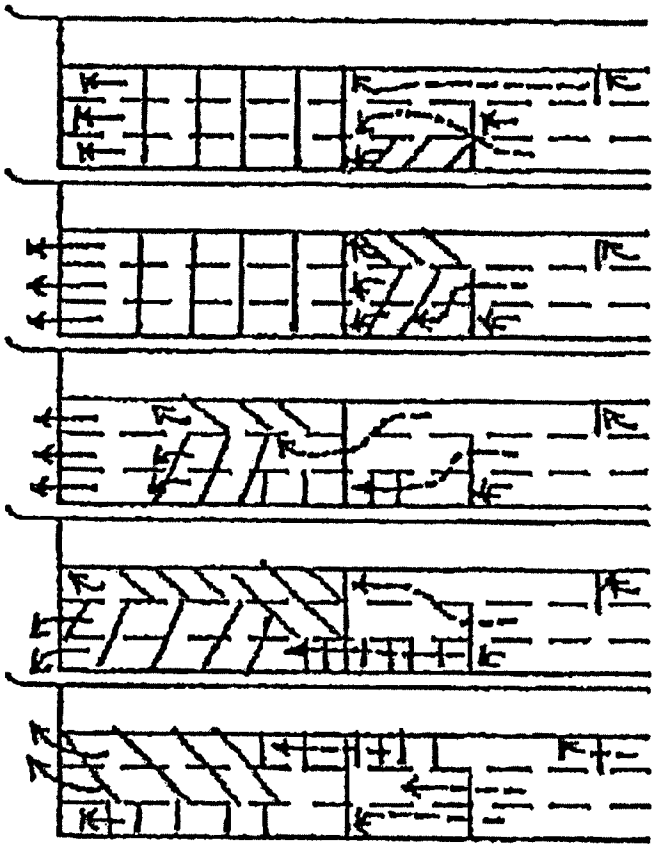
Figure 51:
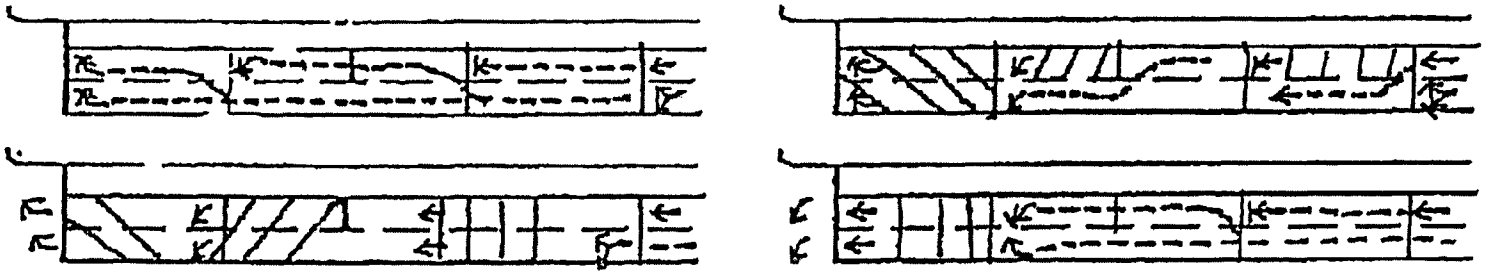
Figure 52:
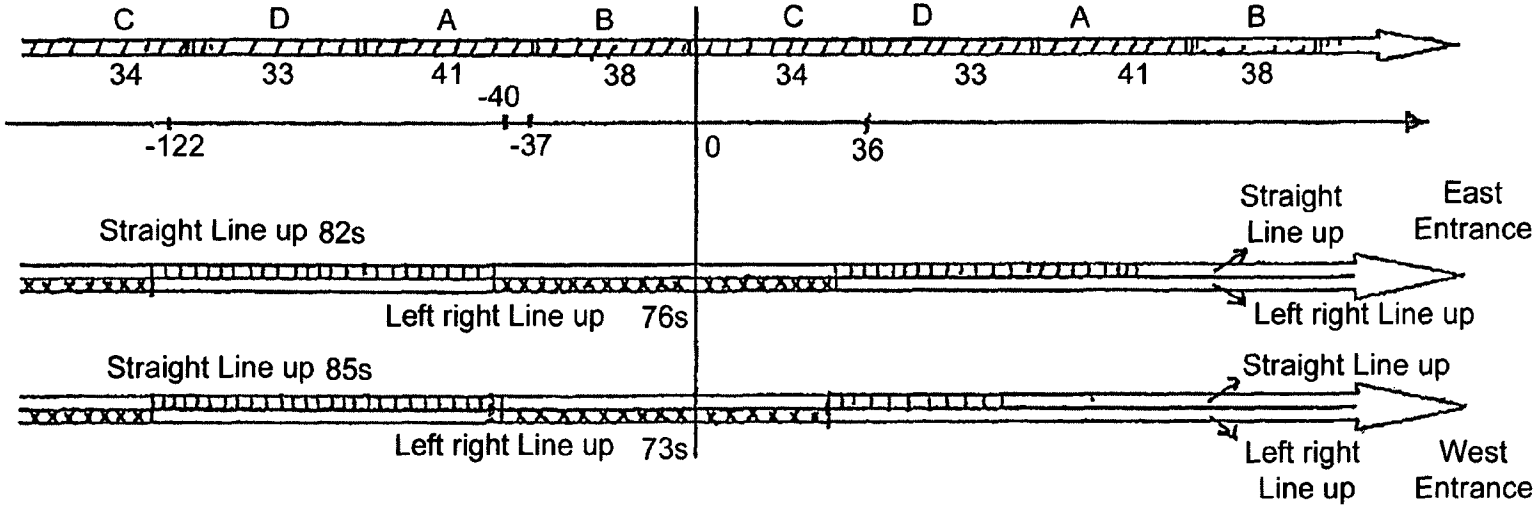
FIGS. 52 and 53 is a diagram illustrating the release and arrangement time of the east-west entrance and north entrance of platoon line up arrangement with time according to method A.

Referring to FIG. 44-51, passage control and platoon line up control plan according to the applied Method A and Method C of fixed area platoon control is illustrated; referring to FIG. 52, 53, the corresponding platoon line up time-matching procedure is illustrated;

Platoon control utilizes timing, sensing, automatic adjustment, traffic response, intelligent and the like control method, when it involves platoon line up control signal time matching and procedural parameter and so forth content, including green wave combined or established under platoon line control, late-initiating and early-cutting off or early-initiating and late-cutting off and so forth all types of present control technology, such as portion or part of dynamic, combined platoon line up green wave, such as realizing control of platoon line up control signal accommodation (green wave), there are options of: fixed area platoon line up control signal time matching can be determination method of determining platoon line up time matching after determining release time matching, can be determining release time matching after determining platoon line up time matching, maximizing chain-reaction adjustment, release control, according to parameter, can have extended or amended traditional control model or platoon control mode time matching, platoon line up control can have time matching according to platoon line up control model, cooperation of release and platoon line up signal time match is determined according to control requirement.

1. Release signal: according to platoon line up control theory and experience, the often adopted traffic control experimental formula of the British Transport and Road Research Laboratory (TRRL) C=(1.5 L+5)/(1−Y) may be applied.

Example: For a particular intersection as shown in the drawings, north-south direction motorized vehicle lane width are all 21 m, left turning lane radius R=30 m, right turning lane radius R=18 M. This intersection involves all platoon line up method of lanes 2-4, complex and has representation. Peak hour (or using 15-30 minutes as sample calculation) flow volume: east entrance: straight=500, left=200; west entrance: straight=650, left=300, right=260; north entrance: straight=1000, left 350, right=500; south entrance: straight=1100, left=600, right=500. Peak hour total flow volume Q=6420. Unit is number of vehicles/hour.

Figure 45:
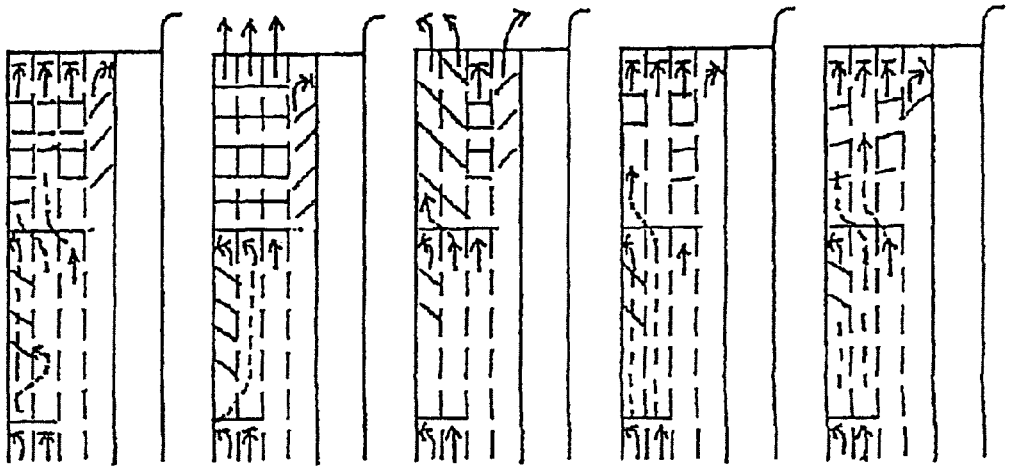
Figures 1, 46:
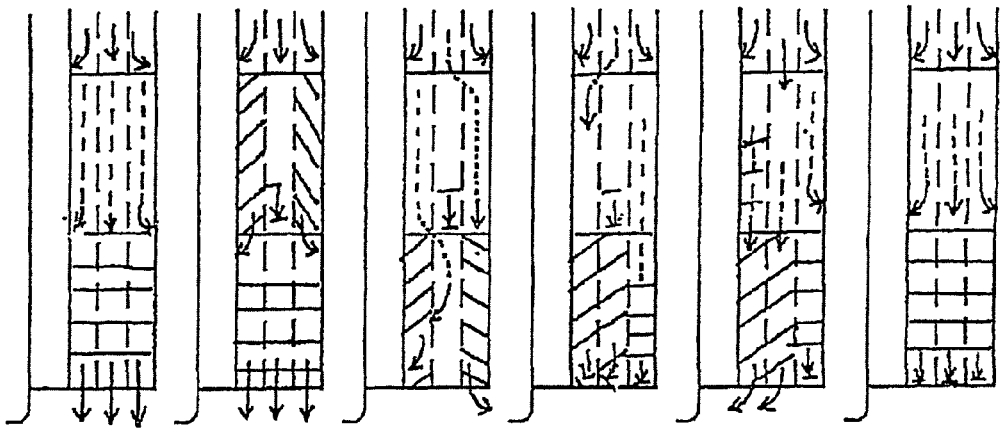
Figures 2, 46:
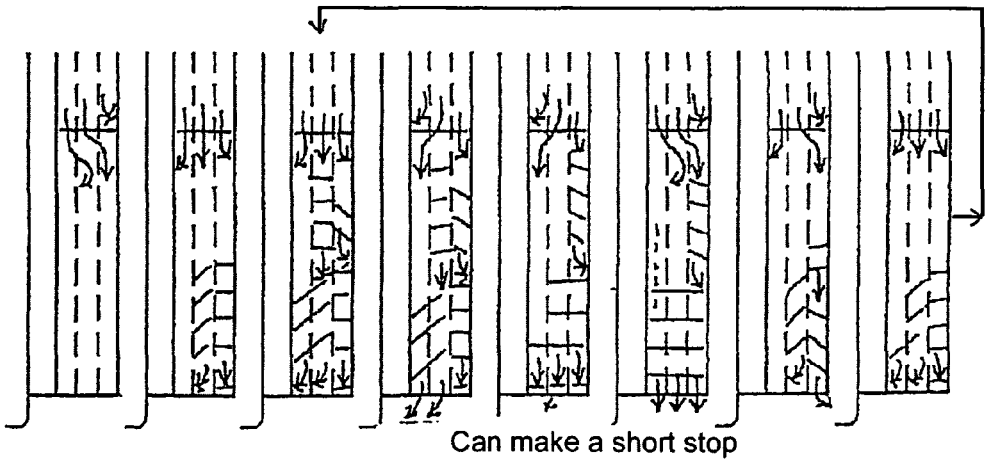
Figure 47:
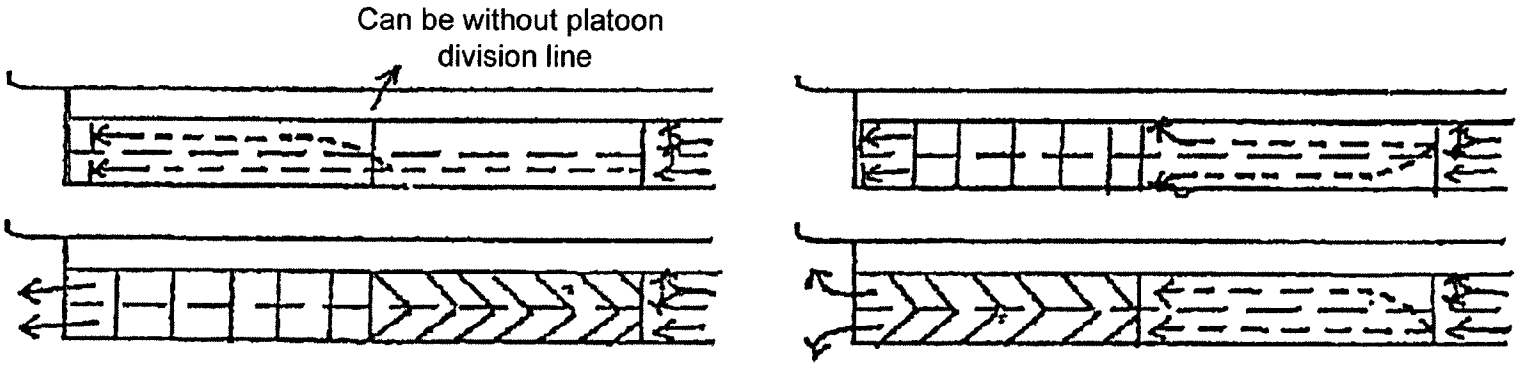

1-1. Method A platoon line up control is first chosen, which is easier to line up platoon. Control plan as FIG. 44. South entrance and north entrance platoon line up release control: as shown in FIG. 45 and FIG. 46, east entrance and west entrance platoon line up control are the same and is only shown by east entrance: as shown in FIG. 47.

After calculation: C=(1.5 L+5)/(1−Y)=35/0.222=158 s. Effect green light time of all phases. GA=39 s, GB=36 s, GC=32 s, GD=31 s. In order to reduce green light separation time, during application, yellow light flashing time should be reduced from 3 s to 1 s, full red time will not change, then the real green light time of all phases are: 41 s, 38 s, 35 s, 33 s.

Figure 48:
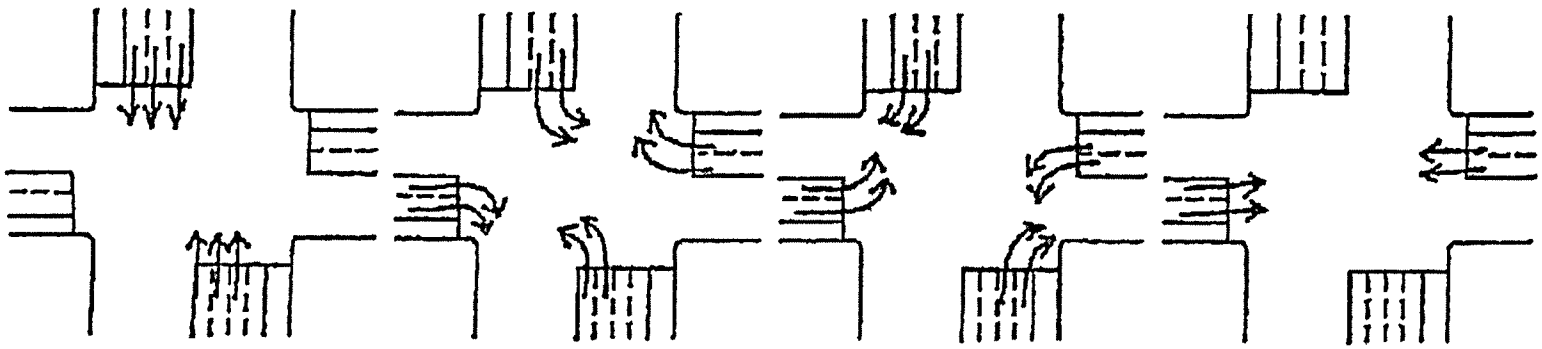
FIGS. 48, 49, 50, 51 is a flow diagram illustrating method C passage control and platoon line up control of platoon line up arrangement with time.
Figure 49:
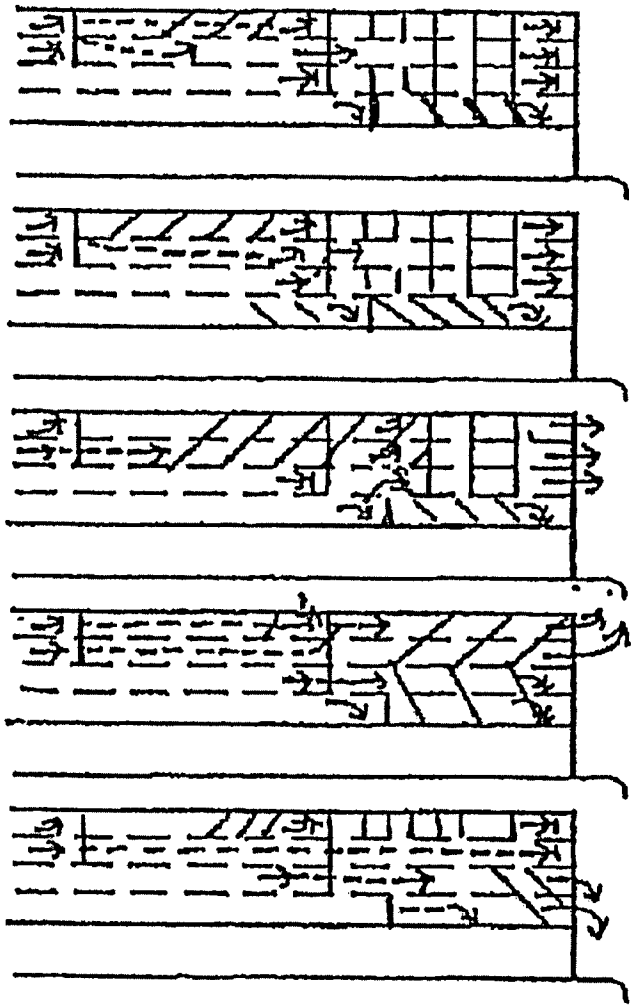

1-2. Method C. Control case is as shown in FIG. 48. South north direction release platoon order is straight, left, right, second platoon area platoon control, platoon order is straight, left and right; east west direction platoon line up and release order is right, left, and straight. South entrance and north entrance platoon line up control: as shown in FIG. 49 and FIG. 50, east entrance and west entrance platoon line up control are the same, and only the east entrance is shown as an example: as shown in FIG. 51.

After calculation: C=35/0.239=147 s. GA=36 s, GB=33 s, GC=28 s, GD=30 s.

Each green light time of all phases add 2 s, and are 38 s, 35 s, 30 s, 32 s, respectively.

1-3. Assuming east west direction straight flow peak flow volume is mediate such as: east straight=400 vehicles/hour, east straight=380 vehicles/hour, respectively, then Method platoon line up release can be considered. Control plan is not discussed here:

2. Platoon length calculation: 2-1: Method A. Procedure is not discussed.

South entrance: the outer most right vehicle lane does not participate in platoon line up, L platoon 1=93 m, L platoon 2=53 m. L total=146 m. North entrance: L platoon 1=83 m, L platoon 2=75 m, L total=158 m. North left has no merging platoon, and can line up platoon continuously, L platoon 2 can also has double right turn and is allowed to have 63 m. East entrance: L platoon 1=63 m, L platoon 2=68 m, L total=131 m. West entrance: L platoon 1=83 m, L platoon 2=78 m, L total=161 m.

2-2: Method C: South entrance: L platoon 1=83 m, fourth lane platoon length=55 m, L platoon 2=63 m, L total=146 m. North entrance: L platoon 1=78 m, L platoon 2=63 m, L total=141 m. East entrance: L platoon 1=38 m, L platoon 2=53 m, L platoon 3=63 m, L total=154 m.

West entrance: L platoon 1=38 m, L platoon 2=73 m, L platoon 3=78 m, L total=179 m.

2-3: Method B is not discussed.

When there is assistance from inspection device, port of the platoon length can be adjusted to be reduced or cancelled, as illustrated in FIG. 50, when inspection device is installed on the straight left pre-stop line of the right turning lane, right turning platoon length can be the same as the left turning platoon length.

3. Platoon timing:

3-1: Method A: East west entrance straight going and left right single lane cross platoon line up, as shown in FIG. 47:

According to the platoon line up control principle that the ratio of platoon line up timing T and flow volume and platoon line up passage Q/Σn should basically be proportional (can adjust according to different gathering wave, evacuation wave, and normal random incoming vehicle flow rate), T east straight line up is=T period*(λ east straight incoming 500/(500+200+260))=82 s, T east left right line up=T period−T east straight line up=158−82=76 s. And under the same theory, T west straight platoon=158*(650/1210)=85 s, T west left right platoon=158−85=73 s.

Starting/ending time: setting straight going platoon starting time as the 0 of the period, then when should the first platoon starts to be released after straight platoon line up? Utilizing wave theory and platoon line up theory, initiation of release is set to be x seconds after straight lining up, under the requirement of least delay, using phase C as the starting point, after calculation (not discussed) west entrance platoon line up period is to be brought ahead 122 s to be initiated (best to set inspection sensor device to carry out real-time control).

It can also use two other methods to predict platoon line up period starting time. Known conservative high-efficiency model and ideal high-efficiency model of platoon line up and release: when platoon line up period ends, when the last vehicle just enters the platoon or when it reaches stopping line, evacuation wave is just passing or release phase ends, the time used are T evacuation=L total platoon/V evacuation wave and T flow=L total platoon/V average (such as easy to calculate when distance (60 m time V average speed 20 km/h) 60 m takes 25 km/h). Then X=158−T evacuation (23)=135 s or 158−(67+3 green light separation−T flow (24))=112 s, these two value represent respectively the two most steady and best scenario X value, and 122 s basically is the average of the two, such that remaining value design can take this average value 122 s. This proves that the accuracy of the above prediction. Which is X=K {(T period−T evacuation)+(T period−[G−T flow])}, K=½ or other appropriate values.

When determining time difference X of platoon line up release timing of opposite platoon and line, under the requirement of minimizing delay, the average scope value of conservative high-efficiency model type and ideal high-efficiency type can be taken. When there are no straight delay requirements, X can exceed this scope.

East Entrance: using the same theory as the east entrance. X=½ {(158−22)+[158−(67−131/25 km/h)]}=½ [(158−22)+(158−51)]=121.5 s. It can be seen that the platoon line up timing cycle of two intersections that correspond to the same direction is affected by the unity of release phase and is basically equal, and can unified to take combine platoon length calculation. Such as east west both take X=122 s. Then the diagram of east entrance and west entrance platoon line up and release phase time period is as shown in FIG. 52.

Figures 1, 53:
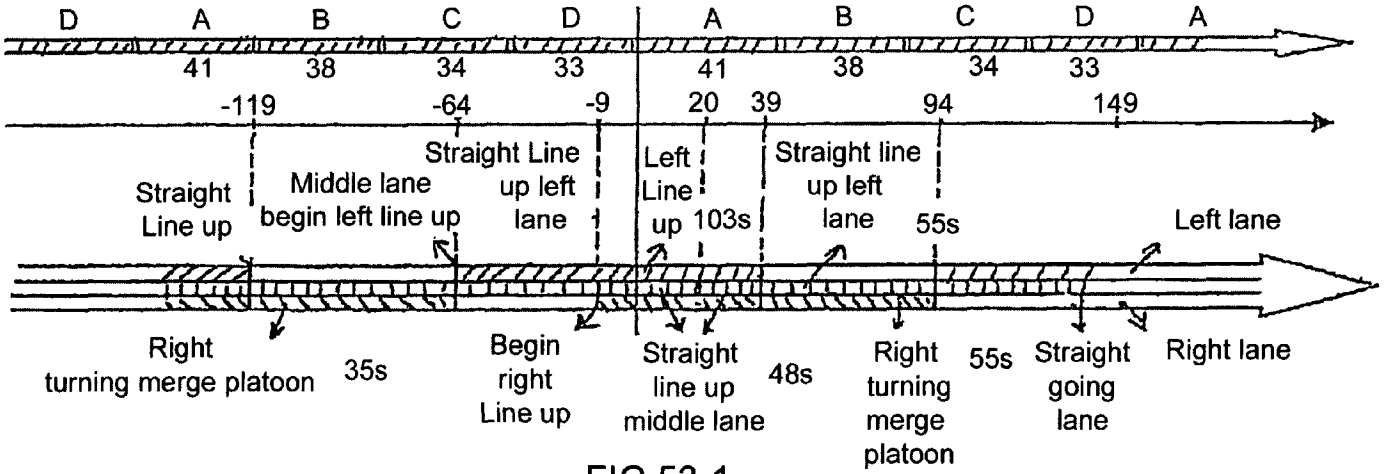
Figures 2, 53:
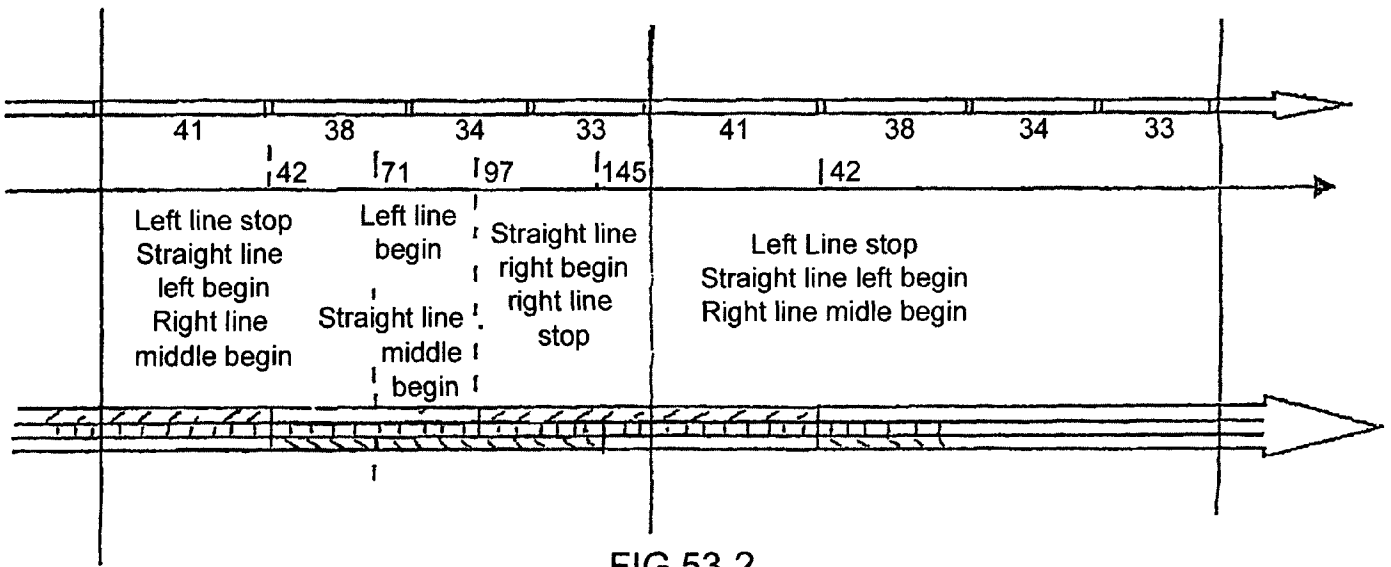
Figure 54:
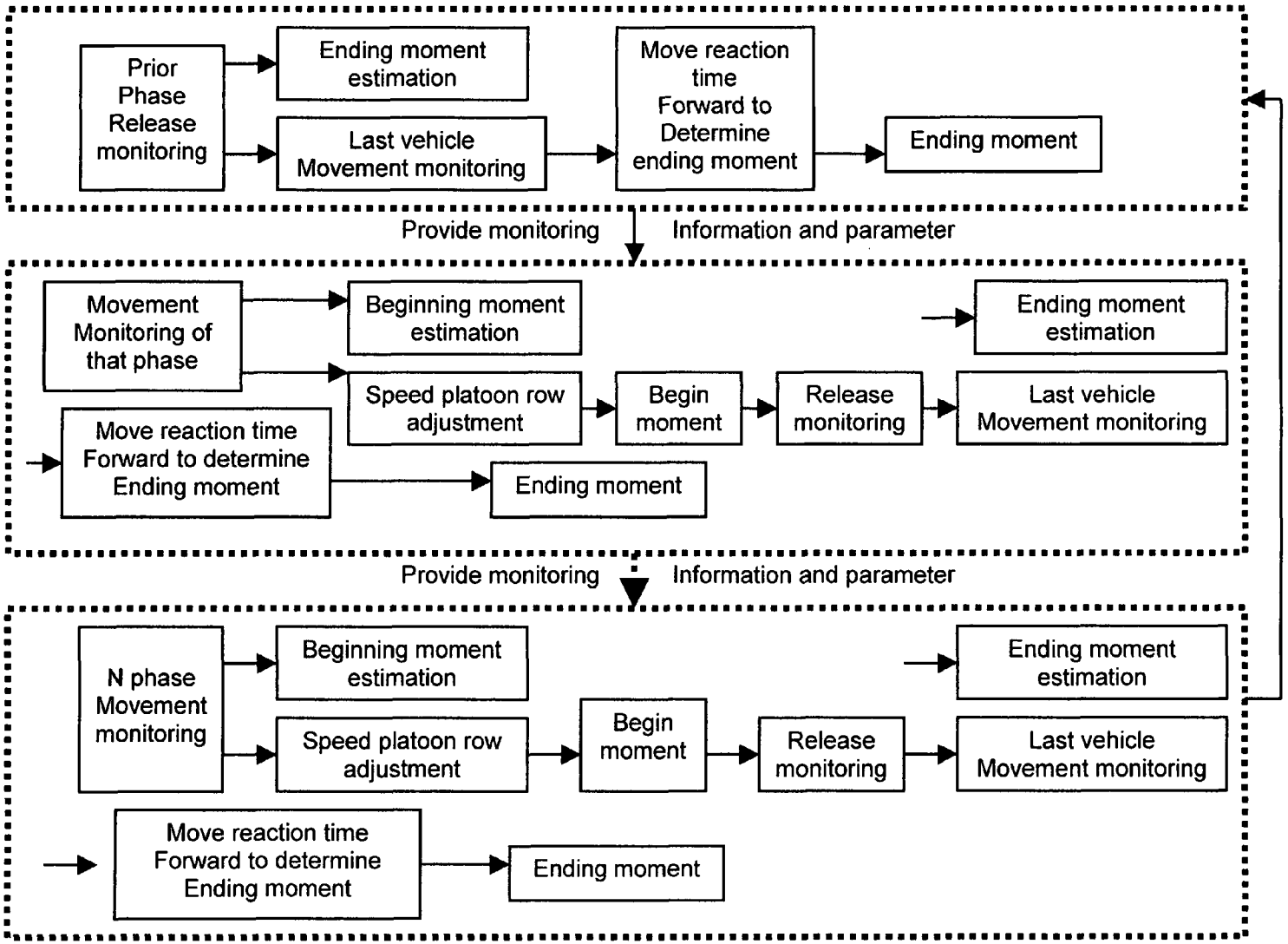
FIG. 54 is a flow diagram of release of dynamic platoon line up.

Referring to east west entrance method, combining the two platoon line up control requirement and platoon line up control process of south north entrance, analyze and calculate the starting time of platoon line up and release of both south north entrances, as shown in FIG. 53. South entrance is not discussed.

The diagram of merge each platoon line up release time order diagram into a combined time order diagram of the entire intersection, not discussed.

For the accuracy of timing, the time order of each lane should be separated, including segmentation method, such that the same can be merged, each time order cycle can also overlap, or can be repeated according to order. When flow volume has a high fluctuation, or receives large effect from upstream signal, timing process and procedure should be adjusted accordingly, such as incoming vehicle flow rate divided into small segments design timing or combined inspection/monitor.

3-2: 3-3: Method C and Method D. Refer to Method A, wherein the theory are the same and are not discussed.

Note 3: Condition under a certain direction (or entrance) fixed area platoon line up control and other direction non-fixed area control, such as the situations as shown in FIG. 46-2, FIG. 53-2, theory is the same. Platoon line up under asymmetrical vehicle lanes (as shown in second lane of FIG. 45), can have information instructing flowing back into lanes (such arrow thickness, wordings), vehicle flow will gradually and automatically flow back into vehicle lanes. Also, phase signal timing can also be alternating cycle of different order.

Referring to FIG. 24, 54, 55, process and procedure of dynamic platoon line up control under moving segment is illustrated.

Signal control can combine fixed area, dynamic platoon line up control model and traffic flow movement model, through vehicle installed and road installed device calculation, display guiding and automatically controlling vehicle movement platoon passage.

1. Release signal: release signal of dynamic platoon line up generally can make use of monitor sensing control, determining vehicle number according to dynamic platoon line up, situations formed by platoon line up and merge and far going situation and the like content, from control model prediction calculation and the release phase time to which it corresponds (the time mainly carries out by methods such as the difference in prediction time that the head and tail vehicle crosses the stop line), beginning time of the phase, using the ending time as standard according to monitor and prediction from previous phase, such that the beginning phase can also be adjusted (bring forward a certain reaction adjustment time monitor and prediction and last vehicle monitor), the phase ending time should be the beginning point of affecting the platoon speed (can be a halt), passage time after platoon shape changes. All phases repeat according to period. Control procedure diagram such as diagram 54 can be chosen.

Fixed period of different time period control model: according to historic information, calculation determines and predetermine a certain release speed, predetermined release phase timing under platoon shape condition (basically is: L largest platoon length/V release speed+amended volume, has design remained volume), then according to this the division movement platoon line up vehicle scope is determined, and through speed guidance, make platoon to approach the passage intersection at a predetermined time. This include application by some (such as perpendicular) phases, traditional control.

Traffic responsive model. According to the traffic reaction made by the input information according to the traffic condition reflected by the front line platoon line up and merging, so as to realize platoon line up and release control of road segment and intersection. Generally, input volume: A: prediction of future platoon line up merging traffic condition: predicting future platoon line up merging and release condition from flow volume and condition data obtained by system inspection device. B: condition of moving platoon: adjust release signal alternation time period using present inspection data with vehicle line moving and line up and spacing situation between vehicle platoon as basis. C: Method matching: through arranging, calculating and prioritizing traffic data obtained by inspection of platoon line up merging and the like and compare with model in data storage, so as to determine the best plan.

Note 4: the above include dynamic platoon line up of a certain direction (or an entrance), and situation of other direction (entrance) non-dynamic platoon line up controls.

Figure 55:
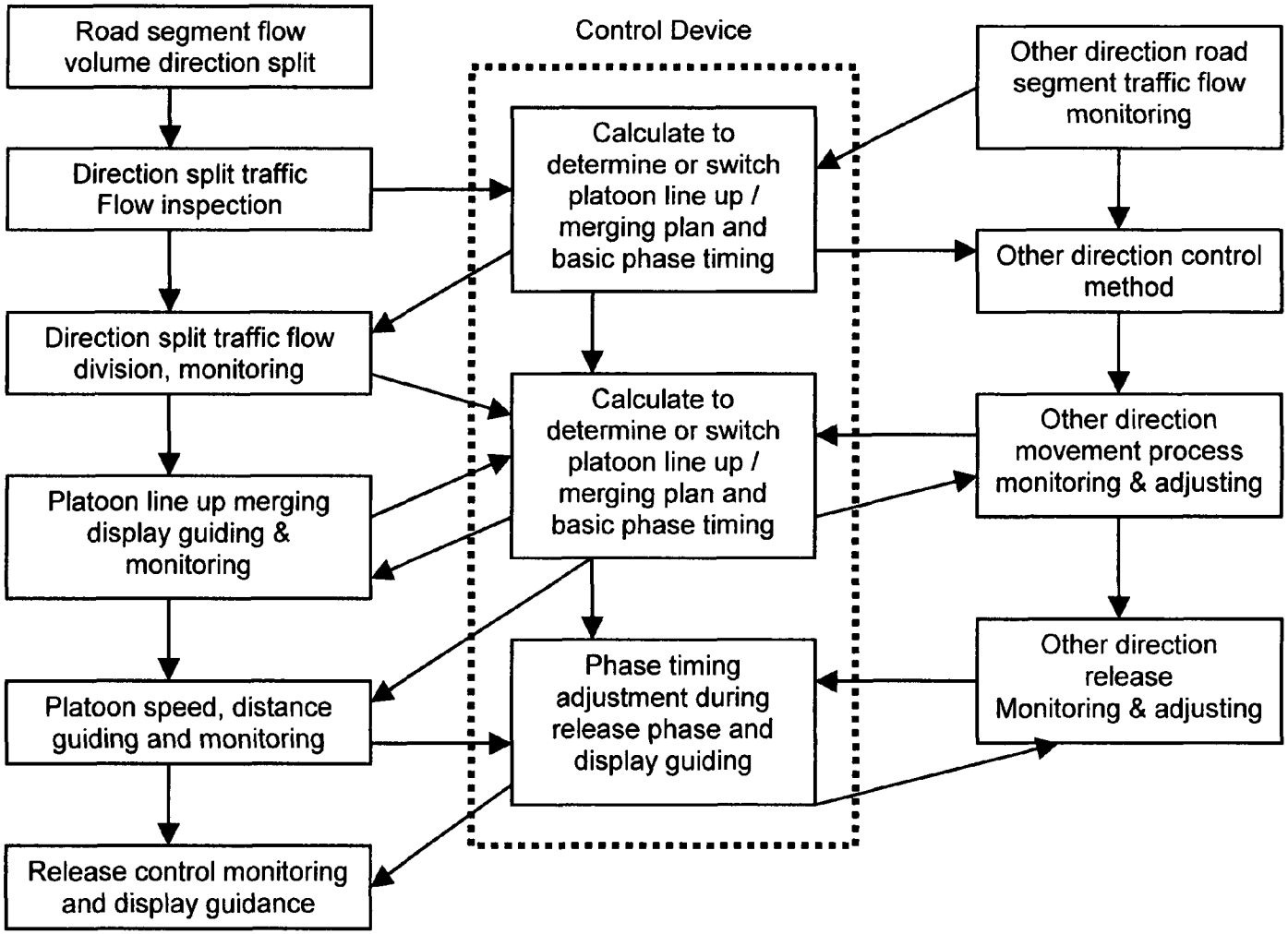
FIG. 55 is a flow diagram of simple platoon line up control of dynamic platoon line up.

2. Platoon line up dynamic control: Moving dynamic platoon line up is difficult to complete with clear signal control display not through vehicles, generally has to be completed through control display and dynamic instruction guidance through vehicle installed, road installed facility. This will involve route navigation, cruise track (identification) guidance, vehicle identification inspection, intra-vehicle position monitor maintenance and communication and so forth. Hence, problems are different from platoon line up timing and so forth problems of fixed area platoon line up. Mainly it is completed with assistance or automatically through central, area, terminal traffic control system and vehicle-installed information receive/transmit display, inspection, calculation, guidance, automatic drive and so forth device. Control of vehicles is carried out according to requirements of moving and platoon line up condition (instruction guidance) at different control stages. As an example, there is an instruction guidance condition of each control condition stage of a left turning vehicle. Such as left turning vehicle within the circle in FIG. 24, went through in order deceleration, lane change, acceleration, speed/distance maintenance, passage and so forth control stages. In addition: road segment movement easy platoon line up control flow diagram is as shown in FIG. 55.

Control flow of platoon line up, release of combined platoon line up.

Combined platoon line up control is the coordinated operation of dynamic platoon line up and two types of control model. Combined platoon line up signal control combine with fixed area and dynamic platoon line up control method. Because of the non-determined nature of the front portion dynamic platoon (complete condition) in combined line up control, release signal control can be calculated to determine according to the completion of condition dynamic platoon line up. Confirmation model of platoon line up (timing) is partially equal to that of dynamic platoon control platoon line up.

Signal control in platoon line up control has other options: 1. Peak flow volume average control according to time, 2. under the allowed conditions that the platoon time scope is allowed by all platoon vehicle flow, platoon line up time should be allow dated according to the total platoon release power of all platoons and all incoming vehicle flow rate of all incoming platoon, or the principle of all platoon flow volume should be proportional, 3. connect or share non-crossing flow direction or phase, 4. platoon line consistent signal control.

Figure 56:
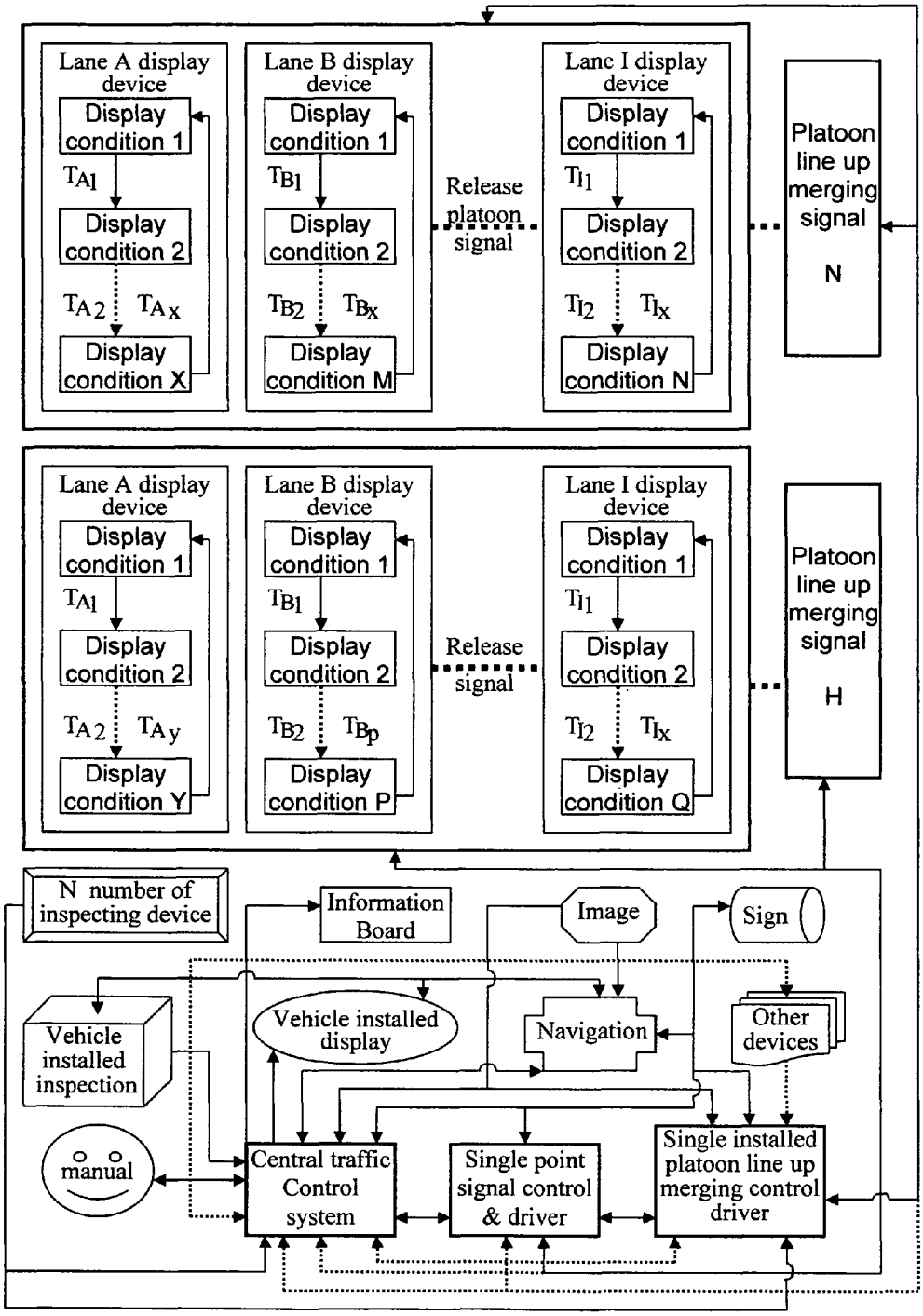
FIG. 56 is a flow diagram of structure and theory of fixed area platoon line up control.
Figure 57A:
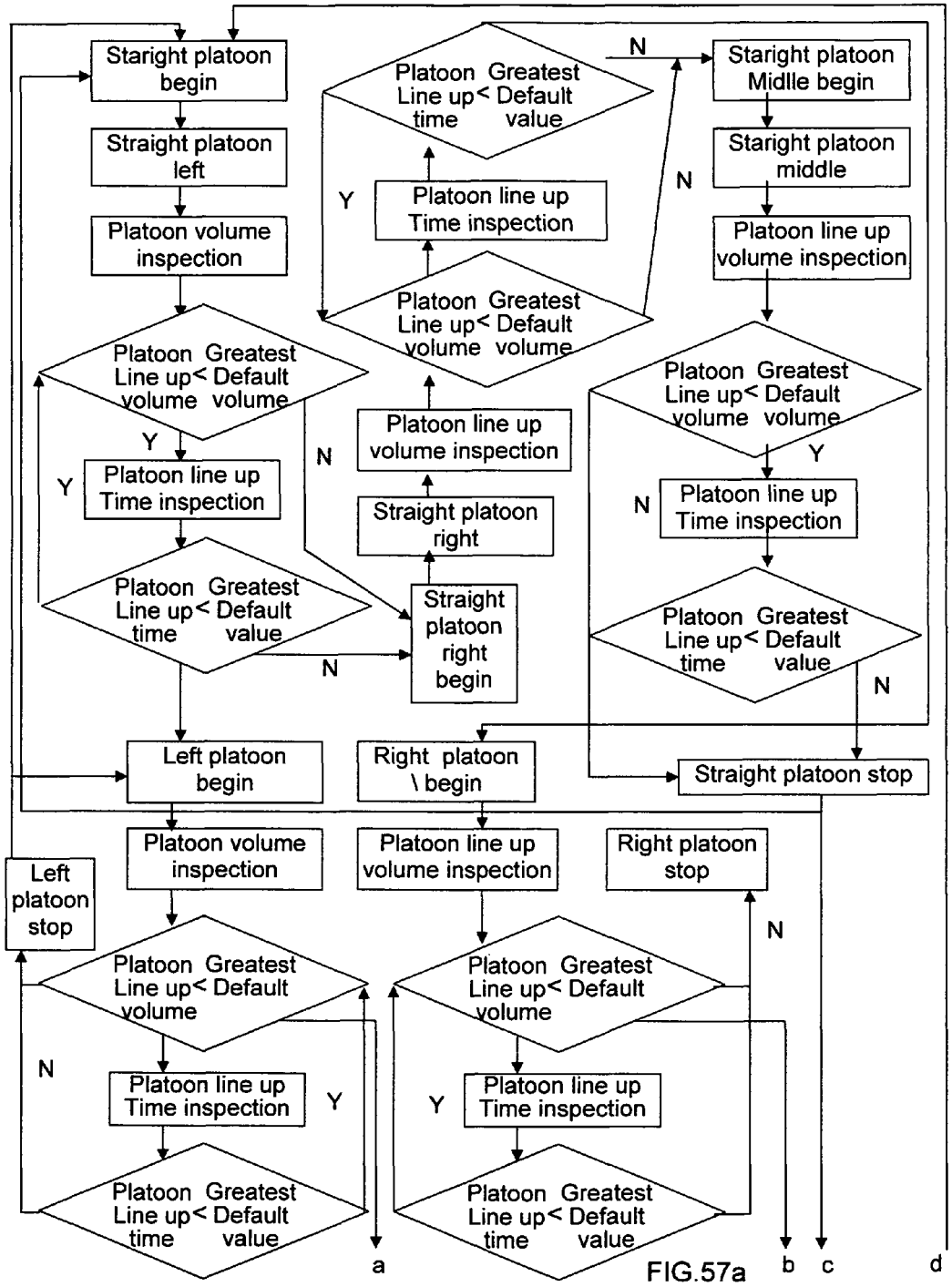
FIG. 57 is a flow diagram of automatic adjustment of fixed area platoon line up control.
Figure 57B:
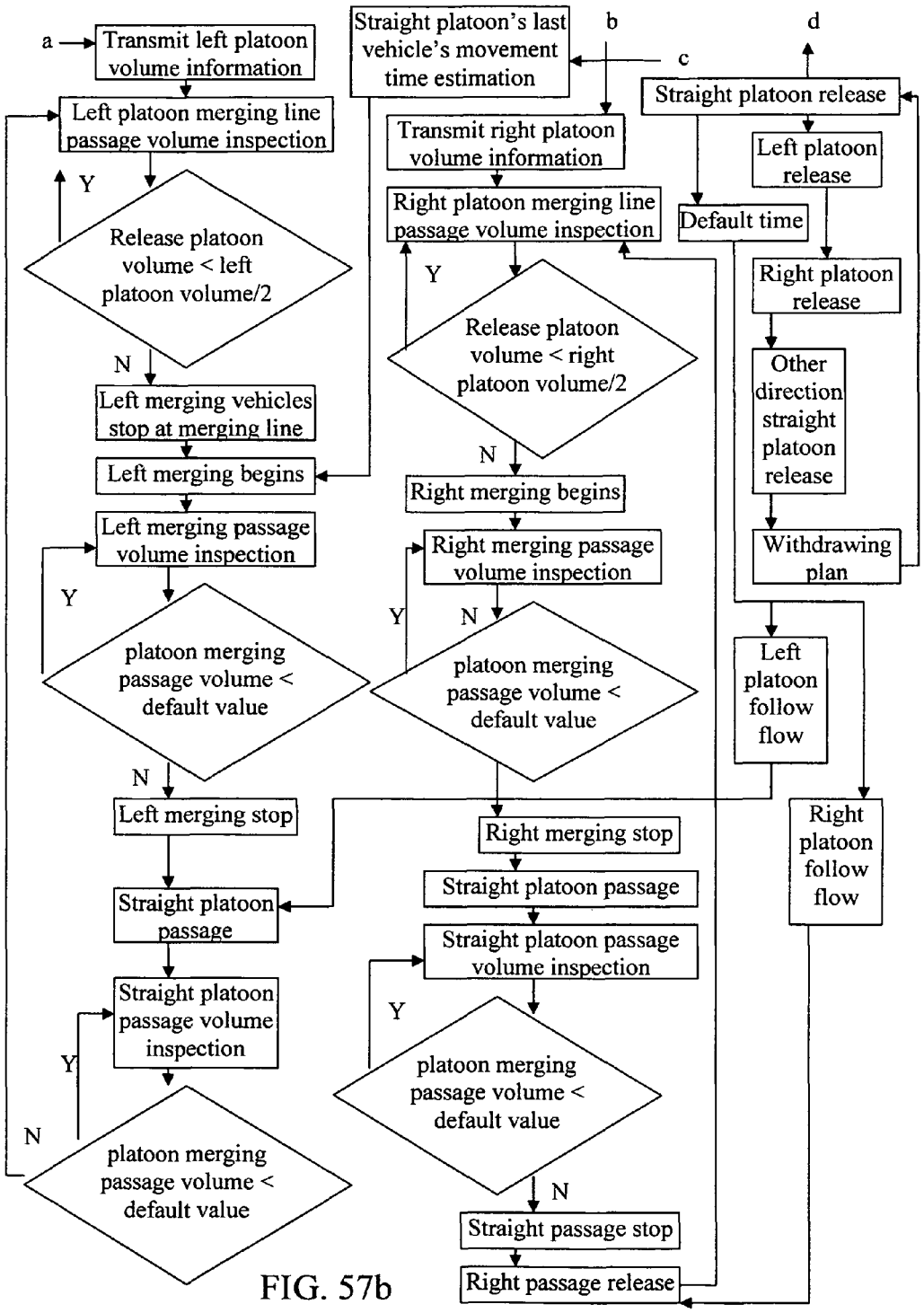
Figure 58:
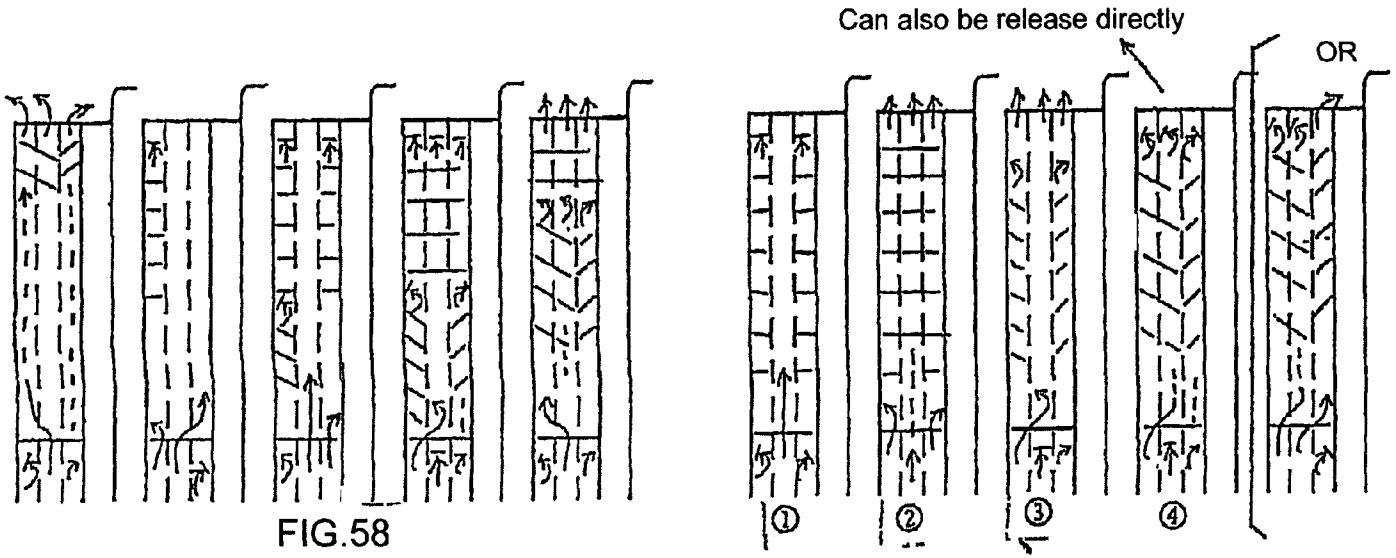
Figure 59:
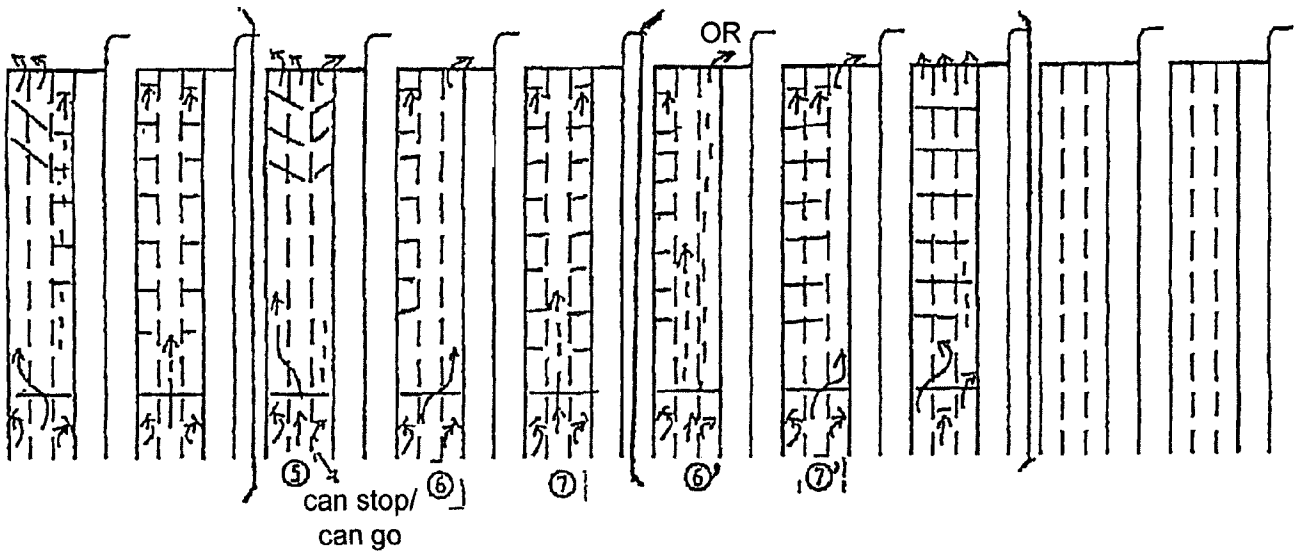
Figure 61:
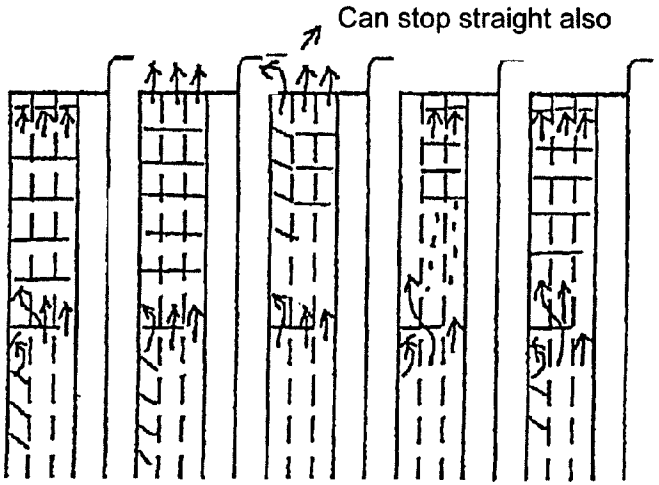

Referring to FIG. 56, structure, theory, flow of platoon line up control system according to fixed area platoon line up as example is illustrated; referring to FIG. 57, automatic adjustment control flow order according to fixed area platoon line as example is illustrated;

Fixed area platoon line up control content is concluded to list the simple structure, theory, work flow diagram, as shown in FIG. 56.

Apart from timing of fixed time period platoon line up control based on change of flow volume investigation data, such as establish automatic responsive control system, application effect and applicability of platoon line up control will be greatly increase, and can reduce many design time left in fixed time period control timing, so as to reduce effectively platoon line up delay time and increase platoon line up release power. Theory and method of determining release and platoon timing in automatic responsive control system is basically same as that of fixed time period control. The difference is the problem of the cooperating and operation of the two sets of signal release and platoon line up. Different intersection, different release and platoon line up plans, different technology condition and requirement determine the difference in operation method of automatic responsive control, as an in the example, using north entrance Method C as an example, its simplified operation flow diagram has been drawn, as shown in FIG. 57 (out side the pre-stop line, merging line of left-turning vehicle lane, and the splitting line of the right turning lane, vehicle automatic inspection sensing devices should be installed, to coordinate control through the increase in control facilities specifically for platoon line up control or existing computer intelligence system).

Coordination problem with non-motorized vehicles.

Because the right turning of non-motorized vehicles will not affect other traffic flow, it will not be mentioned (and, in order for non-motorized vehicle to turn right smoothly, area along turning angle portion of the road can be changed into slope, allowing a smooth passage of right turning non-motorized vehicles, which already has existing application examples). When there are specified lanes and phase for left turning and straight going non-motorized vehicle, it can directly release according to release lane and phase, control method such as left-turning area to wait for two times during mixed traffic. When first platoon is in mixed traffic of all direction but not the straight going and non-motorized vehicle, straight going motorized vehicle then uses vehicle method such as waiting for two times. Also, under the condition allowed by the width of non-motorized vehicle lane, non-motorized vehicle platoon line up control can also be used.

If there are no non-motorized vehicles issue in this control method, the difficulties in platoon line up control is greatly reduced.

Supplemental description: in order to fully express the technology, platoon control method examples are increased here: as shown in FIG. 58-71.

Such as increase the simplification of platoon line up, one-at-a-time or a plurality of platoon line up, continuous or non-continuous platoon line up release, borrowing opposite direction non-motorized vehicle lane/vehicle lane and the like control example diagram. Different platoon line up, release control, device facility, timing model, control procedure and so forth all need corresponding adjustment (as shown in FIG. 71-1/2, the timing control of when left turning vehicles pass through opposite lane should also take the traffic flow condition of the opposite lane into consideration, should choose as much as possible when opposite traffic flow has a low density, little vehicles or no vehicle time period, it also involves the problem of the time of borrowing lane for driving; such as the time gaping phase as shown in FIG. 60, and timing of the time gaping period of platoon line up and release and so forth situation of a certain direction, should also take unifying the timing of platoon line up and release of corresponding platoon of crossing direction into design consideration; FIG. 71-2 shows the example of the situation of borrowing opposite vehicle lane under in order or crossing overlapping release of each cross-section. FIG. 71-3 illustrates the example of borrowing opposite lane for U-turning, which is suitable for U-turning after passing the prohibited area then turn right to realize left turning situation, where U-turning can be provided at multi-entrance or realized at intersection, such as U-turning lane release alternately with straight going. Borrowing opposite vehicle lane can also cooperate with assisted lane as illustrated by dashed line), but the basic theory is the same. Also, borrowing opposite direction vehicle lane can apply signal control, monitoring device and other line markings facilities and so forth on exit vehicle lane. When the right turning vehicle does not line up platoon, when platoon line up vehicle lanes are asymmetrical, can push the right turning vehicles backwards to join in platoon line up, to form symmetrical platoon line up as much as possible (this is also one of the maximizing theory of platoon line up control), such as four vehicle lanes situation of left turning, straight going, straight going, right turning, of course, it should be taken into consideration the vehicle lane distribution requirements by flow volume, which can be realized by accommodating amendment to intersection.

Note 5: Platoon control model can be proven and describe by of line up theory and wave movement theory and so forth traffic flow theory, real observation and simulation both proves the actual practicality of vehicle flow platoon control movement, and preliminarily accumulated related basic parameters. Representation format, parameter changing rate and coefficient determination of related mathematical formulas, prediction model and calculation in this writing, can carry out amendment according to different needs, actual condition and application result (such as average vehicle head stopping distance, release vehicle head average distance, evacuation wave transmission average speed, acceleration and speed balancing and so forth). Also, options in claims and specification in general are contents of optional examples.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A traffic control method, comprising the steps of:

(a) providing a road or vehicle installed platoon line up release control device, and assisting platoon control related devices which include traffic signs, markings, isolation facilities, and passage device facilities;

(b) providing guidance instruction to control directions of at least partial vehicle flow of vehicles in one or more intersections and road segments;

(c) using a control method of simultaneous platoon line up as well as one-at-a-time platoon line up within at least a period of time for vehicle flows including multi-directional multi-lane vehicle flow, multi-segment vehicle flow and multi-point vehicle flow, according to a predetermined or automatic sensing adjustment procedure, wherein said control method is classified as three types, namely a dynamic platoon line up at said road segment, a fixed area platoon line up which provides platoon line up area at said intersection and said road segment, and a combined platoon line up combining said dynamic platoon line up and said fixed area platoon line up, wherein said platoon includes all distribution forms of vehicle line;

(d) forming a plurality of orderly platoon lines, each of which has a variable platoon shape, platoon order, platoon volume, and platoon speed, so as to achieve a platoon line up passage selected from a group consisting of a vehicle flow non-continuous platoon line up passage and a vehicle flow continuous platoon line up passage with a little or no crossing multi-lane;

(e) providing a passage at said intersection and said road segment under one of the situations of having no passage instruction guidance signal control and no automatic control, after a formation of control of said vehicle flow continuous platoon line up passage or said vehicle flow non-continuous platoon line up passage, or a control of platoon line up; after said formation of said vehicle flow continuous platoon line up passage, providing a plurality of control options, including:

(i) a same phase passage of two predetermined directions vehicle flow of the same cross-section to form a continuous platoon line up passage;

(ii) a cycle release using continuous platoon order of left turning, straight going and right turning, or right turning, straight going and left turning;

(iii) a platoon order in one direction of continuous passage of straight going, left turning/right turning, and right turning/left turning, and another direction of continuous passage of right turning/left turning, left turning/right turning and straight going; and (iv) a continuous platoon line up passage control of excessive passage or borrowing phase for passage, under irregular intersection situations including T-shape and multi-crossing, other than said control options (i), (ii) and (iii);

(f) forming control of said simultaneous platoon line up as well as said one-at-a-time platoon line up within at least a period of time for said multi-directional multi-lane vehicle flow, said multi-segment vehicle flow and said multi-point vehicle flow, wherein options for forming control of said simultaneous platoon line up within at least a period of time for said multi-directional multi-lane vehicle flow, said multi-segment vehicle flow and said multi-point vehicle flow are provided, wherein said options include cross-position/cross-platoon area platoon line up, platoon merging, borrowed lane platoon line up, follow flow platoon line up, and combined/mixed platoon line up, wherein said options are capable of being used in combination;

wherein said cross-position/cross-platoon area platoon line up is adapted for controlling guiding speed, direction, distance, position, order, and condition of vehicle flow, and controlling distribution of platoon area, platoon passage way, platoon beginning and ending points, and splitting and flow merging control points, so as to divide passage way and space required by said cross-position/cross-platoon area platoon line up to form a control procedure of said simultaneous platoon line up as well as said one-at-a-time platoon line up within at least a period of time for vehicle flows including said multi-directional multi-lane vehicle flow, said multi-segment vehicle flow and said multi-point vehicle flow;

wherein said merging platoon is adapted to form a control procedure of a certain columns and segments of portion of vehicle flow replacement and merging platoon line in dynamic or static area or in a moving platoon line, wherein said control procedure includes a chain-type shifting control and a one-vehicle-at-a-time passage type control for merge platoon in different segments as well as merge platoon in order;

wherein said borrowed lane platoon line up is adapted to form a control procedure of partial space platoon line up of vehicle flow borrowing opposite lanes or lanes for other types of vehicles;

wherein said position replacement and follow flow platoon line up is adapted to form a control procedure of position replacement of following vehicle flow following a platoon order in front, and following traffic platoon;

wherein said combined/mixing platoon line up is adapted to form a control procedure of platoon line up carried out under conditions of vehicle flow in combined or mixed direction, platoon line and order;

wherein said one-at-a-time platoon line up is adapted for controlling each vehicle flow of each split direction or each vehicle flow of each lane one-direction-at-a-time or one-vehicle-at-a-time taking turn to carry out platoon line up in platoon line up area or while a vehicle line is moving; and (g) providing a platoon line up control for a Vehicle x of a predetermined direction or lane of a predetermined cross section, segment or defined point, comprising the control steps of:

(y1) carrying out instruction guiding control and assisting/automatic control of a plurality of control options including direction, splitting direction, merging direction, speed, distance, position, order, lane adjustment, condition, and information;

(y2) carrying out instruction guiding control and assisting/automatic control of a plurality of control options including direction, splitting direction, merging direction, control point of splitting/merging flow, speed, distance, position, order, lane, lane adjustment, condition, and information, for controlling vehicle entering platoon line up area or a position in or out of a moving vehicle line; and (y2+n) carrying out instruction guiding control and assisting/automatic control of a plurality of control options including direction, splitting direction, merging direction, control point of splitting/merging flow, speed, distance, position, order, lane adjustment, condition, and information, for controlling vehicle entering platoon line up area or a position in or out of a moving vehicle line, where n is a whole number $\geqq 0$, the step (y2+n) is after 0 or a predetermined number of steps;

wherein the steps (y1) and (y2), or the steps (y2) and (y2+n) are capable of repeating once or multiple times, wherein vehicle platoon line up control procedure of other directions, lanes or segments is the same as the above steps (y1), (y2), and (y2+n);

wherein during said control of said simultaneous platoon line up for said multi-directional multi-lane vehicle flow, multi-segment vehicle flow, or multi-point vehicle flow, the steps of said vehicle platoon line up control cycling in all directions, all lanes, all segments, or all points overlap in at least one time period; wherein during said control of said one-at-a-time platoon line up, the steps of said vehicle platoon line up control are repeated in order, wherein platoon line up and merging control has options in order; and wherein after said platoon line up control, when there is said instruction guiding control or said assisting/automatic control, increase the control steps accordingly; when there is no said instruction guiding control or said assisting/automatic control, there is no control step.

2. The method, as recited in claim 1, wherein said platoon line up control is used correspondingly at each of said intersections and said road segments, each entrance, cross-section, lane and flow direction of each of said intersections and said road segments; wherein said method is adapted to apply for at least two lanes of containing non-motorized vehicle on said intersection or road segment, all types of phase control method, left and right handed and single flow traffic, irregular interaction, single direction intersection, platoon line up release area shift to upstream, borrowing opposite vehicle lane, non-motorized vehicle lane, portion intersection space, highway, roundabouts, ramps, neighboring intersection that is not able to be closed, temporary platoon line up, excessive or insufficient flow direction, vehicle platoon, phase, right turning continuous passage, and borrowed phase passage;

wherein, for irregular, single flow intersection, according to structure, flow volume and flow direction situation of said irregular, single flow intersection, said method further comprises platoon line up control options, including borrowing non-motorized vehicle lane control, borrowing opposite vehicle lane control, roundabout platoon line up control, temporary platoon line up control, using partial intersection space outside of vehicle stopping lane for platoon line up release control, using platoon line up control with public transport specific use lane and public transport priority plan, and unable shutting down neighboring intersection control;

wherein said borrowing non-motorized vehicle lane control is adapted to control one or more motorized vehicles to borrow a segment of non-motorized vehicle lane fixed area or movement dynamic platoon after controlling non-motorized vehicle stopping position or portion of vehicle flow in road segment crossed to upstream, wherein when releasing a particular platoon or a particular phase, or within a time period or after a time period, non-motorized vehicle is allow to follow a flow of said motorized vehicles;

wherein said borrowing opposite vehicle lane control is adapted to automatically control vehicle flow of a predetermined direction, vehicle lane, segment, or point according to a default or sensor control guidance signal under a situation of providing no isolation devices, having an opening or utilizing an intersection in front;

wherein said roundabout platoon line up control is adapted to provide platoon line up control device and platoon line up area as well as signs, markings and facilities thereof so as to control and guide yielding and speed guidance of vehicle flow at entrance or roundabout;

wherein said temporary platoon line up control is adapted to control and guide a speed of upstream incoming vehicle or to temporary block incoming vehicles from immediate direction by means of an inspection real-time control or a fixed time period control when a predetermined lane has comparatively small number of incoming vehicles or has no incoming vehicle, or there is a temporary need;

wherein said using partial intersection space outside of vehicle stopping lane for platoon line up release control is adapted for platoon line up release; and wherein said unable shutting down neighboring intersection control is adapted to extend platoon area scope and to adjust or increase control device and process procedure involving corresponding release, and platoon line up.

3. The method, as recited in claim 1, further comprising a plurality of platoon rows balancing control options for controlling of making all platoon rows neat, lengths of said platoon rows in balance or synchronizing passage times, wherein in order to balance platoon rows from a single entrance and different entrances and a distribution of release volume of platoon passage, said platoon rows balancing control options include a balancing control of platoon length of static and dynamic movement, a speed guiding balance, a position replacement follow flow and continuous green light phase, a control of balancing of division of flow volume and timing, a platoon row grouping, and a combination of the above control options;

wherein said balancing control of platoon length of static and dynamic movement is adapted to calculate and preset signal control time of each platoon lining up according to follow volume and traffic model, or through real-time monitoring and to calculate an accumulated platoon length of vehicles entering each said platoon row, so as to carry out comparison with preset parameter and procedure and guide vehicles to enter shorter rows of said platoon rows;

wherein said speed guiding balance is adapted to control a balance of a final release time of each said platoon row through speed guidance, that is by inspecting/monitoring of variation of speed, line up release movement speed or length platoon of all said platoon rows, especially a last vehicle evacuation through calculation and adjustment of procedures;

wherein said position replacement follow flow and continuous green light phase is adapted for using a plurality of continuous platoons as a whole and using control of position replacement follow flow and continuous green light phase;

wherein said control of balancing of division of flow volume and timing is adapted to control excessive flow volume in road segment and to match with a next period flow volume by means of a moving or stopped vehicle platoon line up way when there is a large number of incoming vehicles in a particular platoon of said platoon rows or in a particular direction during a particular period of time and there is a need to control balancing division of flow volume or sign time; and wherein said platoon row grouping is adapted to reasonably group platoon line up for platoon balancing.

4. The method, as recited in claim 1, further comprising control options of first splitting direction then lining up platoon, mixed platoon line up, cross phase platoon line up for dynamic platoon in a road segment with movement;

wherein said method further comprises the following control options of using road surface cut-off and division of time period with reference to a number of vehicles or grouping division to determine a scope of platoon division of vehicle flow with reference to vehicle flow density:

(A) when a flow volume of a particular point reaches a predetermined value is inspected, determining a last vehicle separation and carrying out a control guidance to form a gap in a vehicle flow by a control system;

(B) inspecting said vehicle flow with obvious density difference by two or more inspection/monitor device to determine a last vehicle and carrying out a separate speed and separate distance control;

(C) combining the above control options (A) and (B), wherein when a particular number of vehicles is monitored, a following vehicle flow is appropriately received in such a manner that when there is gaping, divisional speed is to be determined, while the following vehicle flow has a higher vehicle flow and a size of the vehicle flow is acceptable; wherein when divisions using denser groups are smaller, portion of said vehicle flow from following is received while monitoring and controlling an amount thereof; and wherein when a fixed area platoon line up and a road segment dynamic platoon line up control are carried out alternately, control a splitting direction and operation of road segment platoon rows until a predetermined condition is reached and then control said fixed area platoon line up, and, alternatively, complete said road segment movement platoon line up control to a predetermined control step and then complete the remaining control steps while entering a platoon line up area.

5. The method, as recited in claim 1, including a platoon line up and passage control model and a mechanical or electrical control process and computerized prediction, simulation and control process, wherein said method further comprises a plurality of controls, including a control of yielding to a longest vehicle by dividing a vehicle space at an end of platoon or providing an inspection/monitor device to carry out inspecting/monitoring and using a signal device to display;

a control of avoiding signal display from being blocked by providing multi-position or mobile display or vehicle-installed display control of a display device installed at upper and side on road, ground and guiding rail, and separation facility device;

a control or design of blocking prevention of vehicle lane/safety lane change area, including a control of prohibiting stop of vehicle flow in said safety lane change area, and a changing of guiding area or pre-stop line to continue a line up platoon before a possible blocking in said safety lane change area, as well as using a replacement position of last vehicles while said safety lane change area is at a tail of a platoon line up, by means of signal and information instruction/reminder or control, inspection/monitoring, signal control design or platoon length reminder design, or platoon row platoon shape adjustment;

a vehicle lane control of vehicle lane splitting direction adjustment and accommodation;

a heavy flow lane instruction control;

a prediction and simulation control;

a priority of public transport, incidence inspection/monitoring, exhaust estimation control;

a cooperation control of mechanical and non-mechanical and control of non-motorized vehicles to pass in split direction or pass in said platoon line up, or combining two waiting times control; and an alternating between a regular control and a platoon line up control, having options of using partial vehicle flow follow flow pressuring complete release of a full read complete release method, or preset flow cut-off or speed reduction control, carrying out alternation at a particular platoon control cycle point or time period, and controlling vehicle lane adjustment, controlling of corresponding changes in said platoon line up with variable markings, signs and signal, and designing backup electricity source and control of signal transition to regular or manual condition.

6. The method, as recited in claim 1, wherein said fixed area platoon line up control is a control selected from a group consisting of:

(a) vehicle flow entering platoon area in order, that is lining up in order from front to back;

(b) platoon lane order being in an order of from farthest other lanes to an immediate lane line up where other alternations and adjustment are able to be carried out anytime;

(c) position replacement follow flow:

(d) split direction and platoon at far position, wherein splitting direction or different direction platoon line up is carried out as early as possible before vehicle flow approaching platoon area and when entering platoon area for platoon line up, so as to ensure row formation of early direction split or a reasonable far position direction split platoon curve;

(e) large vehicles having priority to use said immediate lane and neighboring lanes;

(f) complete release, wherein all vehicles are not allowed to stop in platoon line passage and affect normal platoon passage, wherein vehicles that are unable to be complete released in a corresponding phase are controlled to be released as much as possible in a following phase, wherein said complete release is performed by a way selected from a group consisting of displaying instruction by signals with diagram or wordings; pre-designing time remaining signal, late initiation and early cut-off or early initiation and late cut off, continuous phase/ripple change; adjusting platoon line up and release signal according to platoon release condition monitored by installed inspection/monitoring devices; and combining signal remote control and management;

(g) borrowing phase, wherein vehicle flow is controlled by making use of other phase for passage in a particular direction or a particular platoon row or a particular segment; and (h) emergency control, wherein when a vehicle lane is blocked due to incomplete release of vehicles, or by a blocking vehicle being malfunction or having accidents, one of the following emergency controls is initiated, including closing off said blocked vehicle lane temporarily through inspection/monitoring automatic adjustment, remote controlling or manual controlling signal instruction and carrying out control adjustment of platoon line up and releasing of other phase at the same time, wherein until said blocking vehicle is removed, said vehicle lane is resumed or changing directly to regular control;

wherein, besides referencing to said fixed area platoon line up control, a dynamic platoon line up control of road segment with movement further comprises the following control options:

(a1) speed, distance maintenance and guidance instruction, vehicle moving with reference to the speed, vehicle distance instruction and information provided by said platoon line up control, forming platoon row through automatic inspection maintenance technology or visual inspection identification;

(b1) grouping and teaming up as much as possible;

(c1) lane changing signaling and opportunity theory, other than obeying control guidance instruction, vehicle providing movement signal before changing lane ahead of time and moving forward under a right opportunity;

(d1) follow flow and dynamic platoon having a chain effect, maintaining following vehicle ahead as much as possible, which is applicable to both before and after direction splitting;

(e1) splitting direction ahead of time, such that direction splitting is completed ahead of time as much as possible before a farther road segment or at an earlier intersection;

(f1) maintaining position, wherein when a particular vehicle is on a position where said vehicle should line up, said vehicle should keep a position thereof as much as possible during platoon control;

(g1) moving cross position platoon line up; and (h1) guiding to reduce vehicle stopping, mainly performed by controlling speed and arrival time;

wherein, besides referencing to said fixed area and dynamic platoon line up controls, a combined platoon line up control comprises the following control options:

(a2) said fixed area platoon control having priority that when vehicle platoon approaches guidance area and platoon area, no matter which platoon condition is in, following said fixed platoon area control, even though controls of front and end are not consistent; and (b2) safe speed changing, wherein during condition alternation in said platoon line up, safe speed reduction or vehicle stopping must be controlled.

7. The method, as recited in claim 1, wherein fixed time, sensing, automatic adjustment, traffic response and intelligence control methods are used, which include combining or establishing all types of platoon control of green wave, late-initiation and early cut-off or early-initiation and late cut off, partial or all dynamic and combined platoon green wave, and releasing options of control of platoon control signal adjusting; wherein methods of platoon control signal timing and determining procedure parameters include:

(A) fixed area platoon control signal timing being arranged to determine platoon line up timing after a determination of release timing, and alternatively to determine release timing after a determination of platoon line up timing, chain action adjustment prioritizing, predicting and determining a method, releasing control having expanded or amended traditional control model or platoon control model timing according to parameter, platoon control being according to platoon control model timing, cooperation of release and platoon line up signal timing being determined according to control requirement, determining platoon line up of corresponding platoon, row, releasing timing cycle beginning time having a difference of X, under a condition of minimizing delay, taking a middle value between conservative high efficiency model and ideal high efficiency model, choosing formula:

$X=K\{(T\ period-T\ evacuation)+[T\ period-(G-T\ moving)]\}$, wherein $K=\frac{1}{2}$ or other predetermined value and G is total phase time of corresponding cross section;

wherein when there is no straight delay requirement, X is able to exceed a scope of a regular high efficiency model; and wherein all lanes are capable of lining up in time order separately, including a separate segment way, wherein the same one is arranged to be merged and all time order cycles are able to be overlapped and repeated in order;

(B) road segment with movement dynamic platoon control, wherein signal control combines fixed area, dynamic platoon control model and moving vehicle model, wherein through calculation, display guidance or automatic control of vehicle installed or road installed device control vehicle movement platoon passage; and (C) combined platoon line up signal control combining the above (A) and (B); wherein said signal control comprises:

(1) time division consistent control of peak flow volume;

(2) under a condition allowed by vehicle flow allowing platoon line up time scope, platoon line up time is distributed according to a theory of consistent proportion of a total platoon line up release ability of all platoon line ups and incoming vehicle flow rate of all platoons or volume of all platoons;

(3) connecting and sharing flow direction and phase without crossing: and (4) consistent signal control of platoon row.

8. The method, as recited in claim 1, further comprising at least a road-installed or vehicle installed mechanical or non-mechanical item of platoon passage control treatment device, a platoon line up and passage instruction guiding control device or control execution device, and related signs, markings, isolation facility, and a device selected from a group consisting of inspection/monitor, information display identification, vehicle position inspection maintenance, drive control, wherein device facilities are installed according to platoon control requirement, including using in combination with regular device facility, wherein there are functions or procedure for carrying out said platoon line up control, including new use of regular device facility, new connection or improvement model, functional parts of functional modules, and combination thereof; wherein at least an installation format, or function, or instruction or theory or flow, or merge of part of said device facility is different from a conventional traffic control device facility, wherein mechanical or non-mechanical devices are installed in single or in combination; wherein fixed area, dynamic and combined platoon line up control is controlled by road-installed and vehicle-installed devices, wherein said road-installed and vehicle installed devices are able to be combined so that all said road-installed and vehicle-installed devices are used in a combined manner flexibly, wherein vehicle-installed or road-installed platoon line up is able to be used, wherein less use or not use of some of said road-installed or vehicle-installed devices is required, including single vehicle platoon release control treatment facility; wherein an individual vehicle facility carries out a platoon line up/release control according to calculation and treatment related to line up/release information and multi-vehicle platoon line up control treatment facility; wherein vehicles at opposite point, line, surface according to related unify calculation treatment of said line up/release information to carry out said multi-vehicle platoon line up/release control, and other devices in vehicles used for said platoon line up control; wherein said method further comprises a plurality of simple matching options, including splitting direction, distance identifying markings, inspection/monitor device to inspect flow volume of different directions, control device calculates, treats and emits on platoon line up information board to display platoon line up guiding information and instruction containing direction, speed, vehicle distances, platoon line up condition shape, and cross-position method and acceleration/deceleration, so as to perform movement dynamic platoon line up.

9. The method, as recited in claim 1, wherein platoon line up control treatment and driver device are arranged to be one unit or multiple units which are capable of being installed independently or in combination with other devices to form an independent device, specific use device, combined type device, or central control treatment system; wherein a plurality of functions, including platoon line up passage control simulation, prediction, optimization, and intelligent, is achieved, including platoon line up passage control system and other intelligent traffic systems, including automatic adjustment, intelligent, professional, fuzzy, nervous and all types of control model applicable to traffic control; wherein besides having regular function and platoon line up control process/timing function, a platoon line up control treatment device has release control process/timing, platoon line up and release signal device and other display guidance devices, which is an electrical or mechanical device of electro-optical signal pixel board in non-conventional signal "light" form; wherein a detachable connecting type device includes display guiding device combined by platoon line up/information controlling device and platoon/information diagram/words producing device and other regular device/part; wherein a group or a plurality of groups, installed independently or in combination with other devices, has display format of direction, platoon passage and control condition, information diagram and wordings, and has multiple control display options of direction splitting, direction merging, lane markings and adjustment, platoon and passage instruction guidance, speed guidance, condition and information, and mechanical and non-mechanical control, wherein direction display includes multiple forms including one direction, multi-direction, crossing direction, splitting direction, merging direction, conditions including conditions options of platoon row immediate platoon line up/merging, space situation, moving situation, changes in observe positions including an vehicles or road segment, guidance area, platoon area, immediate direction or entrance of opposite direction, center of intersection, being arranged to be installed on easy to observe positions including vehicles or road segment, guidance area, platoon area, immediate direction or entrance of opposite direction, center of intersection, being arranged to be installed according to each lanes or a particular lanes; wherein said device is selected from a group consisting of:

(A) inspection/monitor/examination device having direction, speed, vehicle types, platoon rows, platoon shape, position, occupied frequency, complete release, line up/release condition examination/monitor/inspection options, wherein said inspection/monitor/examination device is able to be all types of device or improvements of closed-circuit type or ultrasound wave type vehicle sensors, infrared, laser, microwave, optical-electrical tube, visual frequency inspection, signs, electrical tag, including dispersed light/microwave blockage inspection device, underground or above ground installed signal emitter and receiver, inspect situations of signal being cut off by vehicles, and platoon line up fixed point inspection that inspection devices are only installed in predetermined points, including guiding area, lane change area, last vehicle positions in platoon;

(B) platoon line up information display guiding device, including display technology and device, "flat display", including vehicle installed audio frequency activation, inside or outside vehicle turning signal activation guiding device;

(C) communication system, wired or wireless, road to vehicle communication or vehicle to vehicle all position communication, including an application of Code Division Multiple Access (CDMA) technology and facility; and (D) sign, platoon line up positioning, navigation, cruise track guidance identification, including vehicle position inspection maintenance of platoon shape/vehicle distances, realizing speed reduction, braking, change of direction, change of lane, driving control device of display platoon line up control, regulation violation imaging, central line shifting device, full angle inspection, far position direction split device through external information received by sensors of one or both vehicle-installed or road-installed devices, wherein signs, line marking, device, facility include forms including magnetic nail, electric cable and sign band which are identifiable by using device facility sensing, which is arranged to be installed at isolation area, isolation barrier, ground surface, outside of vehicle stopping line, being fixed or mobile type or transmit device display; wherein format and content of said device facility display are words and diagram, including color, shape, content, condition, fixed or variable position, in platoon and passage condition control flow diagram example and display diagram example or diagram example from said method, control alternation being manual or automatic, both dynamic and static condition being applicable, and also including audio and non-conventional display format; said device has shapeless or shaped platoon area/line, guiding area/line, safety lane change area/line, direction guiding area/line, position shifting area/line, formats of installation of related signs, line markings facility and sign display being fixed and vary, wherein in fixed area control, using original stop line of an intersection as ending line and extending backwardly according to need, dividing into several platoon area, where each said platoon area is parallel or separated, being connected in order along road segment, able to cross, overlap or alternated, able to divide with cross position; wherein end portion of platoon area extends towards upstream direction as guiding area or pre-stop line, and being divided with cross-position; wherein if there is no guiding area or pre-stop line, display and control are carried out using instruction/display sign of guiding platoon, signal, information device; shapeless or shaped platoon area/line and other said area/line of roundabout and borrowing opposite direction motorized and non-motorized vehicle being set on roundabout lane, borrowed lane and position close to intersection, borrowing point of road segment, and position of covering lane that crosses to opposite direction lane, including variable line marking or variable display of instruction display device; wherein mobile type or transmission display type variable platoon area and guiding area or pre-stop line is selected from a group consisting of ground surface or underground light emissive, reflective facility of mobile or transmission display, light receiving or light emissive material line markings that is able to reflect light day or night or emits light and easy to identify, projection moveable lighting device; wherein platoon length design is a greatest or appropriate vehicle row length of all direction vehicle flow of all time period that correspond to all platoon area in control plan, especially that allowed during peak period and lane change safe distance when necessary, or determined according to control requirement and road and safety condition, wherein lane change safety distance is calculated by a characteristic of passage with a turning requirement of a largest type of vehicle and motorized vehicle movement orbit, at the same time position of safe vehicle distance or lane change area/line has to be determined reasonably according to flow volume and control method, including options provided at platoon line up, merging passage and starting point, wherein content of dynamic platoon control is shapeless, dynamic and variable.

* * * * *

UNITED STATES PATENT AND TRADEMARK OFFICE

CERTIFICATE OF CORRECTION

PATENT NO. : 7,860,639 B2
APPLICATION NO. : 10/547055
DATED : December 28, 2010
INVENTOR(S) : Yang It is certified that error appears in the above-identified patent and that said Letters Patent is hereby corrected as shown below:

On the title page of the patent,

In item (73) Assignee, "Shaoping YANG" should read --Shaopeng YANG--.

Signed and Sealed this
Twenty-sixth Day of April, 2011

David J. Kappos

David J. Kappos
*Director of the United States Patent and Trademark Office*